US008371451B2

(12) United States Patent
Wada et al.

(10) Patent No.: US 8,371,451 B2
(45) Date of Patent: Feb. 12, 2013

(54) BANKNOTE HANDLING APPARATUS

(75) Inventors: Mikio Wada, Hyogo-ken (JP); Yasushi Yokota, Himeji (JP); Junichi Sekiguchi, Himeji (JP); Kenichi Hattori, Himeji (JP); Masayuki Mukaida, Himeji (JP); Hirofumi Masuki, Takasago (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 613 days.

(21) Appl. No.: 12/589,955

(22) Filed: Oct. 30, 2009

(65) Prior Publication Data

US 2010/0108576 A1 May 6, 2010

(30) Foreign Application Priority Data

Nov. 6, 2008 (JP) ..... 2008-285230
Nov. 10, 2008 (JP) ..... 2008-287700

(51) Int. Cl.
*B07C 5/00* (2006.01)

(52) U.S. Cl. ..... 209/534; 194/206; 194/207; 902/12; 902/13

(58) Field of Classification Search ..... 209/534; 194/206, 207; 902/12, 13
See application file for complete search history.

(56) References Cited

U.S. PATENT DOCUMENTS

| | | | | |
|---|---|---|---|---|
| 4,825,378 | A * | 4/1989 | Yuge | 700/223 |
| 5,522,511 | A | 6/1996 | Sakoguchi et al. | 209/534 |
| 5,555,983 | A * | 9/1996 | Yamagishi | 209/534 |
| 6,474,549 | B2 * | 11/2002 | Katou et al. | 235/379 |
| 7,628,279 | B2 * | 12/2009 | Sekiguchi et al. | 209/534 |
| 7,708,192 | B2 * | 5/2010 | Yokoi et al. | 235/379 |
| 7,779,982 | B2 * | 8/2010 | Fitzgerald et al. | 194/206 |
| 2010/0108463 | A1 * | 5/2010 | Renz et al. | 194/206 |
| 2011/0048891 | A1 * | 3/2011 | Iwami | 194/206 |

FOREIGN PATENT DOCUMENTS

| | | |
|---|---|---|
| EP | 1 739 632 | 1/2007 |
| WO | WO 2008/030356 | 3/2008 |

OTHER PUBLICATIONS

European Search Report (2 pages—dated Feb. 10, 2010), Application No. EP 09 17 5141.

* cited by examiner

*Primary Examiner* — Joseph C Rodriguez
(74) *Attorney, Agent, or Firm* — Renner, Kenner, Greive, Bobak, Taylor & Weber

(57) ABSTRACT

A banknote handling apparatus 10 comprises a casing 12, an inlet 20 configured for inserting banknotes into the casing 12 from the exterior thereof, a plurality of storages 40 provided in a lower portion of the casing 12, in a substantially horizontal direction and in parallel relative to one another, and respectively adapted for storing therein the banknotes, and an escrow storage 42 juxtaposed with the respective storages 40 in the casing and adapted for escrowing therein the banknotes inserted into the casing 12 from the exterior thereof through the inlet 20. A transport unit 30 adapted for transporting the banknotes between any two of the inlet 20, respective storages 40 and escrow storage 42 is provided above the respective storages 40 and escrow storage 42 in the casing 12. In addition, a plurality of diverters 36 are provided at diversion points 35 in the transport unit 30 toward each of the storages 40 and escrow storage 42, respectively. Each diverter 36 is adapted for diverting the banknotes transported by the transport unit 30 into a specified storage 40 or escrow storage 42.

19 Claims, 31 Drawing Sheets

140b

| DENOMINATION OF THE BANKNOTES | NUMBER OF THE BANKNOTES |
|---|---|
| A | 250 |

FIG. 12

140c

| | | |
|---|---|---|
| PREDETERMINED INFORMATION OF THE BANKNOTES TO BE DISPENSED | PREDETERMINED DENOMINATION OF THE BANKNOTES TO BE DISPENSED | A |
| | PREDETERMINED NUMBER OF THE BANKNOTES TO BE DISPENSED | 250 |
| | PREDETERMINED NUMBER OF THE BANKNOTES TO BE BUNDLED | 100 |
| | PREDETERMINED NUMBER OF THE BATCHES OF THE BUNDLED BANKNOTES | 2 |

FIG. 13

240b

| | ATTRIBUTES | NUMBER OF THE BANKNOTES |
|---|---|---|
| FACE/BACK | FACE | 50 |
| | BACK | 70 |
| DENOMINATION | A | 90 |
| | B | 30 |
| TOTAL NUMBER OF THE BANKNOTES | | 120 |

FIG. 23

240c

| | | |
|---|---|---|
| PREDETERMINED NUMBER OF THE BANKNOTES | PREDETERMINED TOTAL NUMBER OF THE BANKNOTES | 100 OR MORE |
| | PREDETERMINED NUMBER OF THE FACE/BACK | THE NUMBER OF THE "BACK" IS 50 OR LESS |
| | PREDETERMINED NUMBER OF THE BANKNOTES OF THE PREDETERMINED DENOMINATION | THE NUMBER OF THE DENOMINATION "A" IS 50 OR LESS |
| | PREDETERMINED NUMBER OF THE BANKNOTES TO BE INSERTED | 100 OR MORE |
| PREDETERMINED PROCESS | □ INDIVIDUAL PROCESS | ■ CONTINUOUS PROCESS |
| PREDETERMINED MODE | □ NORMAL MODE | ■ INTERRUPT MODE |
| PREDETERMINED BOOKING | DATE | YYYY/MM/DD |
| | DAY OF THE WEEK | FRIDAY |
| | TIME | STARTING TIME 17 : 00<br>ENDING TIME 18 : 00 |

FIG. 24

BANKNOTE HANDLING APPARATUS

FIELD OF THE INVENTION

The present invention relates to a banknote handling apparatus used for performing a depositing process for banknotes or the like, and in particular relates to the banknote handling apparatus adapted for performing the depositing process for a large number of banknotes in one dealing operation.

BACKGROUND OF THE INVENTION

In the past, as disclosed in JP10-188077A, various banknote handling apparatuses, each designed for performing the depositing process and/or dispensing process for the banknotes, have been known. In the conventional banknote handling apparatus as disclosed in JP10-188077A, a plurality of storages (or storage units), each adapted for storing therein the banknotes, for each denomination thereof, are provided to a lower portion of a casing, while an escrow unit adapted for escrowing or temporarily storing therein the banknotes is provided above the respective storages in the casing. Additionally, a transport unit adapted for transporting the banknotes inserted in the casing from an inlet is provided above the escrow unit in the casing. Further, a bundling unit for bundling each batch of the banknotes accumulated in a stacked condition is provided above the transport unit.

In the banknote handling apparatus disclosed in JP10-188077A, the banknotes inserted in the casing from the inlet are first transported into the casing by the transport unit, while being recognized about the denomination or the like thereof by a recognition unit provided along the transport unit. Then, the banknotes are escrowed (or temporarily stored) in the escrow unit. Once the depositing process for the banknotes is confirmed, the banknotes escrowed in the escrow unit will be stored in the respective storages, for each denomination of the banknotes. Meanwhile, upon dispensing the banknotes stored in the respective storages, as bundled banknotes, the banknotes are first transported to the bundling unit from the respective storages, then a bundling process for forming each batch of the banknotes is performed, and finally the bundled banknotes are dispensed from a bundled-banknote outlet.

DISCLOSURE OF THE INVENTION

However, in the conventional banknote handling apparatus as disclosed in JP10-188077A, the provision of the escrow unit above the respective storages in the casing rather increases the height of the casing, causing the space required for installing such a banknote handling apparatus to be inconveniently widened.

Additionally, since the escrow unit is located above the respective storages in the casing, increase of the capacity of the escrow unit would decrease the capacity of each storage, leading to unwanted reduction of the total storage amount of the banknotes in the banknote handling apparatus. Meanwhile, decrease of the capacity of the escrow unit may cause the depositing process to be continued for an unduly long time, especially in the case of storing a relatively large number of banknotes in the banknote handling apparatus. This renders the banknote handling apparatus rather inconvenient for the operator.

The present invention was made in light of the above problems. Therefore, it is an object of this invention to provide the banknote handling apparatus, in which the respective storages and escrow unit are arranged in parallel with one another in the casing, whereby the capacity of each of the storages and escrow unit can be increased, while restricting the increase of the height of the casing, thus enabling the banknote handling apparatus to successfully store therein a significantly large number of banknotes, as well as enabling the depositing process for such a large number of banknotes to be adequately performed in one dealing operation.

A banknote handling apparatus of the present invention comprises a casing; an inlet configured for inserting banknotes into the casing from the exterior thereof; a plurality of storages provided in a lower portion of the casing, in a substantially horizontal direction and in parallel relative to one another, and respectively adapted for storing therein the banknotes; an escrow storage juxtaposed with the respective storages in the casing and adapted for escrowing therein the banknotes inserted into the casing from the exterior thereof through the inlet; a transport unit provided above the respective storages and escrow storage in the casing and adapted for transporting the banknotes between any two of the inlet, storages and escrow storage; and a plurality of diverters respectively provided at diversion points in the transport unit toward the respective storages and escrow storage, and adapted for diverting the banknotes transported by the transport unit into a specified storage or escrow storage.

In the banknote handling apparatus of the present invention, the escrow storage may have substantially the same capacity as the capacity of each of the storages.

In the banknote handling apparatus of the present invention, the transport unit may have a laterally elongated loop-like transport path located above the respective storages and escrow storage.

In this case, the transport unit may further include a plurality of diversion transport paths, each branched downward from the loop-like transport path and connected with each of the storages and escrow storage.

In this case, each diverter may be composed of a diversion claw provided to each diversion point at which the diversion transport path is branched from the loop-like transport path, and the diverter composed of the diversion claw can be rotated about a shaft, whereby the banknotes transported by the transport unit can be diverted into the specified storage or escrow storage, due to the rotation of the diverter corresponding to the storage or escrow storage to which the banknotes are to be fed, upon feeding the banknotes transported in the loop-like transport path into each of the storages or escrow storage.

The banknote handling apparatus of the present invention may further comprise: a bundling unit provided above the transport unit in the casing and adapted for bundling the banknotes transported from the transport unit; and a bundled-banknote outlet provided in the vicinity of the inlet and configured for dispensing bundled banknotes bundled by the bundling unit to the exterior of the casing.

The banknote handling apparatus of the present invention may further comprise: the bundling unit provided in the casing and adapted for bundling a plurality of loose banknotes accumulated in a stacked condition; and the bundled-banknote outlet configured for dispensing the bundled-banknotes bundled by the bundling unit to the exterior of the casing, and a plurality of batches of the bundled-banknotes can be accumulated in the bundled-banknote outlet.

In this case, an opening configured for allowing the bundled banknotes to be taken out therefrom may be provided to the bundled-banknote outlet, a shutter mechanism adapted for opening and closing the opening may be provided to the opening, and the shutter mechanism may be configured not to open the opening of the bundled-banknote outlet until a predetermined number of bundled banknotes are accumulated in the bundled-banknote outlet.

The bundling unit may include a stacking unit adapted for accumulating therein the plurality of loose banknotes in the stacked condition, a bundling mechanism adapted for bundling the plurality of loose banknotes accumulated in the stacked condition, and a transport arm adapted for transporting the plurality of loose banknotes accumulated in the stacked condition from the stacking unit to the bundling mechanism, while transporting the bundled banknotes bundled by the bundling mechanism from the bundling mechanism to the bundled-banknote outlet, and the transport arm may be located in a substantially central position of the bundling unit, while the stacking unit, bundling mechanism and bundled-banknote outlet are arranged around the transport arm, respectively, such that the transport arm is movable between any two of the stacking unit, bundling mechanism and bundled-banknote outlet.

In this case, the bundled-banknote outlet may include a mounting mechanism adapted for placing thereon the plurality of batches of the bundled banknotes and a lifting and lowering table provided below the mounting mechanism and configured to be vertically movable, and the bundled banknotes may be first transferred from the transport arm onto the lifting and lowering table at a point below the mounting mechanism, then the lifting and lowering table may be elevated and reach the mounting mechanism, whereby the bundled banknotes on the lifting and lowering table can be transferred onto the mounting mechanism.

The mounting mechanism may be composed of claws, each provided to be upwardly rotatable about a shaft from a state extending in a substantially horizontal direction, and when no force is applied to each claw from below, the claws may extend in the substantially horizontal direction, while one or more batches of the bundled banknotes can be placed on the claws extending in the substantially horizontal direction, and when the lifting and lowering table reaches the mounting mechanism, the bundled-banknotes on the lifting and lowering table may push and rotate each claw upward, whereby the bundled banknotes on the lifting and lowering table and the bundled banknotes placed on the mounting mechanism can be overlapped with one another, and thereafter, when the lifting and lowering table is lowered, the bundled banknotes on the lifting and lowering table can be transferred onto the mounting mechanism.

The bundled-banknote outlet may include the mounting mechanism adapted for placing thereon the plurality of batches of the bundled banknotes and the lifting and lowering table provided below the mounting mechanism and configured to be vertically movable, and when the lifting and lowering table is elevated and reaches the mounting mechanism, the bundled banknotes on the lifting and lowering table may be transferred to the mounting mechanism, and a restricting member adapted for restricting upward movement of the bundled banknotes may be provided to a top portion of the bundled-banknote outlet in a position opposite to the lifting and lowering table.

In the banknote handling apparatus of the present invention, the banknote handling apparatus may be adapted for dispensing a predetermined number of banknotes for each dispensing process, and may further comprise: an escrow stage adapted for stacking therein the loose banknotes; the bundling unit adapted for bundling a predetermined number of loose banknotes stacked in the escrow stage, so as to form the bundled banknotes; an outlet configured for dispensing the loose banknotes; and a control unit adapted for feeding out the loose banknotes stored in the storages and stacking them in the escrow stage, then transporting the loose banknotes stacked in the escrow stage to the bundling unit, and thereafter feeding out the loose banknotes, corresponding to a fraction less than the predetermined number of the banknotes to be bundled, from the storages and transporting them to the outlet.

In this case, the inlet and outlet may be provided in an integrated form.

The control unit may be adapted for feeding out the loose banknotes corresponding to the fraction from the storages and transporting them to the outlet, in the case in which the bundled banknotes formed by the bundling unit corresponds to the last batch.

The control unit may be adapted for feeding out the fraction of the banknotes from the storages and transporting them to the outlet, during a period of time after the loose banknotes stacked in the escrow stage are transported to the bundling unit and before next loose banknotes are stacked in the escrow stage, in the case in which the plurality of batches of the bundled banknotes are formed by the bundling unit.

The banknote handling apparatus of the present invention may further comprise an operation unit adapted for receiving instructions for a dispensing process, including the number of the banknotes to be dispensed, the amount of money of the banknotes to be dispensed and the number of the bundled banknotes, and the control unit may be adapted for judging whether or not the bundled banknotes formed by the bundling unit corresponds to the last batch, based on the number of the bundled banknotes received by the operation unit.

The banknote handling apparatus of the present invention may further comprise a recognition unit adapted for recognizing the denomination and number of the loose banknotes fed out from the storages, and the control unit may be adapted for judging whether or not the bundled banknotes formed by the bundling unit corresponds to the last batch, based on a recognition result of the recognition unit.

The banknote handling apparatus of the present invention may further comprise: the transport arm adapted for transporting the predetermined number of banknotes stacked in the escrow stage to the bundling unit; and a transport arm detector adapted for detecting the position of the transport arm, and the control unit may be adapted for feeding out the fraction of the loose banknotes from the storages and transporting them to the outlet, at least during a period of time that the transport arm detector detects that the transport arm is out of a predetermined range from the escrow stage, in the case in which the predetermined number of loose banknotes stacked in the escrow stage are transported to the bundling unit.

BRIEF DESCRIPTION OF THE DRAWINGS

FIG. 4 shows an orientation of the diverter when one banknote is transported from a transport path depicted on the right side toward a diversion point.

FIG. 5 shows the orientation of the diverter when the banknote is transported from the transport path depicted on the left side toward the diversion point.

FIG. 6 shows the orientation of the diverter when the banknote is transported from a diversion transport path toward the diversion point.

FIG. 12 is a diagram schematically showing recognition information shown in FIG. 11.

FIG. 13 is a diagram schematically showing predetermined information shown in FIG. 11.

FIG. 23 is a diagram schematically showing the recognition information shown in FIG. 22.

FIG. 24 is a diagram schematically showing the predetermined information shown in FIG. 22.

DETAILED DESCRIPTION OF THE INVENTION

First Embodiment

Figure 1:
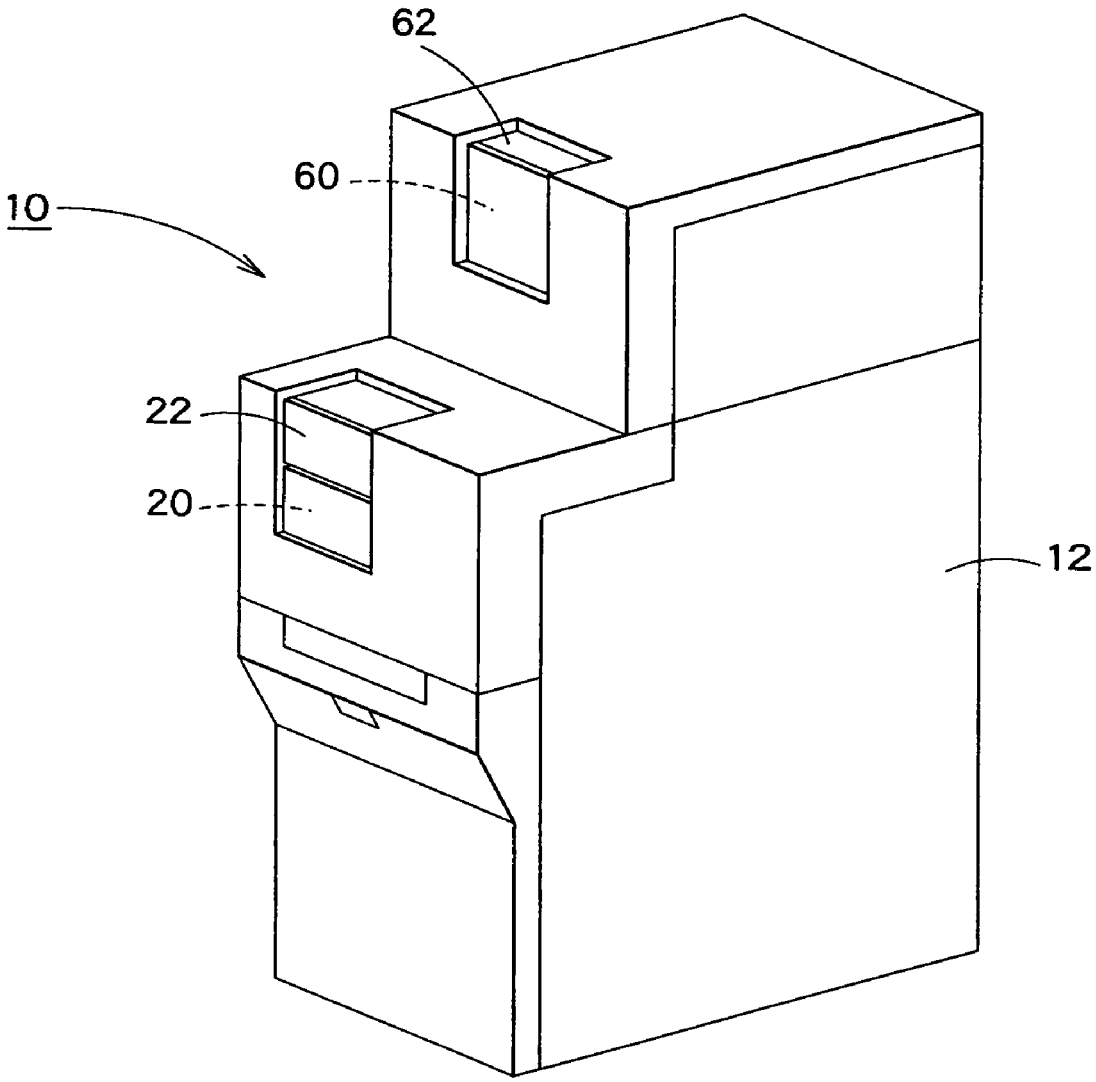
FIG. 1 is a perspective view showing external appearance of a banknote handling apparatus related to a first embodiment of the present invention.
Figure 2:
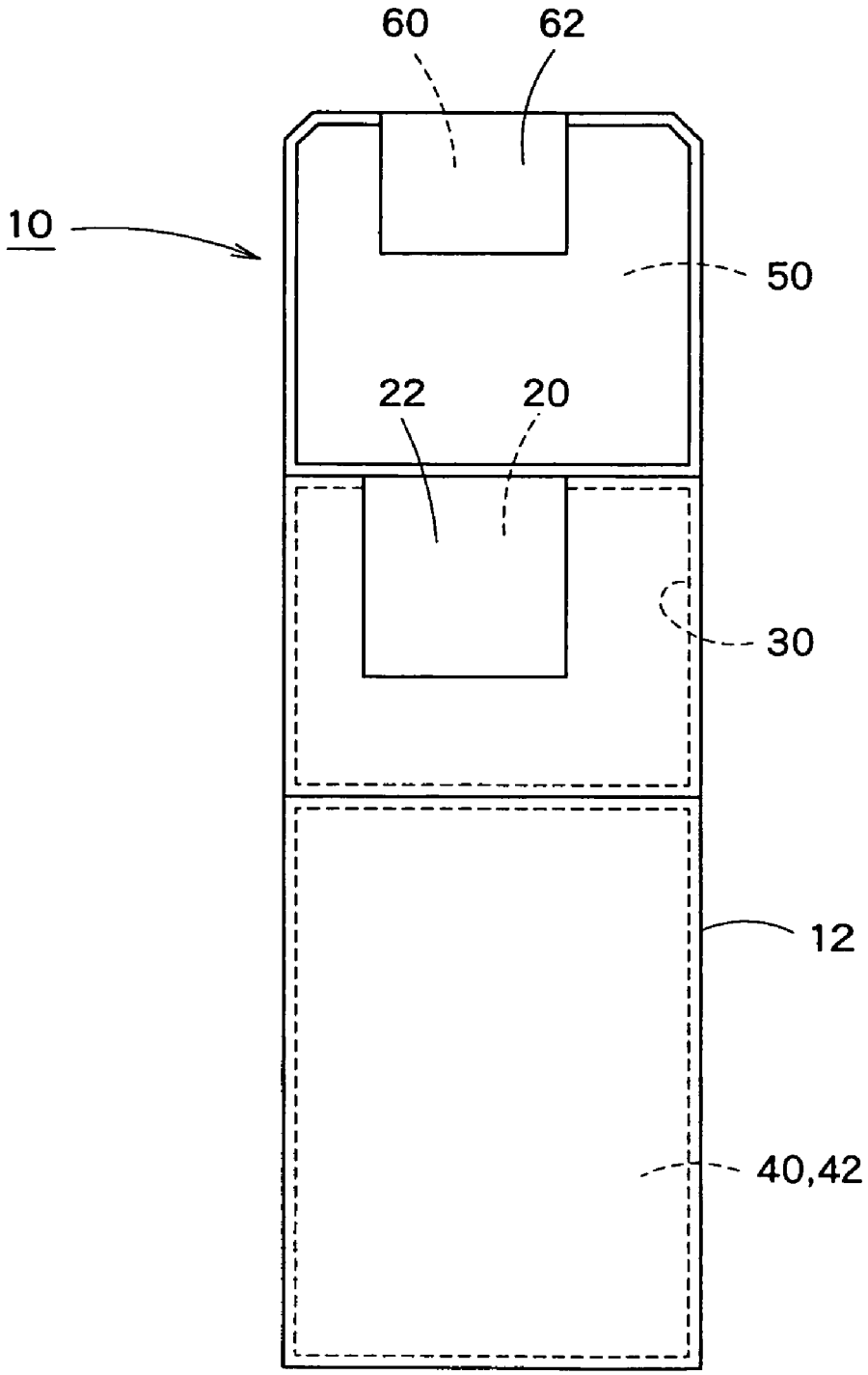
FIG. 2 is a front view of the banknote handling apparatus shown in FIG. 1.
Figure 3:
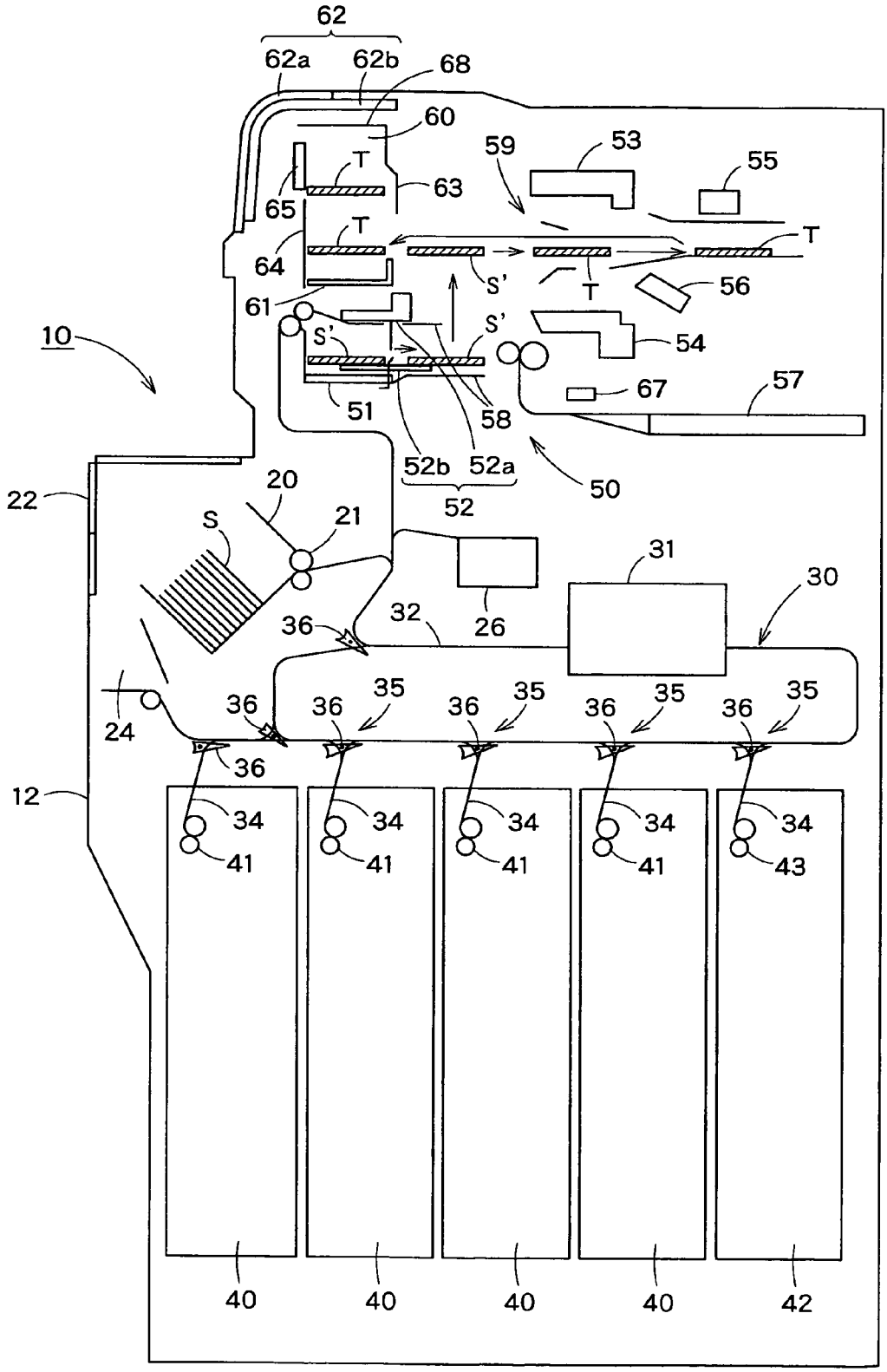
FIG. 3 is a schematic diagram showing construction of the interior of the banknote handling apparatus shown in FIG. 1.
Figure 5:
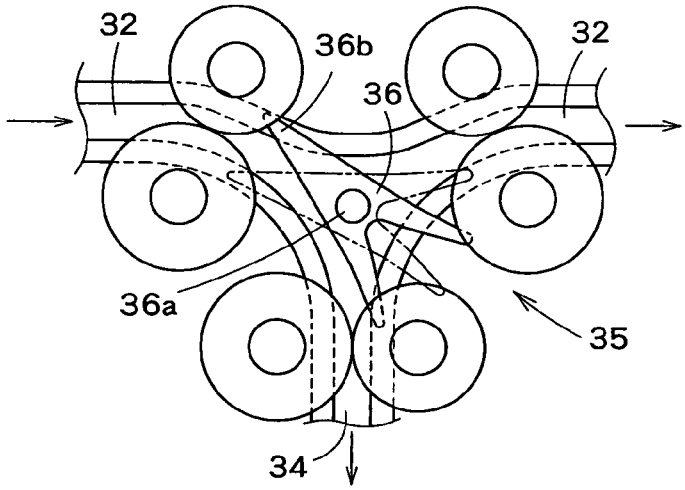
FIG. 5 is an enlarged view showing the construction of the diverter provided in the banknote handling apparatus shown in FIG. 3. More specifically.
Figure 6:
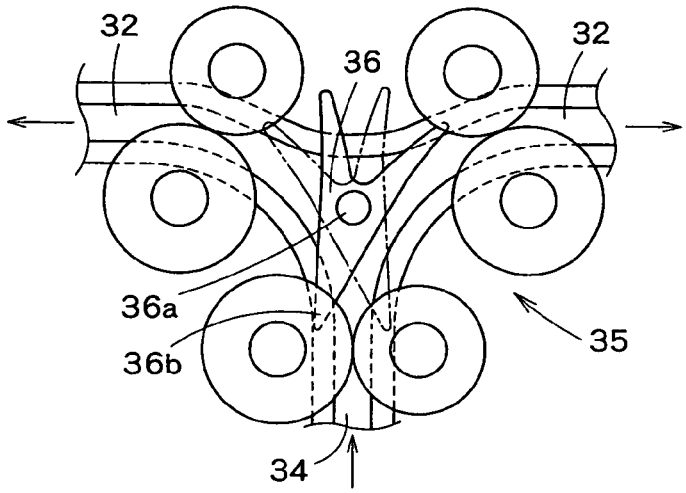
FIG. 6 is an enlarged view showing the construction of the diverter provided in the banknote handling apparatus shown in FIG. 3. More specifically.
Figure 7:
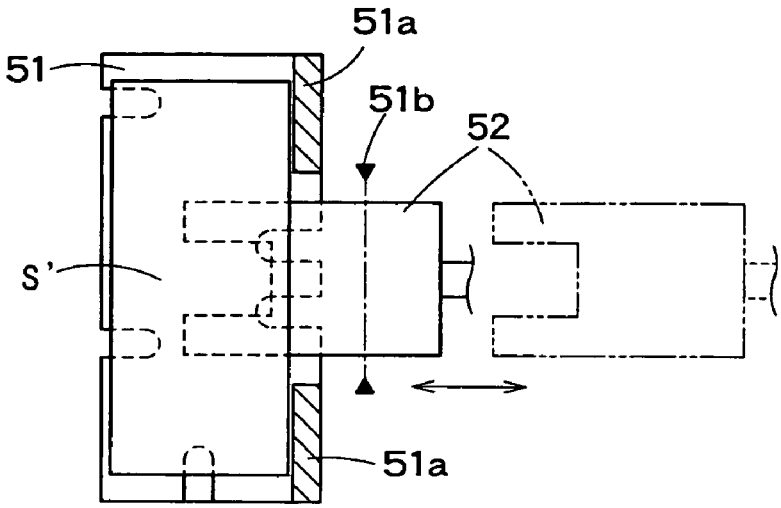
FIG. 7 is a top view showing a relationship between an escrow stage and a transport arm, respectively provided in the banknote handling apparatus shown in FIG. 3.
Figure 8A:
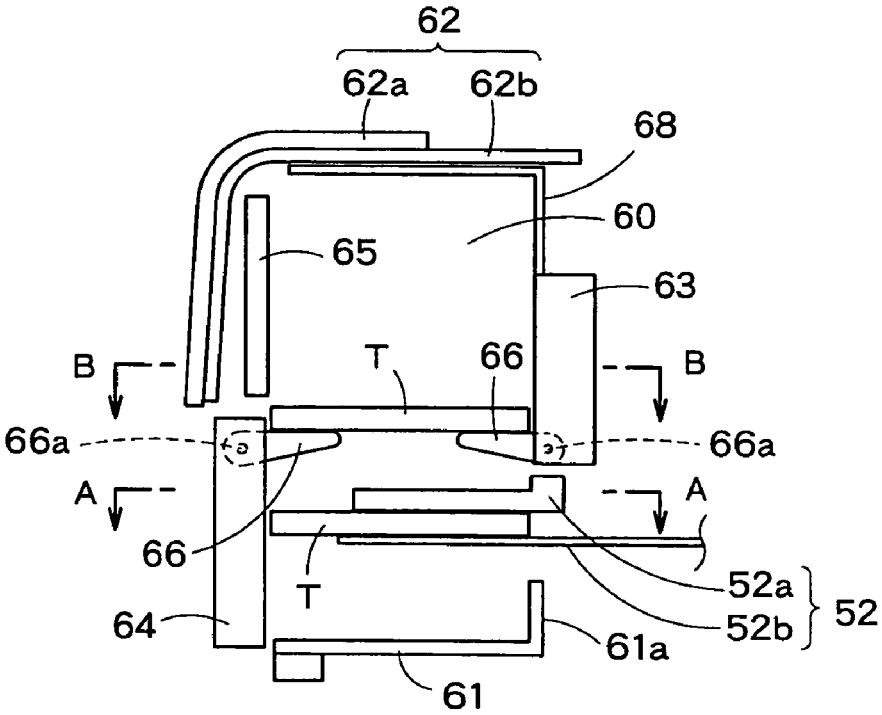
FIG. 8A is a side view showing construction of a bundled-banknote outlet and a shutter mechanism, respectively provided in the banknote handling apparatus shown in FIG. 3.
Figure 8B:
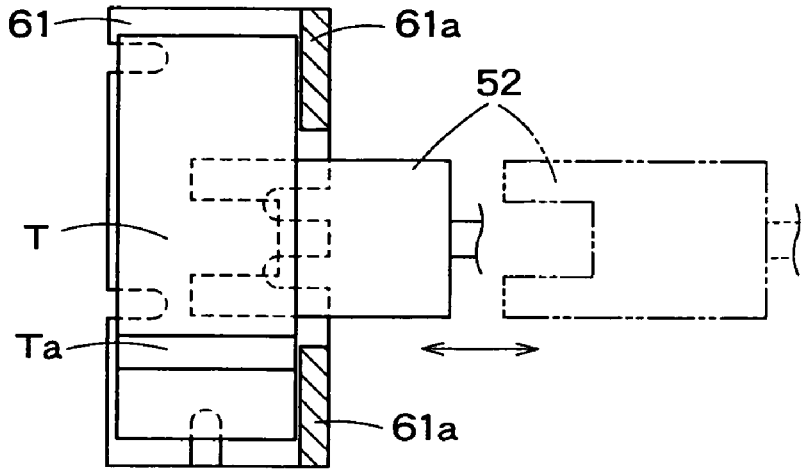
FIG. 8B is a top view, seen along a line A-A of FIG. 8A, of an outlet stage provided to the bundled-banknote outlet and the transport arm advanced into a space above the outlet stage, respectively shown in FIG. 8A.
Figure 9:
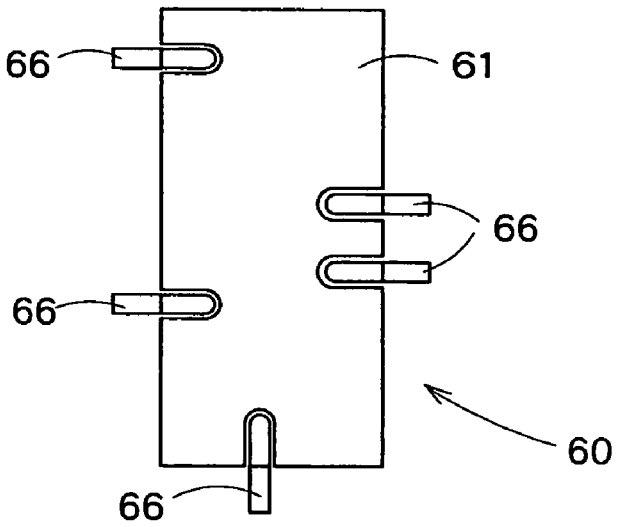
FIG. 9 is a top view, seen along a line B-B of FIG. 8A, of the outlet stage and claws, respectively provided to the bundled-banknote outlet shown in FIG. 8A.

Hereinafter, a first embodiment of the present invention will be described with reference to the drawings. FIGS. 1 through 10 show one exemplary banknote handling apparatus related to this embodiment, respectively. Of these drawings, FIG. 1 is a perspective view showing external appearance of the banknote handling apparatus related to the first embodiment of the present invention, and FIG. 2 is a front view of the banknote handling apparatus shown in FIG. 1. FIG. 3 is a schematic diagram showing construction of the interior of the banknote handling apparatus shown in FIG. 1, and FIGS. 4 through 6 are enlarged views respectively showing construction of a diverter provided in the banknote handling apparatus shown in FIG. 3. FIGS. 7 through 9 are diagrams respectively showing an escrow stage, a bundled-banknote outlet and a shutter mechanism, respectively provided in the banknote handling apparatus shown in FIG. 3, and FIGS. 10(*a*) through 10(*g*) are diagrams respectively showing, in succession, an operation when bundled banknotes are transferred from a bundling unit provided in the banknote handling apparatus shown in FIG. 3 to the bundled-banknote outlet.

First, referring to FIGS. 1 through 3, general construction of the banknote handling apparatus 10 of this embodiment will be described. In FIG. 3, reference character S designates loose banknotes, reference character S' denotes each batch of the loose banknotes accumulated in a stacked condition, and reference character T designates the bundled banknotes. As shown in FIG. 1, the banknote handling apparatus 10 comprises a casing 12 of a rectangular parallelepiped shape. In a front face of the casing 12, a receiving and dispensing unit 20 is provided to be exposed to the outside of the casing 12. This receiving and dispensing unit 20 is used for receiving the loose banknotes inserted from the exterior of the casing 12 to the interior thereof as well as used for dispensing the loose banknotes from the interior of the casing 12 to the exterior thereof. Further, an opening is provided to the receiving and dispensing unit 20, and a shutter mechanism 22 is provided to the opening. Thus, the opening of the receiving and dispensing unit 20 can be optionally opened and closed by the shutter mechanism 22. It is noted that, as shown in FIG. 3, four storage cassettes 40 and one escrow storage cassette 42 are respectively provided to a lower portion of the casing 12, while being arranged in a substantially horizontal direction and in parallel with one another. In this case, each storage cassette is configured to store therein the banknotes, for each denomination thereof. Meanwhile, the escrow storage cassette 42 is configured to escrow (or temporarily store) therein the banknotes inserted from the exterior of the casing 12 to the interior thereof via the receiving and dispensing unit 20.

Again, as shown in FIG. 3, a transport unit 30 is provided above the respective storage cassettes 40 and escrow storage cassette 42 in the casing 12. The transport unit 30 is configured to transport the banknotes between any two of the receiving and dispensing unit 20, each of the storage cassettes 40 and escrow storage unit 42. Additionally, a bundling unit 50 adapted for bundling the banknotes transported from the transport unit 30 is provided above the transport unit 30 in the casing 12. Further, in the front face of the casing 12, a bundled-banknote outlet 60 is provided to be exposed to the outside of the casing 12. This bundled-banknote outlet 60 is used for dispensing the bundled banknotes bundled by the bundling unit 50 to the exterior of the casing 12. As shown in FIGS. 1 and 2, the bundled-banknote outlet 60 is located in the vicinity of the receiving and dispensing unit 20. Further, an opening is provided to the bundled-banknote outlet 60, and a shutter mechanism 62 is provided to the opening. Thus, the opening of the bundled-banknote outlet 60 can be optionally opened and closed by the shutter mechanism 62.

Hereinafter, each component of the banknote handling apparatus 10 as generally constructed above will be detailed.

As shown in FIGS. 1 through 3, the receiving and dispensing unit 20 is provided in the front face of the casing 12, such that an operator can insert each batch of the loose banknotes S into the receiving and dispensing unit 20 or take out the batch of the loose banknotes S from the receiving and dispensing unit 20. More specifically, as shown in FIG. 3, the receiving and dispensing unit 20 is inclined obliquely to the vertical direction, thus enabling the loose banknotes S to be inserted into the receiving and dispensing unit 20, while being obliquely inclined. A banknote feeding mechanism 21 is provided to the receiving and dispensing unit 20, such that the loose banknotes S accumulated or stacked in the receiving and dispensing unit 20 can be fed to the transport unit 30, one by one, by the banknote feeding mechanism 21. Meanwhile, upon dispensing the loose banknotes, the loose banknotes S can be fed into the receiving and dispensing unit 20 one by one, from the transport unit 30.

As shown in FIG. 1 and the other related drawings, the shutter mechanism 22 is provided to the opening of the receiving and dispensing unit 20, such that the opening of the receiving and dispensing unit 20 can be optionally opened and closed by the shutter mechanism 22. More specifically, when the operator inserts the batch of the loose banknotes S into the receiving and dispensing unit 20 or takes out the batch of the loose banknotes S from the receiving and dispensing unit 20, the shutter mechanism 22 will be actuated to expose the receiving and dispensing unit 20 to the outside of the casing 12. Meanwhile, when the loose banknotes S are fed to the transport unit 30, one by one, by the banknote feeding mechanism 21 or when the loose banknotes S are fed to the receiving and dispensing unit 20, one by one, from the transport unit 30, the shutter mechanism 22 will be actuated to close the receiving and dispensing unit 20.

As shown in FIG. 3, a recognition unit 31 is provided to the transport unit 30. The recognition unit 30 can serve to recognize the denomination, fitness, authentication and the like of each banknote fed to the transport unit 30 from the receiving and dispensing unit 20. In addition, a deposit reject unit 24 is provided in the casing 12, while being connected with the transport 30. In this case, each banknote recognized, as an abnormal or rejected banknote, among the inserted or deposited banknotes, by the recognition unit 31 and/or banknote that cannot be recognized by the recognition unit 31 will be fed to the deposit reject unit 24 from the transport unit 30. A dispense reject unit 26 is also provided in the casing 12, while being connected with the transport unit 30. In this case, each banknote recognized, as the abnormal or rejected banknote, among the banknotes fed out from the escrow storage cassette 42 upon the dispensing process, by the recognition unit 31 and/or banknote that cannot be recognized by the recognition unit 31 will be fed to the dispense reject unit 26 from the transport unit 30.

Further, as shown in FIG. 3, the respective storage cassettes 40 and escrow storage cassette 42 are arranged backward (or from left to right in FIG. 3), in parallel with one another, in the casing 12. Each of the storage cassettes 40 and escrow storage cassette 42 is configured to receive the banknotes, one by one, from the transport unit 30. Typically, each of the storage cassettes 40 and escrow storage cassette 42 is of a flat and substantially rectangular parallelepiped shape for allowing the banknotes transported from the transport unit 30 to be stored therein in the stacked condition. Additionally, the storage cassettes 40 and escrow storage cassette 42 are provided with banknote feeding mechanisms 41, 43, respectively. With these banknote feeding mechanisms 41, 43, the banknotes stored in each of the storage cassettes 40 and escrow storage cassette 42 can be fed out to the transport unit 30, one by one.

The capacity (or banknote storage amount) of the escrow storage cassette 42 may be substantially the same as the capacity of each storage cassette 40. In this case, the escrow storage cassette 42 can be formed of the same part or material as that of each storage cassette 40.

As shown in FIG. 3, the transport unit 30 has a laterally elongated loop-like transport path 32 that is located above the respective storage cassettes 40 and escrow storage cassette 42. In addition, the transport unit 30 includes a plurality of diversion transport paths 34, each branched downward from the loop-like transport path 32 and connected with each corresponding one of the storage cassettes 40 and escrow storage cassette 42. Therefore, as depicted in FIG. 3, a plurality of diversion points 35 (or T-shaped paths), each corresponding to a point at which each diversion transport path is connected with the loop-like transport path 32, are provided along the transport path 32.

A diverter 36 composed of a diversion claw is located at each diversion point 35 for the respective storage cassettes 40 and escrow storage cassette 42, along the transport path 32 of the transport unit 30. Each diverter 36 is configured to divert the banknotes transported through the transport path 32 of the transport unit 30 to a specified storage cassette 40 or escrow storage cassette 42.

Figure 4:
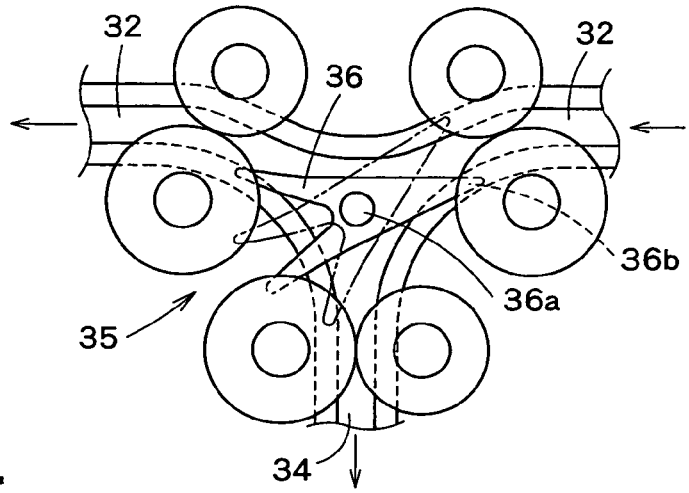
FIG. 4 is an enlarged view showing construction of a diverter provided in the banknote handling apparatus shown in FIG. 3. More specifically.

Now, referring to FIGS. 4 through 6, more specific construction of the diverter 36 located at each diversion point 35 will be described. Of these drawings, FIG. 4 is a diagram showing an orientation of one exemplary diverter 36 when one banknote is transported from the transport path 32 depicted on the right side toward one exemplary diversion point 35. FIG. 5 is a diagram showing the orientation of the diverter 36 when the banknote is transported from the transport path 32 depicted on the left side toward the diversion point 35. FIG. 6 is a diagram showing the orientation of the diverter 36 when the banknote is transported from one exemplary diversion transport path 34 toward the diversion point 35.

As shown in FIGS. 4 through 6, the diverter 36 is composed of the diversion claw of an elongated isosceles-triangular shape (or clothespin-like shape). This diverter 36 is configured to be rotatable about a shaft 36*a* located in a substantially central position of the diverter 36. In this case, the orientation of the diverter 36, more specifically the position of a distal end 36*b* of the diverter 36, can be determined, based on the direction in which the banknote is transported toward the diversion point 35 as well as on the transport path to which the banknote is transported from the diversion point 35.

More specifically, as shown in FIG. 4, when the banknote is transported from the transport path 32 on the right side toward the diversion point 35, the distal end 36*b* of the diverter 36 will be substantially oriented toward the transport path 32 on the right side. Thereafter, when the banknote is further transported from the transport path 32 on the right side toward the transport path 32 on the left side at the diversion point 35, the diverter 36 will be rotated about the shaft 36*a* to be oriented as depicted by a solid line in FIG. 4. Namely, in this case, the position of the distal end 36*b* of the diverter 36 is controlled in such a manner. Meanwhile, when the banknote is transferred from the transport path 32 on the right side toward the diversion transport path 34 at the diversion point 35, the diverter 36 will be rotated about the shaft 36*a* to be oriented as depicted by a two-dot chain line in FIG. 4. Namely, in this case, the position of the distal end 36*b* of the diverter 36 is controlled in such a manner.

Alternatively, as shown in FIG. 5, when the banknote is transported from the transport path 32 on the left side toward the diversion point 35, the distal end 36*b* of the diverter 36 will be substantially oriented toward the transport path 32 on the left side. Thereafter, when the banknote is further transported from the transport path 32 on the left side toward the diversion transport path 34 at the diversion point 35, the diverter 36 will be rotated about the shaft 36*a* to be oriented as depicted by a solid line in FIG. 5. Namely, in this case, the position of the distal end 36*b* of the diverter 36 is controlled in such a manner. Meanwhile, when the banknote is transported from the transport path 32 on the left side toward the transport path 32 on the right side at the diversion point 35, the diverter 36 will be rotated about the shaft 36*a* to be oriented as depicted by a two-dot chain line in FIG. 5. Namely, in this case, the position of the distal end 36*b* of the diverter 36 is controlled in such a manner.

Alternatively, as shown in FIG. 6, when the banknote is transported from the diversion transport path 34 toward the diversion point 35, the distal end 36*b* of the diverter 36 will be substantially oriented toward the diversion transport path 34. Thereafter, when the banknote is further transported from the diversion transport path 34 toward the transport path 32 on the right side at the diversion point 35, the diverter 36 will be rotated about the shaft 36*a* to be oriented as depicted by a solid line in FIG. 6. Namely, in this case, the position of the distal end 36*b* of the diverter 36 is controlled in such a manner. Meanwhile, when the banknote is transported from the diversion transport path 34 toward the transport path 32 on the left side at the diversion point 35, the diverter 36 will be rotated about the shaft 36*a* to be oriented as depicted by a two-dot chain line in FIG. 6. Namely, in this case, the position of the distal end 36*b* of the diverter 36 is controlled in such a manner.

As described above, the plurality of diverters 36, respectively formed of the diversion claws, are provided to the diversion points 35, at which the diversion transport paths 34 are respectively branched from the loop-like transport path 32 in the transport unit 30. In this case, each diverter 36 can be rotated about the shaft 36*a*. Namely, upon feeding the banknotes transported by the loop-like transport path 32 into each selected one of the storage cassette 40 or escrow storage cassette 42, each diverter 36 can be rotated, corresponding to the selected one of the storage cassettes 40 and escrow storage cassette 42 for receiving the banknotes. In this way, each banknote transported by the transport unit 30 can be diverted to the specified storage cassette 40 or escrow storage cassette 42. In addition, with the control of the orientation of each diverter 36, the banknotes fed out by the banknote feeding mechanisms 41, 43 toward the diversion transport path 34 from the storage cassettes 40 and/or escrow storage cassette 42 can be fed to the loop-like transport path 32, respectively.

The bundling unit 50 provided above the transport unit 30 is configured to bundle the banknotes transported from the transport unit 30. Now, referring to FIG. 3, specific construction of the bundling unit 50 will be discussed. As described above, in FIG. 3, the reference character S' denotes each batch of the loose banknotes accumulated in the stacked condition, while the reference character T designates the bundled banknotes.

As shown in FIG. 3, an escrow stage 51 is provided to the bundling unit 50. On the escrow stage 51, the banknotes fed, one by one, from the transport unit 30 can be accumulated in the stacked condition. In the vicinity of the escrow stage 51, batch guide units 58 are provided. In addition, a transport arm 52 is provided to the bundling unit 50. This transport arm 52 can serve to collectively transport each batch S' of the loose banknotes accumulated in the stacked condition on the escrow stage 51. More specifically, the batch guide units 58 are respectively provided above and below the escrow stage 51. Therefore, when the batch S' of the loose banknotes accumulated or stacked on the escrow stage 51 is pulled or taken out from the escrow stage 51 by the transport arm 52, unwanted spreading of each edge of the batch S' of the loose banknotes can be successfully prevented. In addition, the transport arm 52 is composed of an upper arm 52*a* and a lower arm 52*b*, so that the banknotes can be grasped, from above and below, between the upper arm 52*a* and the lower arm 52*b*. Then, with proper vertical movement of the upper arm 52*a*, the banknotes can be optionally grasped and released.

The bundling unit 50 includes an upper banknote holding unit 53, a lower banknote holding unit 54, a heater 56, a bundling-paper supply unit 57, and a printing unit 67. With the upper banknote holding unit 53, lower banknote holding unit 54, heater 56, bundling-paper supply unit 57 and printing unit 67, a bundling mechanism 59 is constituted. As described above, once one batch S' of the loose banknotes is transferred to the transport arm 52, the transport arm 52 is moved to a position between the upper banknote holding unit 53 and the lower banknote holding unit 54. Subsequently, bundling paper is supplied to the batch S' placed on the transport arm 52 from the bundling-paper supply unit 57, and is then wound around the batch S' of the loose banknotes. Thereafter, the batch S' of the loose banknotes wound with the bundling paper is pressed, from above and below, by the upper banknote holding unit 53 and lower banknote holding unit 54, while being heated by the heater 56. In this manner, a bundling process (or binding process) for the batch S' of the loose banknotes with the bundling paper is carried out, thereby to form the bundled banknote T.

A stamp 55 for printing each bundling paper of the bundled banknotes T is provided to the bundling unit 50. Namely, the bundled banknotes T subjected to the bundling process due to the bundling mechanism 59 are fed to the stamp 55, and marks, such as a name of a bank, a mark indicating a fit or unfit note and the like, are stamped onto the bundling paper of the bundled banknotes T by the stamp 55. In addition, the printing unit 67 adapted for printing a date, a serial number and the like on the bundling paper is provided to the bundling unit 50. Thus, such a printing process is provided to the bundling paper by the printing unit 67 each time the bundling paper is fed from the bundling-paper supply unit 57.

Thereafter, the bundled banknotes T are fed to the bundled-banknote outlet 60 by the transport arm 52. In this case, multiple batches of the bundled banknotes T can be accumulated or stacked in the bundled-banknote outlet 60, with the opening of the bundled-banknote outlet 60 closed by the shutter mechanism 62. Once the multiple batches of the bundled-banknotes T are stacked in the bundled-banknote outlet 60, the opening of the bundled-banknote outlet 60 is opened by the shutter mechanism 62. Thus, the operator can collectively take out the multiple batches of the bundled banknotes T from the bundled-banknote outlet 60. It is noted that the shutter mechanism 62 is configured not to open the opening of the bundled-banknote outlet 60 until a predetermined number of bundled banknotes T are stacked in the bundled-banknote outlet 60.

When seen from one side, the transport arm 52 is located in a substantially central position of the bundling unit 50, while the escrow stage 51, bundling mechanism 59, stamp 55, printing unit 67 and bundled-banknote outlet 60 are located around the transport arm 52, respectively. Additionally, the transport arm 52 is movable between any two of the escrow stage 51, bundling mechanism 59, stamp 55 and bundled-banknote outlet 60.

Next, more specific construction of the escrow stage 51, bundled-banknote outlet 60 and shutter mechanism 62 will be described with reference to FIGS. 7 through 9. Of these drawings, FIG. 7 is a top view showing a relationship between the escrow stage 51 and the transport arm 52, FIG. 8A is a side view showing construction of the bundled-banknote outlet 60 and shutter mechanism 62, and FIG. 8B is a top view, seen along a line A-A of FIG. 8A, of an outlet stage 61 provided to the bundled-banknote outlet 60 and the transport arm 52 advanced into a space above the outlet stage 61, respectively shown in FIG. 8A. FIG. 9 is a top view, seen along a line B-B, of the outlet stage 61 and claws 66, respectively provided to the bundled-banknote outlet 60 shown in FIG. 8A. As described above, in FIG. 7, the reference character S' designates each batch of a predetermined number of loose banknotes. Additionally, in FIGS. 8A and 8B, the reference character T denotes again the bundled banknotes, and Ta designates each bundling paper wound around the bundled banknotes.

As shown in FIG. 7, two, left and right, side walls 51*a* are provided to extend upward from the escrow stage 51, and a proper space for allowing the transport arm 52 to be advanced therethrough is provided between the two side walls 51*a*. Through this space, the transport arm 52 can grasp each batch S' of the predetermined number of loose banknotes stacked on the escrow stage 51 and then transport the batch S' to the bundling unit 50. In the vicinity of the escrow stage 51 (or in a position at a predetermined distance from the escrow stage 51), a shade sensor 51*b* is provided. When the shade sensor 51*b* is shaded (i.e., when the transport arm 52 is present within a predetermined range from the escrow stage 51), this sensor 51*b* will transmit a detection signal to a control unit 120 that will be described later. However, when the shade sensor 51*b* is not shaded (i.e., when the transport arm 52 is out of the predetermined range from the escrow stage 51), the sensor 51*b* will not transmit the detection signal to the control unit 120. Namely, this shade sensor 51 can serve as a transport arm detector adapted for detecting whether or not the transport arm 51 is out of the predetermined range from the escrow stage 51.

As shown in FIG. 8A, the outlet stage 61 configured to be vertically movable and adapted for placing thereon the bundled banknotes T is provided to a lower portion of the bundled-banknote outlet 60. More specifically, this outlet stage 61 is configured such that only one batch of the bundled banknotes T can be placed thereon. Further, as shown in FIGS. 8A and 8B, side walls 61*a* are provided to extend upward from an edge of the outlet stage 61. More specifically, as shown in FIG. 8B, two, left and right, side walls 61*a* are provided to extend upward from the outlet stage 61, and an appropriate space for allowing the transport arm 52 to be advanced therethrough is provided between the two side walls 61*a*.

As shown in FIG. 8A, the transport arm 52 can be advanced into the space provided above the outlet stage 61, while the bundled banknotes T are placed on the arm 52. More specifically, the transport arm 52 is first advanced into the space provided above the outlet stage 61, at a level higher than the side walls 61*a* of the outlet stage 61, while placing thereon the bundled banknotes T. Then, the transport arm 52 is lowered. Thereafter, when the transport arm 52 is lowered up to a position in the vicinity of a bottom of the outlet stage 61, the upper arm 52*a* of the transport arm 52 is elevated. Then, the transport arm 52 is retracted from the space above the outlet stage 61 through the space provided between the two, left and right, side walls 61*a*, as shown in FIG. 8B. In this case, when the transport arm 52 is retracted from the space above the outlet stage 61, the bundled banknotes T placed on the transport arm 52 are caught by the side walls 61*a*, thus left and transferred onto the outlet stage 61, after the transport arm 52 is completely retracted from the stage 61.

To the bundled-banknote outlet 60, guide members 63, 64, 65, each extending in the vertical direction, are provided. Between the guide members 63 and 64 or 65, a suitable space for stacking therein the bundled banknotes T is provided. In this case, the guide member 63 is provided to be opposed to the guide member 64, while the guide member 65 is provided above the guide member 64. Further, a restricting member 68 for restricting upward movement of the bundled banknotes is attached to a top portion of the guide member 63. Further, this restricting member 68 is provided to a top portion of the bundled-banknote outlet 60 in a position opposite to the outlet stage 61.

As shown in FIGS. 8A and 9, the claws 66 are provided to the guide members 63 and 64, respectively. Further, as shown in FIG. 8A, each claw 66 is pivotally supported about a shaft 66*a* provided to the guide member 63 or 64. In this case, each claw 66 can be rotated only upward from a substantially horizontally extending state as depicted in FIG. 8A. More specifically, a bias spring (not shown) is provided to each claw 66. Thus, when the claw 66 is rotated upward about the shaft 66*a* from the substantially horizontally extending state, some bias force will be applied to the claw 66 from the spring. Namely, each claw 66 is configured to be rotated upward against such bias force exerted from the bias spring.

In this bundled-banknote outlet 60, the multiple batches of the bundled banknotes T can be placed, while being stacked on the claws 66. Namely, when no force is applied to each claw 66 from below, the claw extends in a substantially horizontal direction, so that the multiple batches of the bundled banknotes T can be placed on such substantially horizontally extending claws 66. Thus, in this state, when the shutter mechanism 62 is opened, the operator can collectively take out the multiple batches of the bundled banknotes T placed on the claws 66.

As shown FIG. 9, a total of five claws 66 are provided to the bundled-banknote outlet 60, while five notches are formed in the outlet stage 61, respectively corresponding to the claws 66. Namely, when the outlet stage 61 is seen from above, each claw 66 is provided in a position corresponding to each notch formed in the outlet stage 61. Therefore, the outlet stage 61 can be lowered or elevated while passing through each claw 66, without any collision between the outlet stage 61 and each claw 66.

As shown in FIG. 8A and the other related drawings, the shutter mechanism 62 is composed of two shutter members, an outer shutter member 62*a* and an inner shutter member 62*b*. Such two shutter members 62*a*, 62*b* constitute together a dual structure. Specifically, both of the shutter members 62*a*, 62*b* can be opened, at a point of time that the inner shutter member 62*b* and the outer shutter 62*a* are overlapped with each other. Further, as described above, the guide member 65 is provided inside the shutter mechanism 62. Therefore, when the shutter mechanism 62 is closed, the multiple batches of the bundled banknotes T placed on each claw 66 can be securely guided by the guide member 65, without being scattered.

It is noted that a method for stacking the bundled banknotes T bundled by the bundling unit 50, on each claw 66 of the bundled-banknote outlet 60 will be described later.

Now, operation of the banknote handling apparatus 10 constructed as described above will be discussed.

First of all, the depositing process for the banknotes into the banknote handling apparatus 10 will be described. In the case of performing the depositing process for the banknotes, the shutter mechanism 22 of the receiving and dispensing unit 20 of the banknote handling apparatus 10 is first opened, and then the batch of the loose banknotes is inserted into the receiving and dispensing unit 20 by the operator. Thereafter, when the shutter mechanism 22 is closed, the loose banknotes S inserted into the receiving and dispensing unit 20 are fed to the transport unit 30, one by one, by the banknote feeding mechanism 21. Subsequently, the banknotes fed to the transport unit 30 by the banknote feeding mechanism 21 are transported to the loop-like transport path 32, and then recognized, regarding the denomination, fitness, authentication or the like thereof, by the recognition unit 31. Then, each banknote recognized, as the rejected or abnormal banknote, by the recognition unit 31 or banknote that cannot be recognized by the recognition unit 31, is fed to the deposit reject unit 24 from the transport unit 30 and accumulated in the deposit reject unit 24. Meanwhile, each banknote recognized, as the normal banknote, by the recognition unit 31 is fed to the diversion transport path 34, by the diverter 36, from the loop-like transport path 32, at the diversion point 35 (i.e., the rightmost diversion point 35 shown in FIG. 3) corresponding to the escrow storage cassette 42, and then stored in the escrow storage cassette 42. In this escrow storage cassette 42, each banknote fed from the loop-like transport path 32 via the diversion transport path 34 is escrowed (or temporarily stored) in the stacked condition.

Once the depositing process for the banknotes is confirmed, the banknotes escrowed in the escrow storage cassette 42 are fed to each storage cassette 40, for each denomination of the banknotes, through the recognition unit 31. During this operation, the banknotes are once returned to the loop-like transport path 32 from the escrow storage cassette 42. Then, the banknotes transported through the loop-like transport are diverted, for each denomination thereof, to the corresponding storage cassette 40, by the corresponding diverter 36. Thus, the banknotes can be fed to each corresponding storage cassette 40 from the loop-like transport path 32 via the corresponding diversion transport path 34. In this way, the banknotes can be stored, for each denomination thereof, in the stacked condition, in the corresponding storage cassette 40.

Next, the dispensing process for the loose banknotes from the banknote handling apparatus 10 will be described. In the case of performing the dispensing process for the loose banknotes, the banknotes stored in each storage cassette 40 are fed out, one by one, from the storage cassette 40 to the transport unit 30 by the banknote feeding mechanism 41. Then, each banknote fed to the transport unit 30 is recognized by the recognition unit 31. As a result, the banknotes respectively recognized, as the normal banknote, are fed, one by one, to the receiving and dispensing unit 20 from the transport unit 30. In this way, the loose banknotes S are accumulated, in the stacked condition, in the receiving and dispensing unit 20. Meanwhile, each banknote recognized, as the abnormal or rejected banknote, by the recognition unit 31 or banknote that cannot be recognized by the recognition unit 31 is fed to the dispense reject unit 26 from the transport unit 30 and accumulated in the dispense reject unit 26.

Thereafter, when the shutter mechanism 22 of the receiving and dispensing unit 20 is opened, the operator can take out the batch of the loose banknotes S accumulated in the receiving and dispensing unit 20.

Next, the dispensing process for the bundled banknotes from the banknote handling apparatus 10 will be described. In the case of performing the dispensing process for the bundled banknotes, the banknotes stored in each storage cassette 40 are fed out, one by one, to the transport unit 30 from the storage cassette 40 by the banknote feeding mechanism 41. Then, the banknotes fed to the transport unit 30 are transported to the bundling unit 50 provided above the transport unit 30. More specifically, the banknotes are fed, one by one, onto the escrow stage 51 from the transport unit 30, and eventually the plurality of the banknotes are accumulated on the escrow stage 51 in the stacked condition. In this way, the batch S' of the plurality of loose banknotes stacked on the escrow stage 51 is collectively transported by the transport arm 52; while each edge of the loose banknotes is held by the batch guide units 58 to prevent the spreading thereof.

Thereafter, the transport arm 52 is moved to the position between the upper banknote holding unit 53 and the lower banknote holding unit 54. Then, the bundling paper is supplied from the bundling-paper supply unit 57 to the batch S' of the loose banknotes placed on the transport arm 52, whereby the batch S' of the loose banknotes can be wound with the bundling paper. While the bundling paper is supplied from the bundling paper supply unit 57, the printing process for printing the date, serial number and the like on the bundling paper is provided by the printing unit 67. Thereafter, the batch S' of the loose banknotes wound with the bundling paper is pressed, from above and below, by the upper banknote holding unit 53 and lower banknote holding unit 54, while being heated by the heater 56. In this way, the bundling process (or binding process) for bundling each batch S' of the loose banknotes with the bundling paper is carried out to form the bundled banknotes T.

Thereafter, the bundled banknotes T are fed to the stamp 55 by the transport arm 52, and the marks, such as the name of the bank and the like, are stamped on the bundling paper of the bundled banknotes T.

Then, the bundled banknotes T are fed to the bundled-banknote outlet 60 from the bundling unit 50 and stacked on each claw 66 of the bundled-banknote outlet 60. In this manner, the multiple batches of the bundled banknotes T can be stacked on each claw 66 of the bundled-banknote outlet 60, while the bundled-banknote outlet 60 is closed by the shutter mechanism 62.

Next, referring to FIG. 10, the method for stacking the bundled banknotes T bundled by the bundling unit 50, on each claw 66 of the bundled-banknote outlet 60, will be discussed in more detail.

Figure 10:
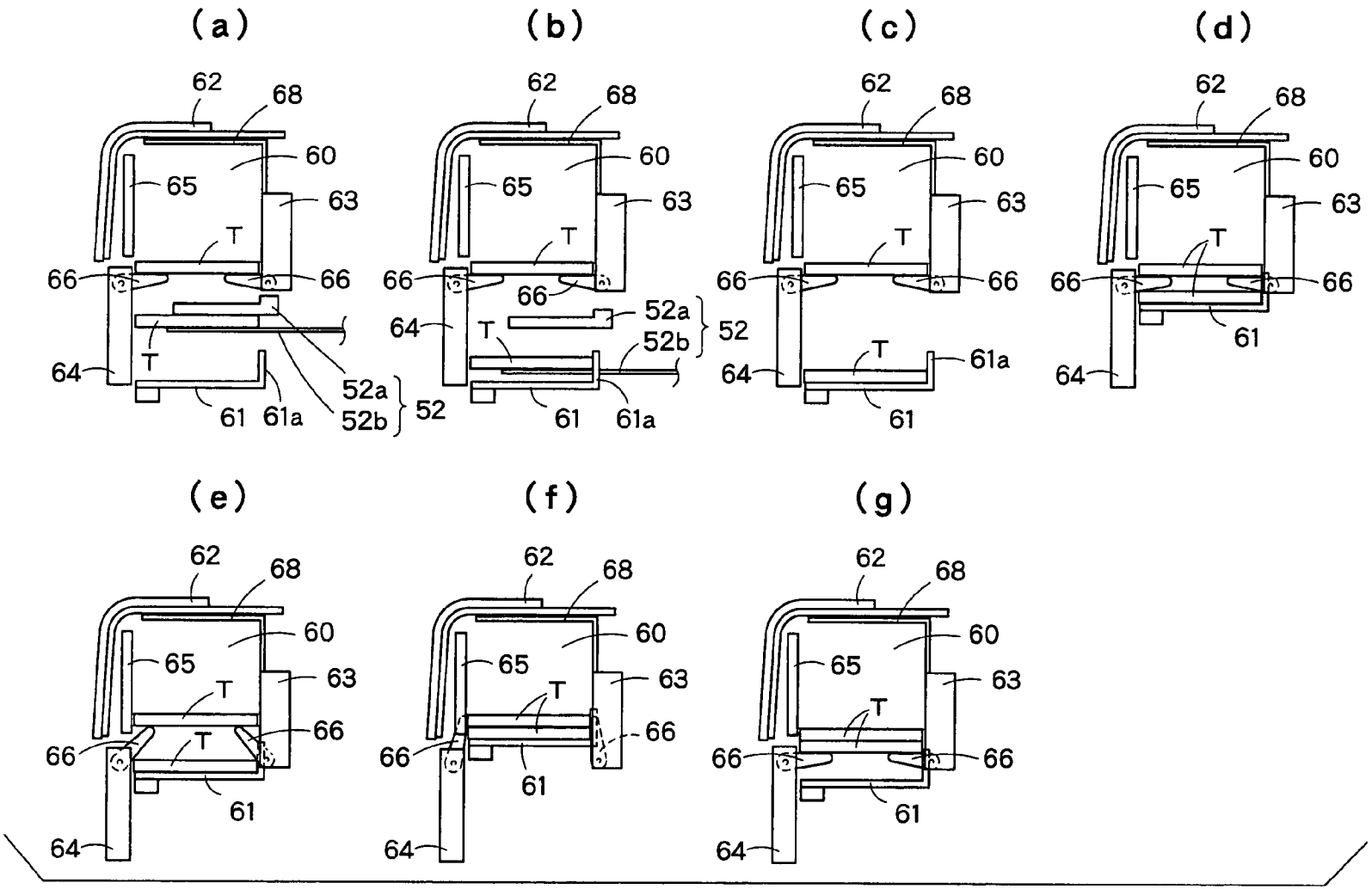
FIGS. 10(*a*) through 10(*g*) are diagrams, respectively illustrating, in succession, an operation when the bundled banknotes are transferred from a bundling unit provided in the banknote handling apparatus shown in FIG. 3 to the bundled-banknote outlet.

By way of example, as shown in FIG. 10(*a*), a case in which one batch (or first batch) of the bundled banknotes T is already placed on each claw 66 of the bundled-banknote outlet 60 and then another batch (or second batch) of the bundled banknotes T is further transported into the bundled-banknote outlet 60 by the transport arm 52 will be described. In this case, as shown in FIG. 10(*a*), the outlet stage 61 is initially located at the lower portion of the bundled-banknote outlet 60. Then, the transport arm 52 is advanced into the space provided above the outlet stage 61, at a level higher than the side walls 61*a* of the outlet stage 61 but lower than the guide member 63, while the second batch of the bundled banknotes T is placed on the transport arm 52.

Thereafter, as shown in FIG. 10(*b*), the transport arm 52 is lowered up to the position in the vicinity of the bottom of the outlet stage 61, and then the upper arm 52*a* of the transport arm 52 is moved upward. At this time, as shown in FIG. 8B, the transport arm 52 passes through the space between the two, left and right, side walls 61*a* of the outlet stage 61. Then, as shown in FIG. 10(*c*), the transport arm 52 is moved rightward from a position depicted in FIG. 10(*b*), and retracted from the space above the outlet stage 61. In this case, when the transport arm 52 is retracted from the space above the outlet stage 61, the second batch of the bundled banknotes T is caught by the side walls 61*a*, thus left and transferred onto the outlet stage 61 after the transport arm 52 is completely retracted from the stage 61 (see FIG. 10(*c*)).

Once the second batch of the bundled banknotes T is transferred onto the outlet stage 61 from the transport arm 52, the outlet stage 61 is elevated as depicted in FIG. 10(*d*). With the elevation of the outlet stage 61, the second batch of the bundled banknotes T placed on the outlet stage 61 will be in contact with each claw 66, as shown in FIG. 10(*d*). When the outlet stage 61 is further elevated from such a state as shown in FIG. 10(*d*), the second batch of the bundled banknotes T placed on the outlet stage 61 will push each claw 66 upward, as depicted in FIG. 10(*e*). Thus, each claw 66 will be rotated upward about the shaft 66*a*. Thereafter, if the outlet stage 61 is further elevated, as shown in FIG. 10(*f*), each claw 66 is rotated to be oriented substantially upward in the vertical direction by the second batch of the bundled banknotes T. Eventually, the second batch of the bundled banknotes T placed on the outlet stage 61 will be directly overlapped with the first batch of the bundled banknotes T already placed on each claw 66.

Once the first batch of the bundled banknotes T already placed on each claw 66 is overlapped on the second batch of the bundled banknotes T newly fed onto the outlet stage 61 in the bundled-banknote outlet 60, as shown in FIG. 10(*f*), the outlet stage 61 is further elevated higher than each claw 66. Then, as shown in FIG. 10(*g*), the outlet stage 61 is lowered. As a result, each claw 66 is rotated downward about the shaft 66*a* and returned to the substantially horizontally extending state. In this manner, the multiple batches of the bundled banknotes T can be stacked on each claw 66. Because the restricting member 68 is provided to the top portion of the bundled-banknote outlet 60 in the position opposite to the outlet stage 61, the upward movement of the bundled banknotes T can be restricted due to the restricting member 68. Namely, upward bulging or spreading of the bundled banknotes T can be suppressed by the restricting member 68, when the bundled banknotes T are successively stacked on each claw 66 from below. Therefore, the batch of circulated banknotes, which is likely to be bulged more than the batch of brand-new banknotes, can be successfully compressed in a thickness direction. In this way, the predetermined number of batches of the bundled banknotes can be stacked on each claw 66.

Thereafter, when the shutter mechanism 62 is opened, the operator can collectively take out the multiple batches of the bundled banknotes T stacked on each claw 66 in the bundled-banknote outlet 60.

As described above, according to the banknote handling apparatus 10 of this embodiment, the plurality of storage cassettes 40, each adapted for storing therein the banknotes, and the escrow storage cassette 42 adapted for escrowing (or temporarily storing) therein the banknotes are arranged in parallel with one another in the casing 12. In addition, the diverters 36 are respectively provided to the diversion points 35 in the transport unit 30 for diverting the banknotes toward each of the storage cassettes 40 and escrow storage cassette 42. Therefore, due to such dividers 36, each banknote transported by the transport unit 30 can be diverted into the specified storage cassette 40 or escrow storage cassette 42. Thus, the arrangement of the storage cassettes 40 and escrow storage cassette 42 respectively provided in the substantially horizontal direction and in parallel with one another can securely prevent undue increase of the height of the casing 12, while adequately increasing each capacity of the storage cassettes 40 and escrow storage cassette 42. In addition, such increase of the capacity of each storage cassette 40 enables the banknote handling apparatus 10 to store therein the banknotes in a significantly large number. Further, the increase of the capacity of the escrow storage cassette 42 enables the deposition process for such a significantly large number of banknotes to be performed in one dealing operation.

Additionally, in the banknote handling apparatus 10 of this embodiment, the escrow storage cassette 42 may have substantially the same capacity (or banknote storage amount) as the capacity of each storage cassette 40. In this case, the escrow storage cassette 42 can be formed of the same part or material as that of each storage cassette 40.

As described above, the transport unit 30 includes the laterally elongated loop-like transport path 32 located above the respective storage cassettes 40 and escrow storage cassette 42. This can further prevent the height of the casing 12 from being unduly increased. In addition, even in the case in which the storage cassettes 40 are increased backward in the casing 12, it is not necessary to change so much the internal construction of the banknote handling apparatus 10.

In addition, the transport unit 30 includes the plurality of diversion transport paths 34, each branched downward from the loop-like transport path 32 and connected with each of the storage cassettes 40 and escrow storage cassette 42. Each diverter 36 is composed of the diversion claw that is provided at the corresponding diversion point 35, at which the corresponding diversion transport path 34 is branched from the loop-like transport path 32. In this case, each diverter 36 can be rotated about the shaft 36*a*. Thus, in the case of feeding the banknotes transported by the loop-like transport path 32 to a specified one of the storage cassettes 40 or escrow storage cassette 42, each banknote transported by the transport unit 30 can be diverted to the specified storage cassette 40 or escrow storage cassette 42, due to the rotation of the diverter 36 corresponding to the storage cassette 40 or escrow storage cassette 42 to which the banknote is to be fed. Namely, such provision of the diverters 36, each composed of the diversion claw, can allow each banknote transported by the transport unit 30 to be securely diverted to the specified storage cassette 40 or escrow storage cassette 42.

Further, the bundling unit 50 is provided above the transport unit 30 in the casing 12. Therefore, this bundling unit 50 can be positioned in the vicinity of the receiving and dispensing unit 20, thus significantly simplifying the construction of the banknote handling apparatus 10 adapted for the depositing process for the banknotes. In addition, the provision of the bundled-banknote outlet 60 in the vicinity of the receiving and dispensing unit 20 can possibly prevent the operator from forgetting to take the banknotes from each outlet, even in the case in which the outlet for the bundled banknotes is provided separately from the outlet for the loose banknotes.

As described above, the bundled-banknote outlet 60 adapted for dispensing the bundled banknotes formed by the bundling unit 50 to the exterior of the casing 12 is configured to accumulate or stack therein the multiple batches of the bundled banknotes. Therefore, such multiple batches of the bundled banknotes can be collectively dispensed to the exterior of the casing 12 from the bundled-banknote outlet 60, thus reducing the time required for dispensing the banknotes, even in the case in which considerably many batches of the bundled banknotes are dispensed. In addition, even in the case in which so many batches of the bundled banknotes are dispensed, there is no need for the operator to take out the bundled banknotes from the bundled-banknote outlet 60 every time each batch of the bundled banknotes is accumulated or stacked in the bundled-banknote outlet 60. This can significantly mitigate or eliminate complexity of the operation performed by the operator.

Additionally, the opening for allowing the operator to take out the bundled banknotes therefrom is provided to the bundled-banknote outlet 60, while the shutter mechanism 62 adapted for optionally opening and closing the opening is provided to the outlet 60. In this case, the shutter mechanism is configured not to open the opening of the bundled-banknote outlet 60 until the predetermined number of bundled banknotes is stacked in the bundled-banknote outlet 60. Therefore, the operator can take out, collectively, the predetermined number of bundled banknotes from the bundled-banknote outlet 60. This can considerably facilitate the depositing process for the operator. In addition, since the operator cannot take out the bundled banknotes from the bundled-banknote outlet 60 during the operation for stacking the predetermined number of batches of the bundled banknotes in the bundled-banknote outlet 60, unwanted trouble, such as failure in stacking the bundled banknotes in the bundled-banknote outlet 60 or the like, can be avoided.

As described above, the stacking unit 50 includes the escrow stage 51 adapted for accumulating therein the plurality of loose banknotes in the stacked condition, the bundling mechanism 59 adapted for bundling the plurality of loose banknotes accumulated in the stacked condition, and the transport arm 52 adapted for transporting the plurality of loose banknotes accumulated in the stacked condition from the escrow state 51 to the bundling mechanism 59 as well as adapted for transporting the bundled banknotes bundled by the bundling mechanism 59 from the bundling mechanism 59 to the bundled-banknote outlet 60. In this case, the transport arm 52 is located at the substantially central position of the bundling unit 50, while the escrow stage 51, bundling mechanism 59 and bundled-banknote outlet 60 are located around the transport arm 52, respectively. Further, the transport arm 52 is movable between any two of the escrow stage 51, bundling mechanism 59 and bundled-banknote outlet 60. With such configuration of the banknote handling apparatus 10 including the escrow stage 51, bundling mechanism 59 and bundled-banknote outlet 60 respectively located around the transport arm 52, these components can be arranged in a spatially well-balanced condition, thus achieving significantly compact configuration of the bundling unit 50.

Additionally, in the bundled-banknote outlet 60, the claws 66 respectively adapted for placing thereon the multiple batches of the bundled banknotes and the outlet stage 61 located below the claws 66 and configured to be vertically movable are provided, respectively. In this case, the bundled banknotes are transferred onto the outlet stage 61 from the transport arm 52 at a point below the claws 66, and then the bundled banknotes on the outlet stage 61 are transferred onto the claws 66, after the outlet stage 61 is elevated up to the claws 66. With such configuration of the banknote handling apparatus 10, the bundled banknotes can be placed on the claws 66 from below. Therefore, as compared with a type of accumulating the multiple batches of the bundled banknotes in the bundled-banknote outlet by utilizing free fall of each batch into the outlet, the bundled banknotes can be more compressed in the thickness direction. Therefore, in this banknote handling apparatus 10, the height (or thickness) of the accumulated multiple batches of the bundled banknotes can be positively reduced. Further, as compared with the type of accumulating the multiple batches of the bundled banknotes in the bundled-banknote outlet by the utilizing free fall of each batch into the outlet, occurrence of the trouble, such as failure in stacking the bundled banknotes in the bundled-banknote outlet 60 or the like, can be well controlled.

As described above, each claw 66 can be rotated upward about the shaft 66*a* from the substantially horizontally extending state. In this case, when no force is applied to each claw 66 from below, the claw 66 extends in the substantially horizontal direction. As such, one or more batches of the bundled banknotes can be placed on such claws 66 respectively extending in substantially horizontal direction. However, when the outlet stage 61 is moved up to the claws 66, the bundled banknotes placed on the outlet stage 61 will push up the claws 66 from below and rotate them upward. Thus, the bundled banknotes placed on the outlet stage 61 will be directly overlapped with the bundled banknotes already placed on the claws 66. Thereafter, when the outlet stage 61 is lowered, the bundled banknotes placed on the outlet stage 61 can be transferred onto the claws 66. With such banknote handling apparatus 10, the bundled banknotes can be securely transferred onto the claws 66 from the outlet stage 61. In addition, since the bundled banknotes can be adequately compressed in the thickness direction when the claws 66 are pushed upward by the bundled banknotes on the outlet stage 61, unwanted bulging in the thickness direction of the bundled banknotes placed on the claws 66 can be positively restricted.

Additionally, the restricting member 68 that can serve to restrict the upward movement of the bundled banknotes is provided to the top portion of the bundled-banknote outlet 60 in the position opposite to the outlet stage 61. Therefore, the predetermined number of batches of the bundled banknotes can be securely stacked on the claws 66, even in the case in which each batch of the bundled banknotes is considerably thick. For instance, there is a difference in the thickness, between the circulated banknotes and the brand-new banknotes. However, due to the restricting member 68 of this embodiment, the upward bulging of the bundled banknotes can be positively restricted when the bundled banknotes are stacked on the claws 66 from below. Therefore, even in the case of the circulated banknotes or the like, the predetermined number of batches of the bundled banknotes can be properly stacked on the claws 66, because each batch of the banknotes can be adequately compressed in the thickness direction by the restricting member 68.

Figure 11:
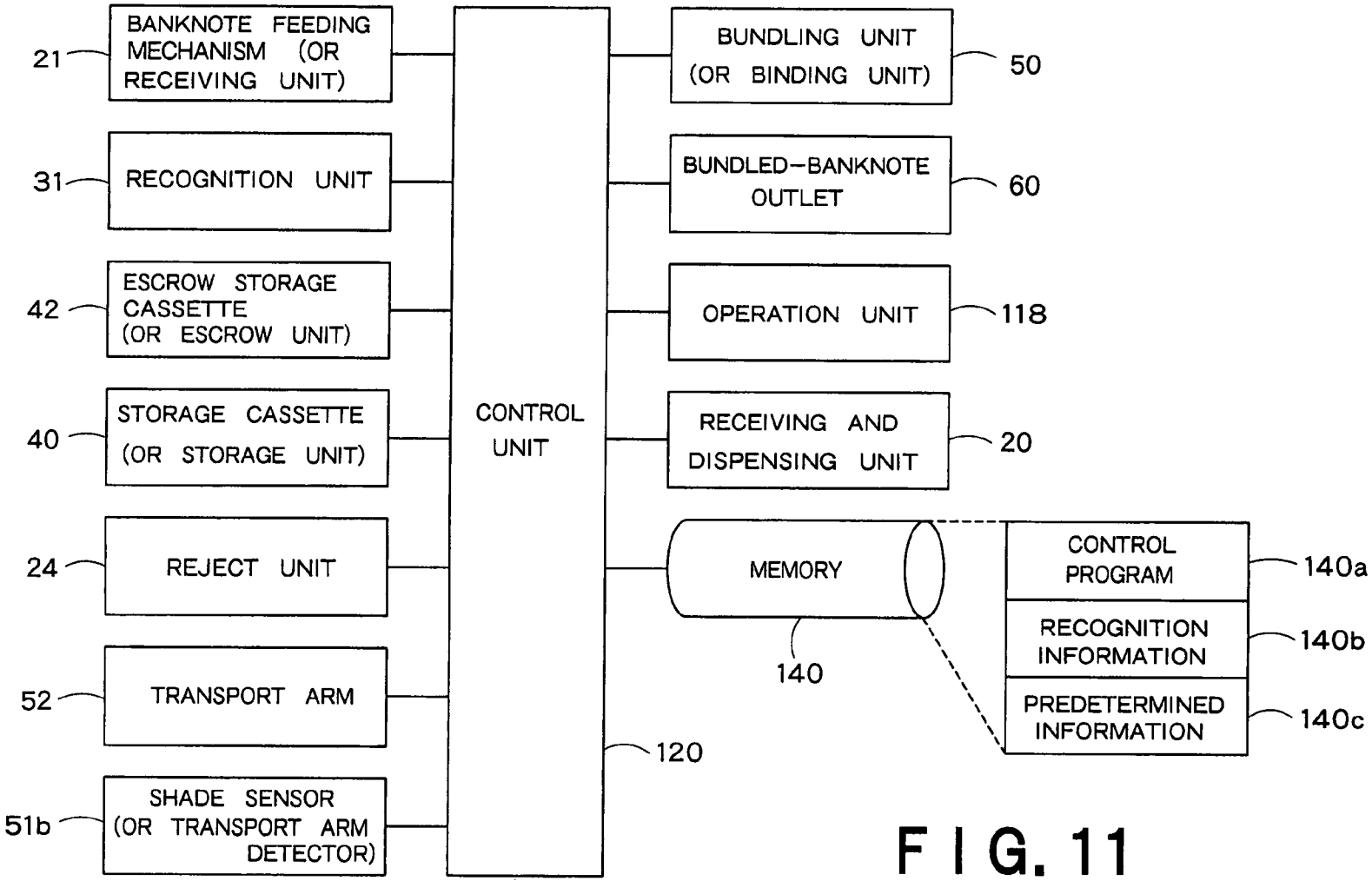
FIG. 11 is a block diagram showing a control function of the banknote handling apparatus related to the first embodiment.

Now, one exemplary control function of the banknote handling apparatus 10 related to the first embodiment will be described with reference to FIGS. 11 through 13. Of these drawings, FIG. 11 is a block diagram showing the control function of the banknote handling apparatus related to the first embodiment. FIG. 12 is a diagram schematically showing recognition information 140*b* shown in FIG. 11. FIG. 13 is a diagram schematically showing predetermined information 140*c* shown in FIG. 11.

An operation unit 118 includes a plurality of keys, each adapted for receiving an instruction of the operator, and a display adapted for displaying a predetermined screen. The operation unit 118 is configured to transmit each instruction of the operator to the control unit 120.

The control unit 120 is configured to start a control program 140*a* stored in a memory 140, based on the operator's instruction transmitted from the operation unit 118, in order to control the banknote feeding mechanism 21, recognition unit 31, escrow storage cassette 42, storage cassettes 40, reject unit 24, transport arm 52, shade sensor 51*b*, bundling unit 50, bundled-banknote outlet 60, operation unit 118, receiving and dispensing unit 20 and other components shown in FIG. 3. Further, the control unit 120 is configured to write the recognition information 140*b* in the memory 140, based on each recognition result transmitted from the recognition unit 31. Additionally, the control unit 120 is configured to write the predetermined information 140*c* in the memory 140, based on each operator's instruction transmitted from the operation unit 118.

The memory 140 is configured to store therein the control program 140*a*, recognition information 140*b*, predetermined information 140*c* and other various data. The control program 140*a* is provided to be used for the control unit 120. As shown in FIG. 12, the recognition information 140*b* includes information on the denomination and number of the banknotes. Further, as shown in FIG. 13, the predetermined information 140*c* includes information on the banknotes to be dispensed (i.e., the "predetermined denomination of the banknotes to be dispensed," "predetermined number of the banknotes to be dispensed," "predetermined number of the banknotes to be bundled" and "predetermined number of the batches of the bundled banknotes").

Next, referring to FIG. 14, operation of the banknote handling apparatus using the above control function, as described with reference to FIGS. 11 through 13 will be discussed. FIG. 14 is a schematic diagram illustrating a transport route in the banknote handling apparatus related to this embodiment.

Figure 14A:
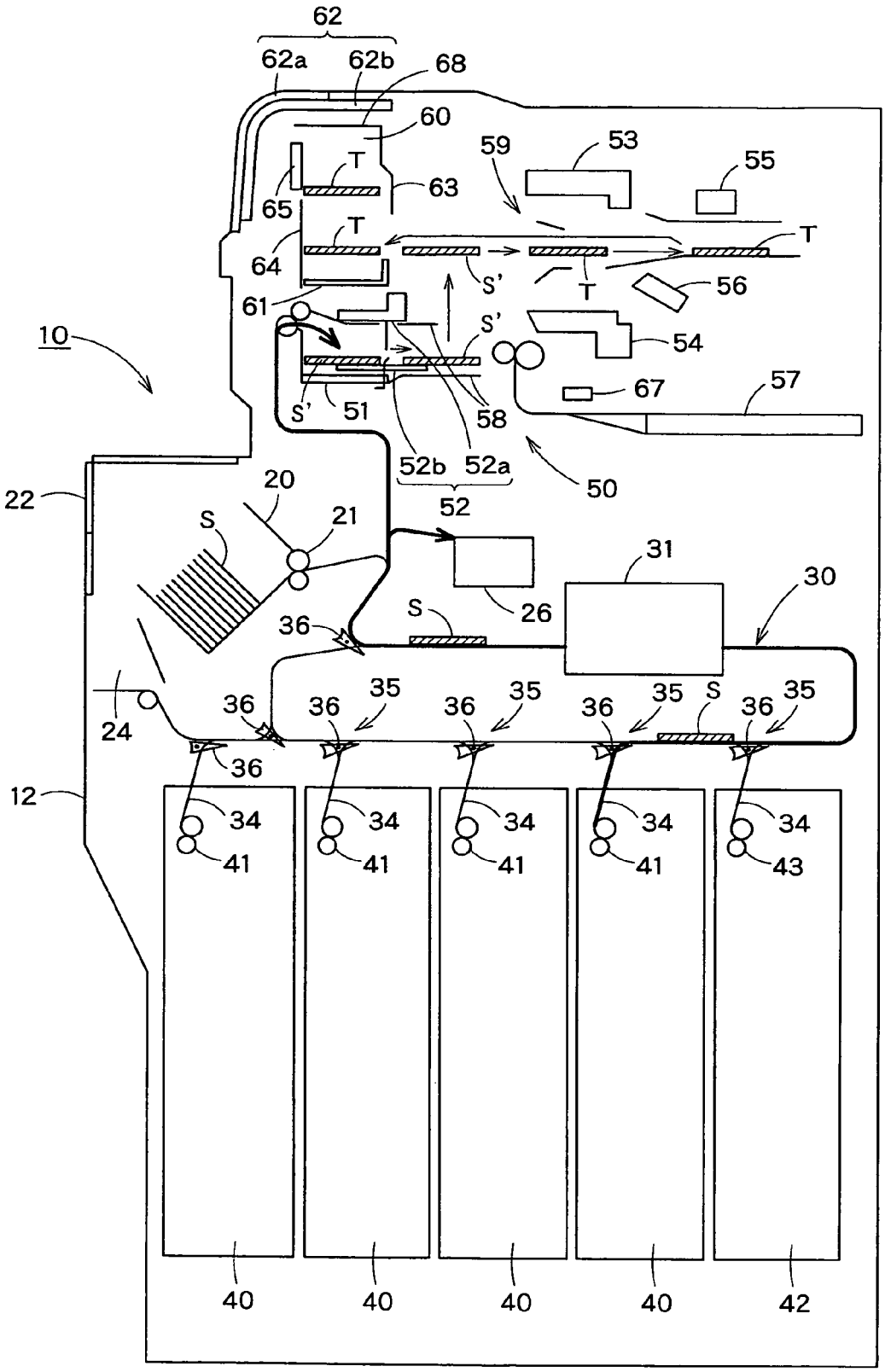
FIG. 14A is a schematic diagram showing a transport route for an arrangement escrow process in the banknote handling apparatus using the control function as shown in FIGS. 11 through 13.

Specifically, FIG. 14A shows the transport route for an arrangement escrow process that will be described later. In this escrow process, the loose banknotes S fed out from the storage cassettes 40 are recognized by the recognition unit 31, then a predetermined number of normal banknotes are stacked on the escrow stage 51, while the rejected banknotes are accumulated in the dispense reject unit 26.

Figure 14B:
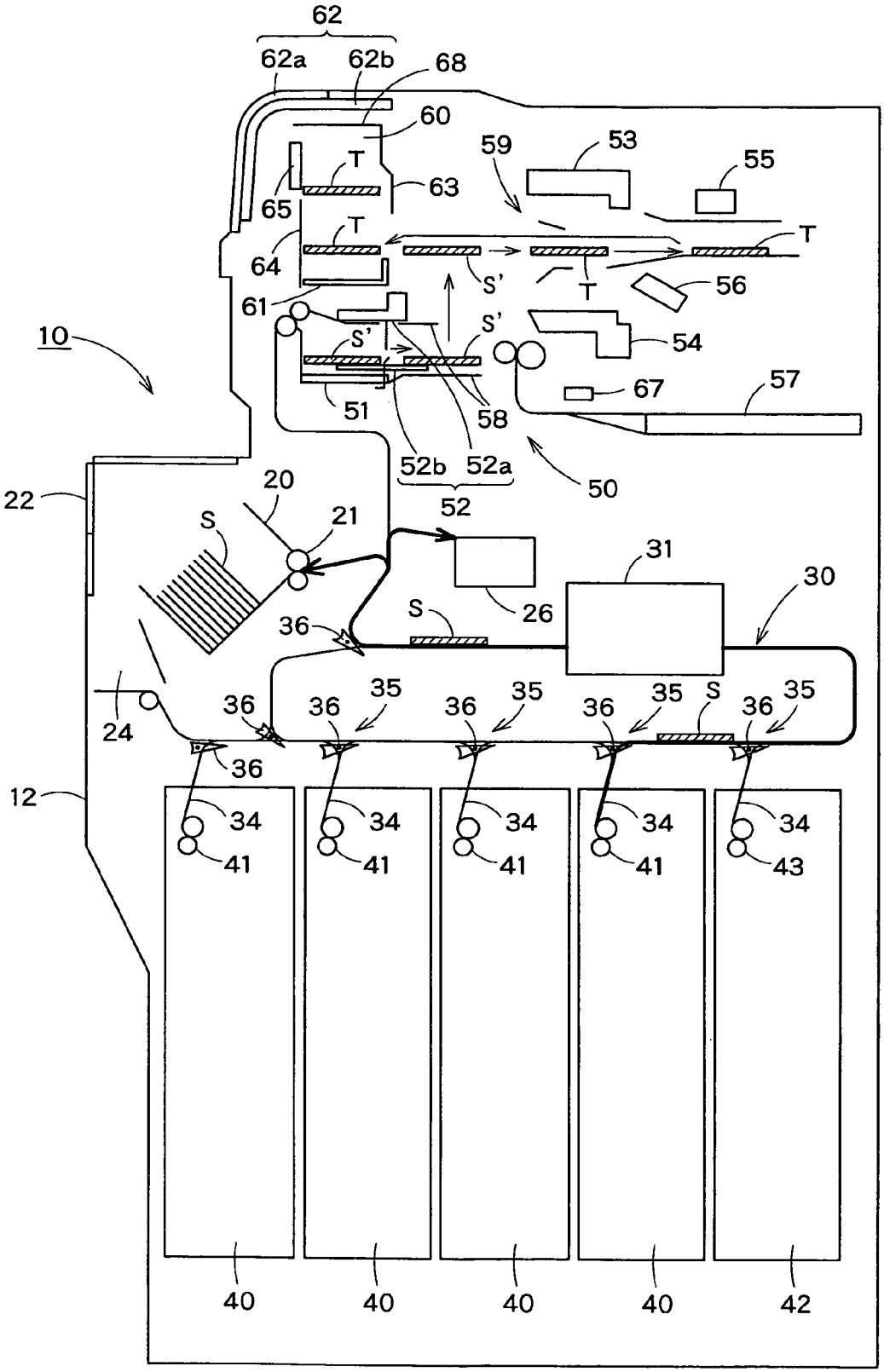
FIG. 14B is a schematic diagram showing the transport route for a loose-banknote dispensing process in the banknote handling apparatus using the control function as shown in FIGS. 11 through 13.

FIG. 14B shows the transport route for a loose-banknote dispensing process that will be described later. In this dispensing process, the loose banknotes S fed out from the storage cassettes 40 are recognized by the recognition unit 31, then the normal banknotes are transported to the receiving and dispensing unit 20, while the rejected banknotes are accumulated in the dispense reject unit 26.

Figure 15:
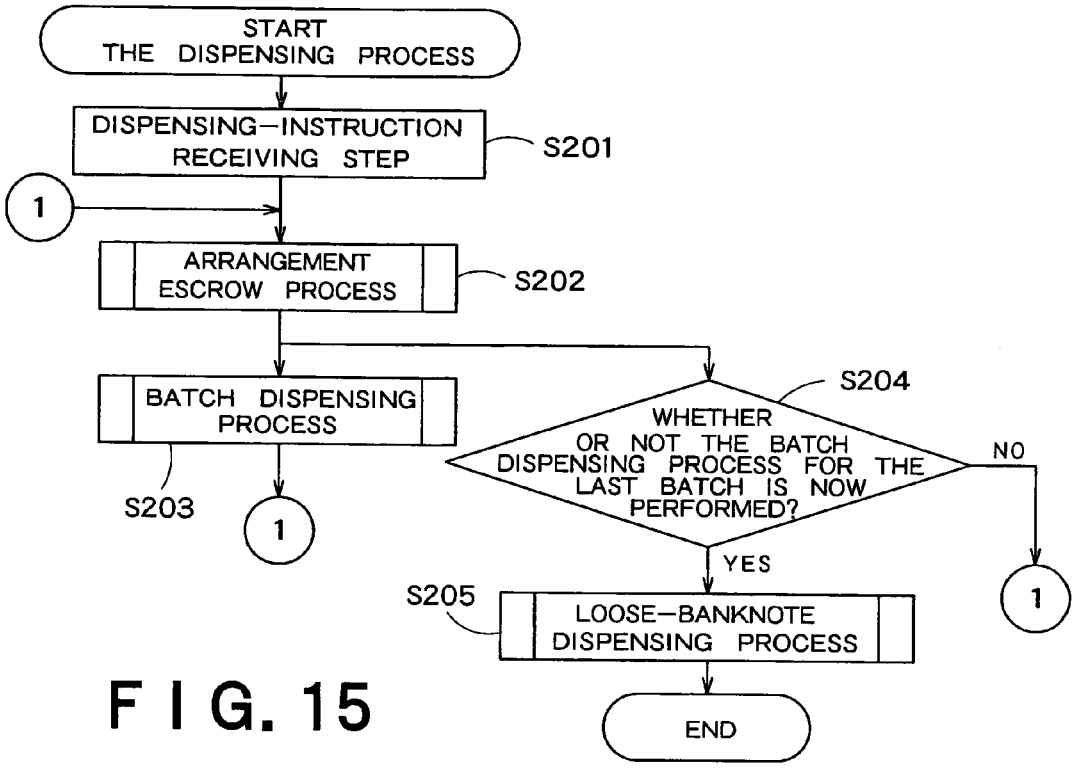
FIG. 15 is a flow chart illustrating a procedure of the dispensing process in the banknote handling apparatus using the control function as shown in FIGS. 11 through 13.
Figure 16:
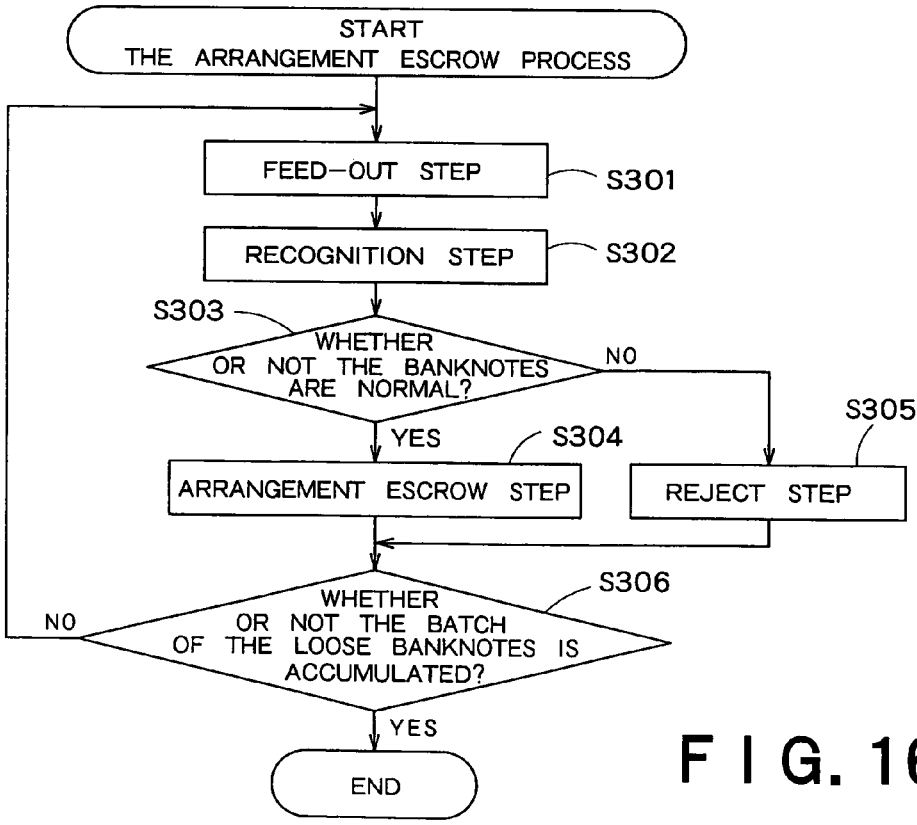
FIG. 16 is a flow chart illustrating a procedure of the arrangement escrow process (S202) shown in FIG. 15.
Figure 17:
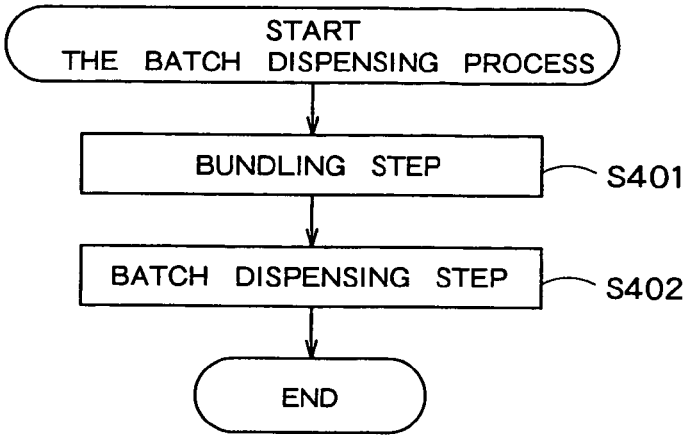
FIG. 17 is a flow chart illustrating a procedure of a batch dispensing process (S203) shown in FIG. 15.
Figure 18:
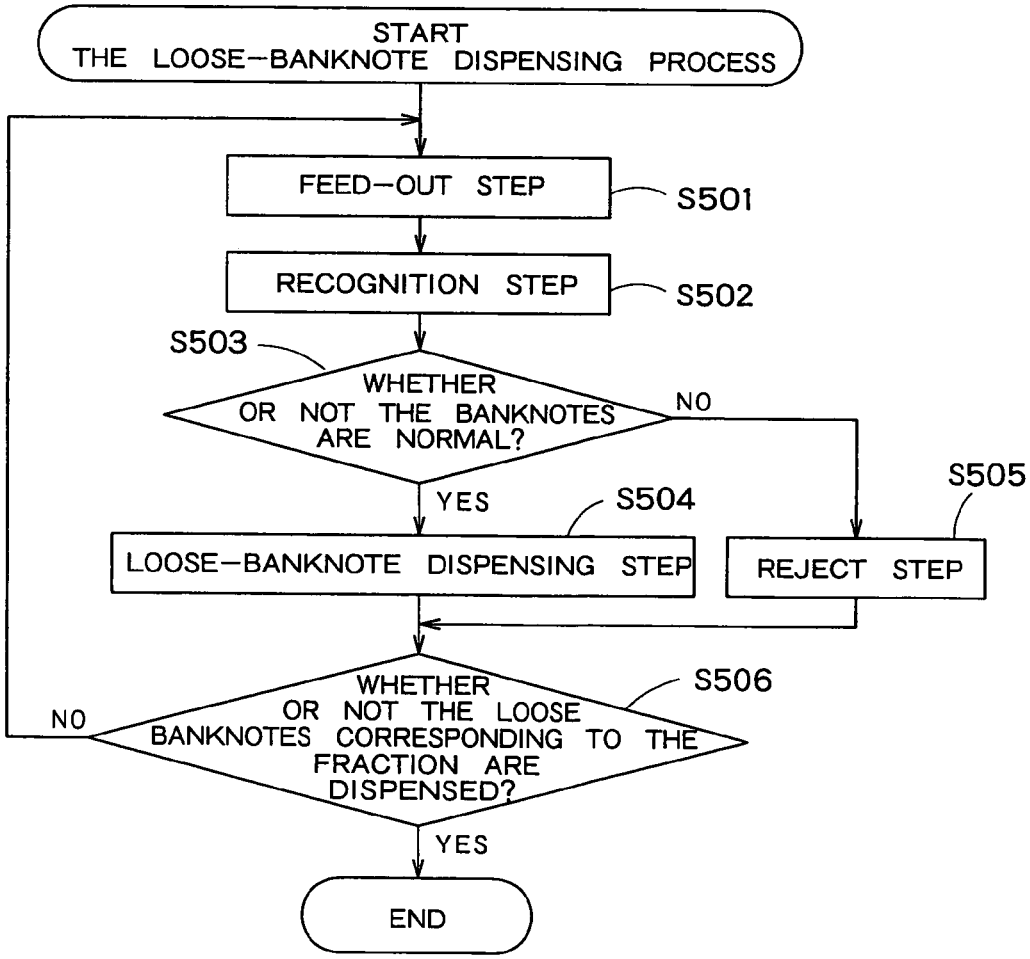
FIG. 18 is a flow chart illustrating a procedure of the loose-banknote dispensing process (S205) shown in FIG. 15.

Next, the dispensing process in the banknote handling apparatus using the control function as described with reference to FIGS. 11 through 13 will be described with reference to FIGS. 15 through 18. FIG. 15 is a flow chart illustrating a procedure of the dispensing process using the control function as illustrated in FIGS. 11 through 13. FIG. 16 is a flow chart illustrating a procedure of an arrangement escrow process (S202) shown in FIG. 15. FIG. 17 is a flow chart illustrating a procedure of a batch dispensing process (S203) shown in FIG. 15. FIG. 18 is a flow chart illustrating a procedure of a loose-banknote dispensing process (S205) shown in FIG. 15.

As shown in FIG. 15, a dispensing-instruction receiving step (S201) is performed. In the dispensing-instruction receiving step (S201), the operator inputs a dispensing instruction (about the denomination of the banknotes to be dispensed, the number of the banknotes to be dispensed, the number of the banknotes to be bundled and the number of the batches of the bundled banknotes) by using the operation unit 118. Then, the control unit 120 writes the predetermined information 140*c* in the memory 140, based on the operator's instruction transmitted from the operation unit 118.

Next, as shown in FIG. 15, the arrangement escrow process (S202) is performed.

In the arrangement escrow process (S202), as shown in FIG. 16, a feed-out step (S301) is first performed. In this feed-out step (S301), the control unit 120 controls the banknote feeding mechanism 41 to feed out the loose banknotes S corresponding to "the predetermined denomination of the banknotes to be dispensed" of the predetermined information 140*c*, among the loose banknotes S stored in the storage cassettes 40.

Next, as shown in FIG. 16, a recognition step (S302) is performed. In this recognition step (S302), the control unit 120 controls the recognition unit 31 to recognize the denomination, fitness, authentication and the like of the loose banknotes S fed out from the storage cassettes 40 in the feed-out step (S301). Then, the control unit 120 writes the recognition information 140*b* in the memory 140, based on the recognition result transmitted from the recognition unit 31.

Next, as shown in FIG. 16, if the banknotes are recognized as the normal banknotes in the recognition step (S302) (i.e., S303—YES), an arrangement escrow step (S304) is performed. Meanwhile, if the banknotes are recognized as the rejected banknotes (i.e., S303—NO), then a reject step (S305) is performed.

In the arrangement escrow step (S304), as shown in FIG. 16, the control unit 120 controls the transport path 32 to accumulate or stack the loose banknotes S, which have been recognized as the normal banknotes in the recognition step (S302), into the escrow stage 51.

Meanwhile, in the reject step (S305), as shown in FIG. 16, the control unit 120 controls the transport path 32 to accumulate the loose banknotes S, which have been recognized as the rejected banknotes in the recognition step (S302), into the dispense reject unit 26.

In this process, as shown in FIG. 16, the procedure from the feed-out step (S301) through the reject step (S305) is repeated until the batch S' of the loose banknotes formed of the predetermined number (i.e., the number of the banknotes corresponding to "the predetermined number of the banknotes to be bundled" of the predetermined information 140*c*) of loose banknotes S is accumulated on the escrow stage 51 (S306—NO). Finally, the arrangement escrow process (S202) is ended at a point of time that the batch S' of the loose banknotes is completely accumulated on the escrow stage 51 (S306—YES).

Next, as shown in FIG. 15, the batch dispensing process (S203) and a check (S204) on whether or not the batch dispensing process for the last batch is now performed are conducted in parallel.

As shown in FIG. 17, in the batch dispensing process (S203), a bundling step (S401) is first performed. In this bundling process (S401), the control unit 120 controls the transport arm 52 to transport the batch S' of the loose banknotes accumulated on the escrow stage 51 to the bundling unit 50, and then controls the bundling unit 50 to form the bundled banknotes T by bundling the batch S' of the loose banknotes.

Thereafter, as shown in FIG. 17, a batch dispensing step (S402) is performed. In this batch dispensing step (S402), the control unit 120 controls the transport arm 52 to accumulate the bundled banknotes T formed in the bundling step (S401) onto the outlet stage 61 of the bundled-banknote outlet 60.

Finally, as shown in FIG. 17, the batch dispensing process (S203) is ended after the batch dispensing step (S402) is completed.

Meanwhile, as shown in FIG. 15, in the check (S204) on whether or not the batch dispensing process for the last batch is now performed, the control unit 120 judges whether or not the bundled banknotes T currently formed in the batch dispensing process (S203) corresponds to the last batch, based on "the predetermined number of the batches of the bundled banknotes" of the predetermined information 140*c*. As a result, if the bundled banknotes T currently formed in the batch dispensing process (S203) corresponds to the last batch (i.e., S204—YES), then the loose-banknote dispending process (S205) is performed.

Further, as shown in FIG. 18, in the loose-banknote dispensing process (S205), a feed-out step (S501) and a recognition step (S502) are first performed. In this case, the feed-out step (S501) and recognition step (S502) are performed in the same manner as the feed-out step (S301) and recognition step (S302) shown in FIG. 16, respectively.

Then, as shown in FIG. 18, if the banknotes are recognized as the normal banknotes in the recognition step (S502) (i.e., S503—YES), a loose-banknote dispensing step (S504) is performed. Meanwhile, if the banknotes are recognized as the rejected banknotes (i.e., S503—NO), then a reject step (S505) is performed.

Further, as shown in FIG. 18, in the loose-banknote dispensing step (S504), the control unit 120 controls the transport path 32 to transport the loose banknotes S recognized as the normal banknotes in the recognition step (S502), into the receiving and dispensing unit 20.

Meanwhile, as shown in FIG. 18, the reject step (S505) is performed in the same manner as the reject step (S305) shown in FIG. 13.

In this case, as shown in FIG. 18, the procedure from the feed-out step (S501) through the reject step (S505) is repeated until a fraction of the loose banknotes S is dispensed (S506—NO). For instance, as shown in FIG. 13, the control unit 120 regards a value under "the predetermined number of the banknotes to be bundled (i.e., "100" shown in FIG. 13)" as the number of the fraction (i.e., "50 (sheets)" shown in FIG. 13), among "the predetermined number of the banknotes to be dispensed (i.e., "250" shown in FIG. 13)", respectively included in the predetermined information 140*c*. Finally, the loose-banknote dispensing process (S205) is ended at a point of time that the fraction of the loose banknotes S is dispensed (S506—YES).

In this way, as shown in FIG. 15, the arrangement escrow process (S202) and batch dispensing process (S203) are respectively repeated until the batch dispensing process for the last batch is recognized as currently performed (S204—NO). Finally, the whole dispensing process is ended after the loose-banknote dispensing process (S205).

Figure 19:
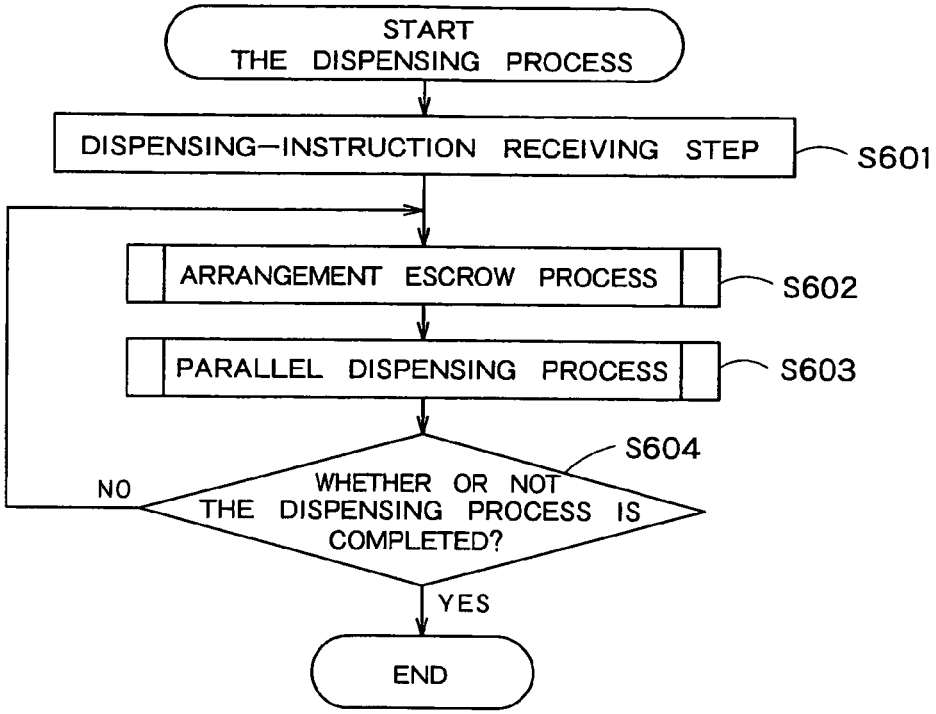
FIG. 19 is a flow chart illustrating a procedure of the dispensing process related to one variation in the banknote handling apparatus using the control function as shown in FIGS. 11 through 13.
Figure 20:
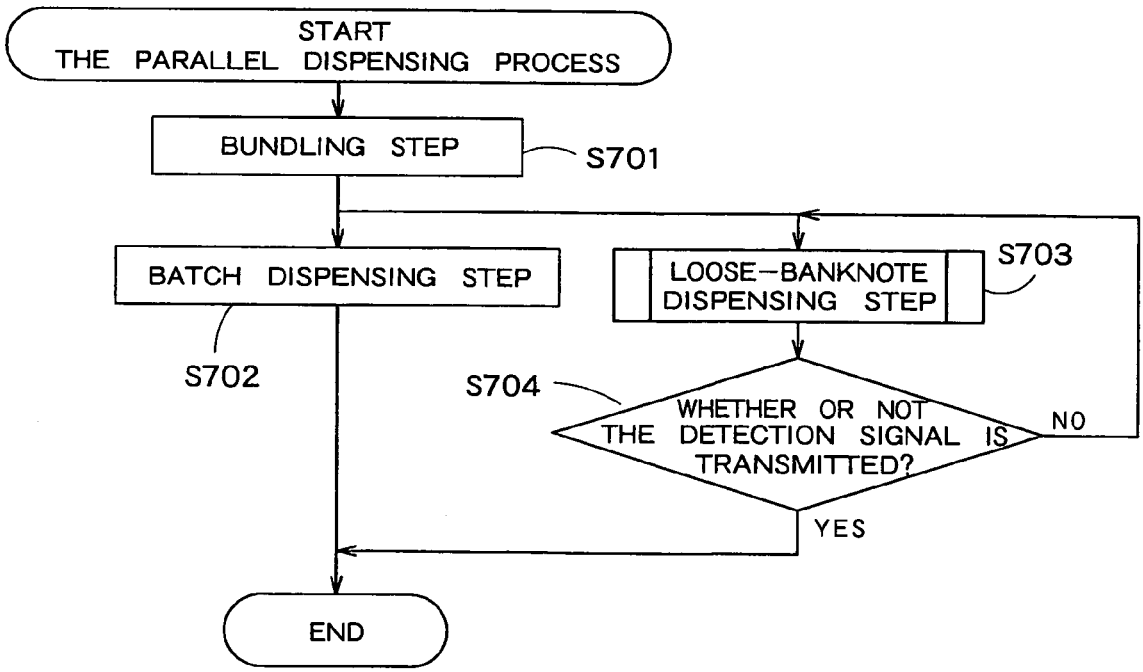
FIG. 20 is a flow chart illustrating a procedure of a parallel dispensing process (S603) shown in FIG. 19.

Next, one variation of the dispensing process of the banknote handling apparatus using the control function as illustrated in FIGS. 11 through 13 will be described with reference to FIGS. 19 and 20. FIG. 19 is a flow chart illustrating another procedure of the dispensing process related to the variation. FIG. 20 is a flow chart illustrating a procedure of a parallel dispensing process (S603) shown in FIG. 19.

As shown in FIG. 19, a dispensing-instruction receiving step (S601) and an arrangement escrow process (S602) are first performed. In this case, the dispensing-instruction receiving process (S601) and arrangement escrow process (S602) are performed in the same manner as the dispensing-instruction receiving step (S201) shown in FIG. 15 and the arrangement escrow process (S202) shown in FIG. 16, respectively.

Then, as shown in FIG. 19, the parallel dispensing process (S603) is performed.

As shown in FIG. 20, in the parallel dispensing process (S603), a bundling step (S701) is performed first. This bundling step (S701) is performed in the same manner as the bundling step (S401) shown in FIG. 17.

Then, as shown in FIG. 20, a batch dispensing step (S702) and a loose-banknote dispensing step (S703) are performed in parallel. The batch dispensing step (S702) is performed in the same manner as the batch dispensing step (S402) shown in FIG. 17, while the loose-banknote dispensing step (S703) is performed in the same manner as the loose-banknote dispensing step shown in FIG. 18. In this case, the loose-banknote dispensing step (S703) is repeated until the detection signal is transmitted from the shade sensor 51*b* (or until the transport arm 52 is returned into the predetermined range from the escrow stage 51) (S704—NO).

Finally, as shown in FIG. 20, the parallel dispensing process (S603) is ended after the batch dispensing step (S702) and after the detection signal is transmitted from the shade sensor 51*b* (S704—YES).

In this way, as shown in FIG. 19, the arrangement escrow process (S602) and parallel dispensing process (S603) are respectively repeated until the parallel dispensing process is completed (S604—NO) (i.e., S604—NO). Finally, the whole dispensing process is ended after the parallel dispensing process is completed (i.e., S604—YES).

Namely, in the variation as described above, the control unit 120 controls each unit or mechanism to preferentially perform the bundling step (S701), while performing the loose-banknote dispensing process (S703), as much as possible, during the batch dispensing step (S702) performed after the bundling step (S701). For instance, in the case of dispensing 350 sheets of banknotes, one batch S' (100 sheets) of the loose banknotes for forming the first batch of the bundled banknotes T is first stacked on the escrow stage 51. Then, while the transport arm 52 is driven to grasp the batch S' (100 sheets) of the loose banknotes S, the loose-banknote dispensing process (S703) is performed once for 25 sheets of loose banknotes S among the fraction (50 sheets) of the loose banknotes S. Thereafter, when the transport arm 52 is moved away from the escrow stage 51 while grasping the batch S' (100 sheets) of the loose banknotes S (or when the detection signal is no longer transmitted to the control unit 120 from the shade sensor 51*b*), another (or second) batch S' (100 sheets) of the loose banknotes for forming the second batch of the bundled banknotes T is stacked on the escrow stage 51. Then, while the transport arm 52 is driven to grasp the second batch S' (100 sheets) of loose banknotes S, the loose-banknote dispensing process (S703) is performed again for the remaining 25 sheets of loose banknotes S among the fraction (50 sheets) of the loose banknotes S. In this way, the loose-banknote dispensing process (S703) for the entire fraction (50 sheets) of the loose banknotes S can be completed before the bundling step (S701) for the third batch is performed.

In other words, in this variation, when the transport arm 52 is present in the vicinity of the escrow stage 51 (or otherwise when the loose banknotes S for forming a next batch of the bundled banknotes T cannot be transmitted to the escrow stage 51), the loose-banknote dispensing process (S703) is performed, as much as possible, for the fraction of the loose banknotes S. Therefore, the time required for the whole dispensing process shown in FIG. 19 can be reduced.

In the banknote handling apparatus using the control function as illustrated in FIGS. 11 through 13, the batch dispensing process is preferentially performed, while the loose-banknote dispensing process is performed during each batch dispensing process or during the batch dispensing process for the last batch. Therefore, the time required for the whole dispensing process can be significantly reduced.

Additionally, in the banknote handling apparatus using the control function as illustrated in FIGS. 11 through 13, most of mechanisms for performing the batch dispensing process can be commonly used for performing the loose-banknote dispensing process, thereby substantially downsizing the banknote handling apparatus.

While the above first embodiment has been described by way of example in regard to the banknote handling apparatus, it should be construed that this invention is not limited to such an aspect. For instance, the present invention can also be applied to a coin handling apparatus adapted for handling coins or applied to a paper sheet handling apparatus adapted for handling mediums or objects other than the banknotes.

Second Embodiment

Figure 21:
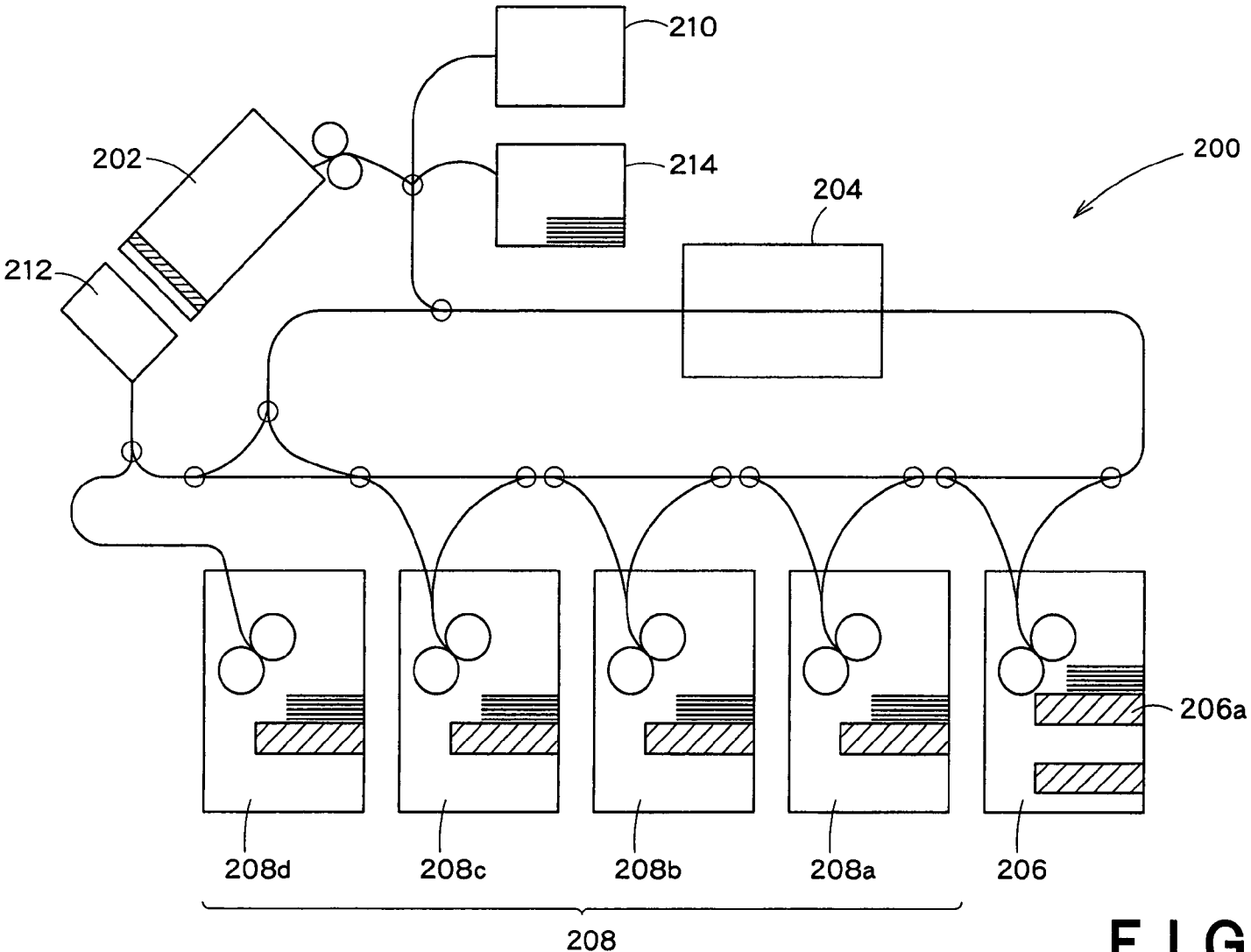
FIG. 21 is a schematic view showing the construction of the banknote handling apparatus related to a second embodiment of the present invention.
Figure 22:
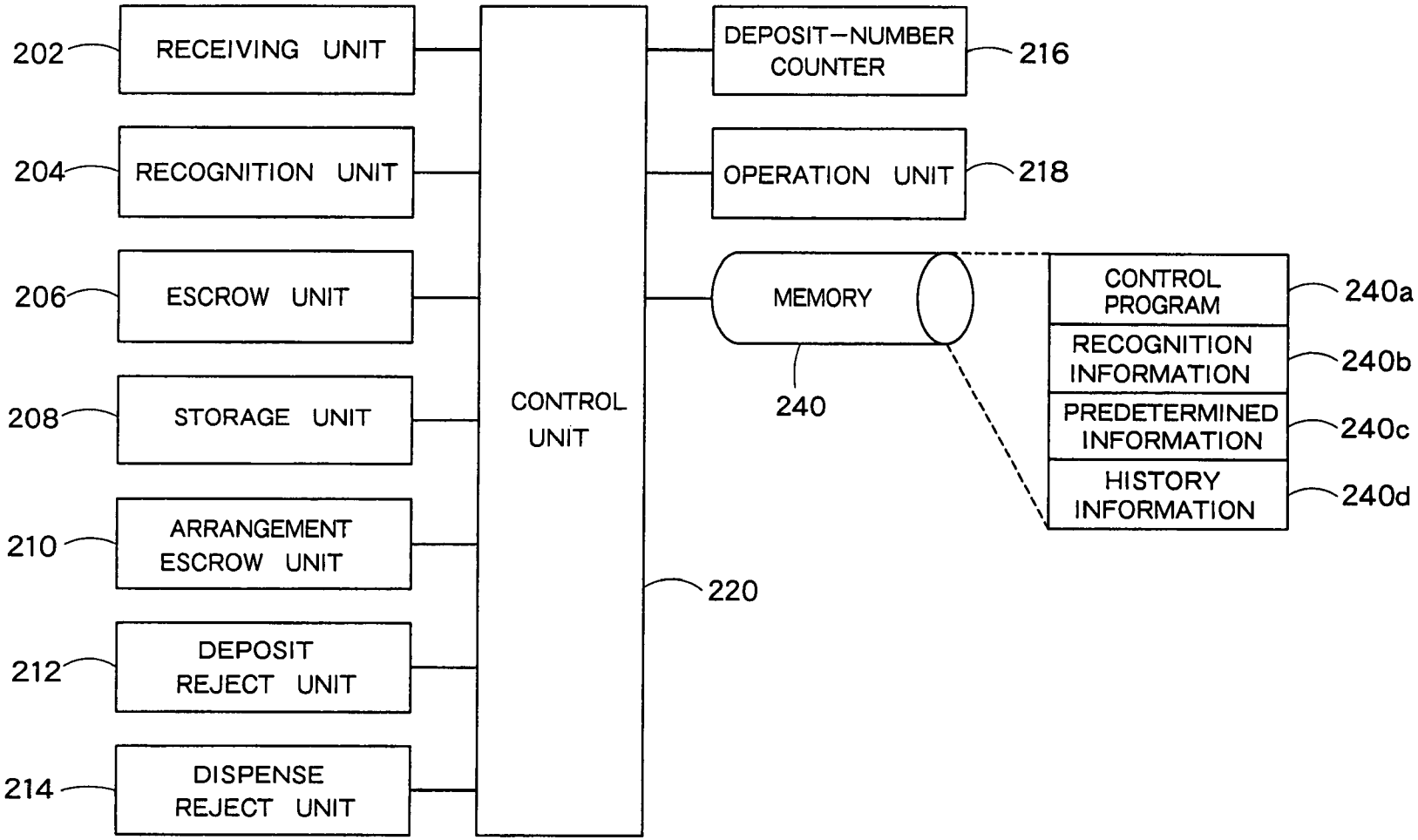
FIG. 22 is a block diagram showing the control function of the banknote handling apparatus related to the second embodiment.
Figure 25A:
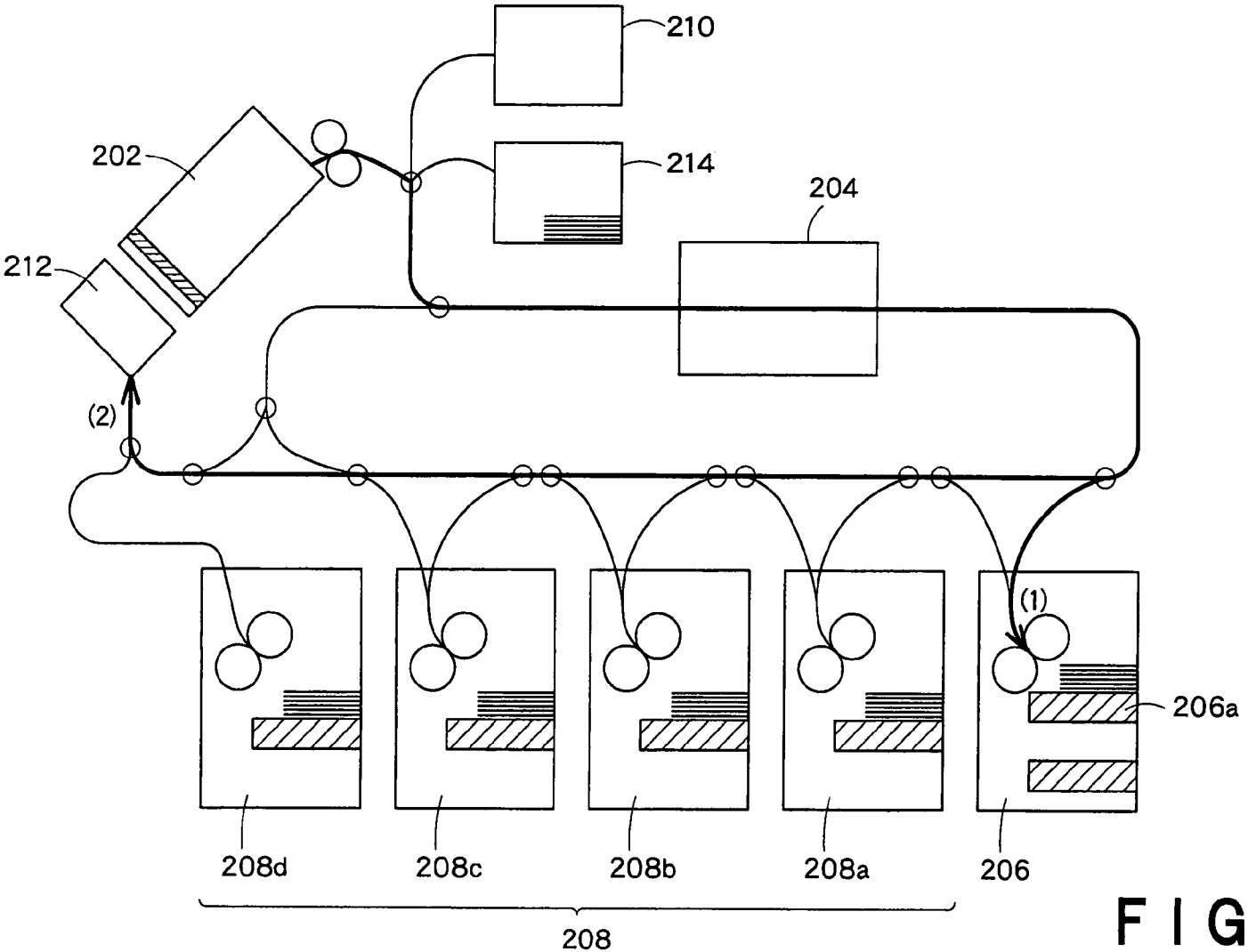
FIG. 25A is a schematic diagram showing the transport route of the banknote handling apparatus related to the second embodiment.
Figure 25B:
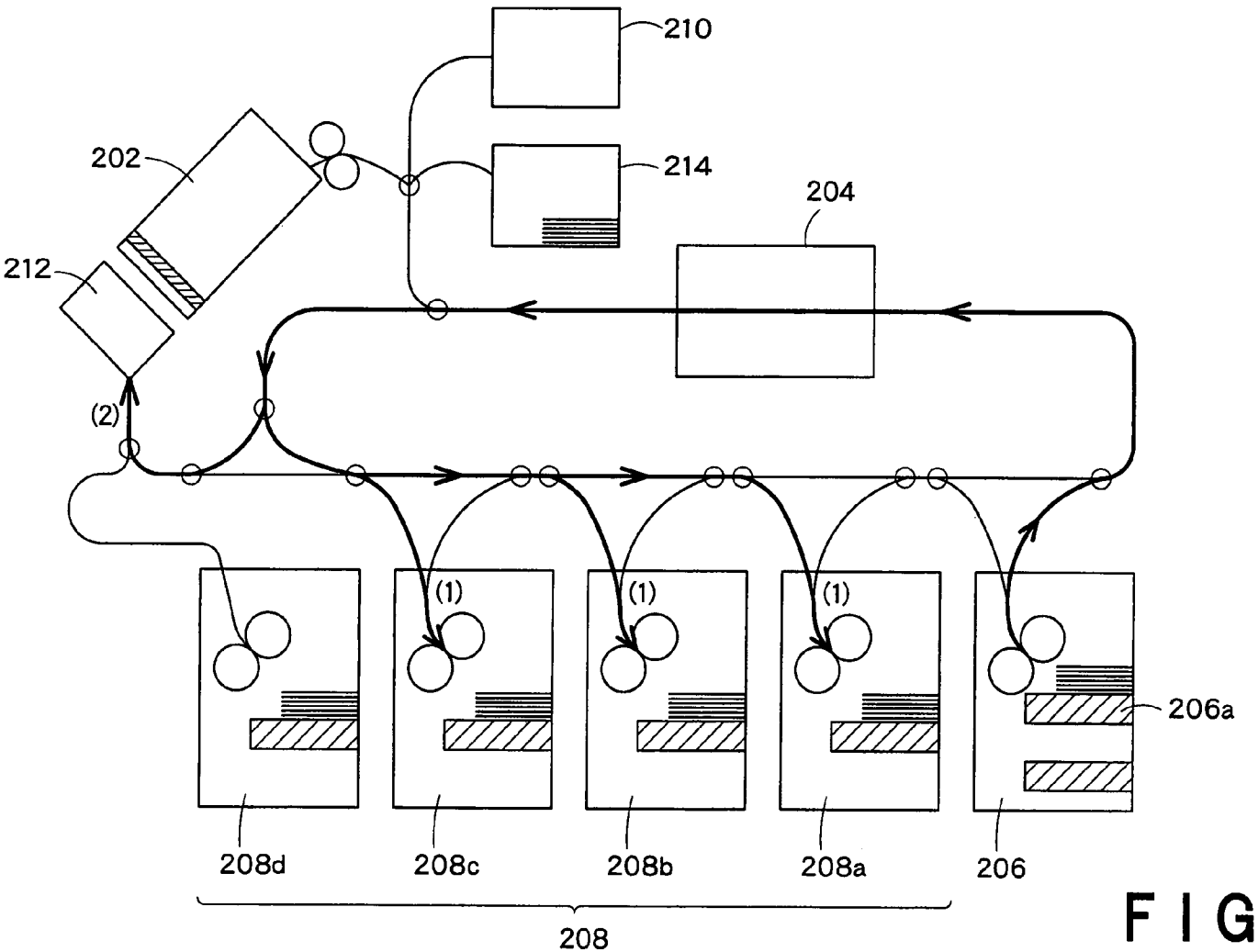
FIG. 25B is another schematic diagram showing the transport route of the banknote handling apparatus related to the second embodiment.
Figure 25C:
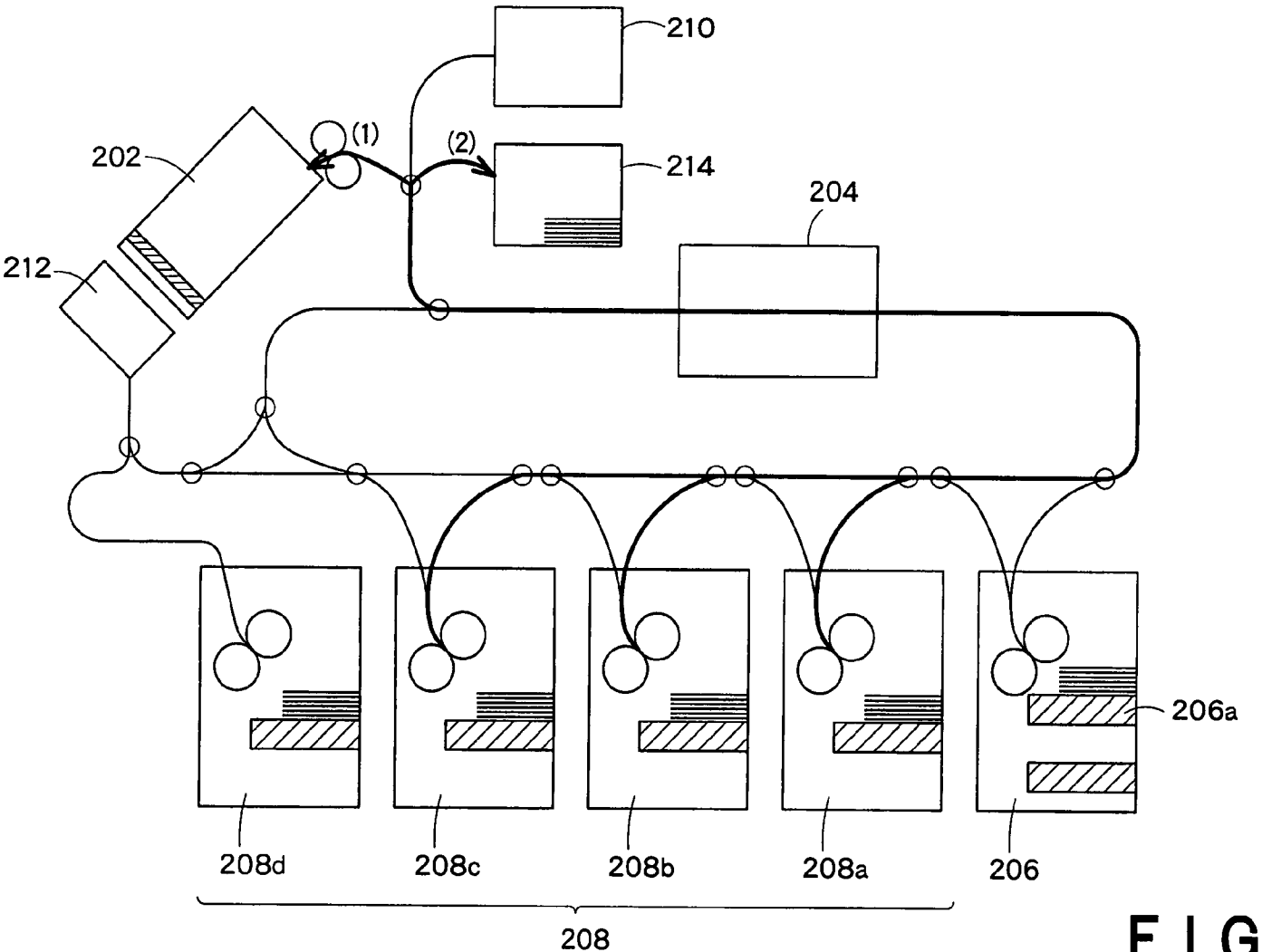
FIG. 25C is still another schematic diagram showing the transport route of the banknote handling apparatus related to the second embodiment.

Hereinafter, a second embodiment of the present invention will be described with reference to the drawings. FIGS. 21 through 25 are diagrams respectively showing the banknote handling apparatus related to this embodiment. FIG. 21 is a schematic view showing the construction of the banknote handling apparatus related to the second embodiment. FIG. 22 is a block diagram showing the control function of the banknote handling apparatus related to the second embodiment. FIG. 23 is a diagram schematically showing the recognition information shown in FIG. 22. FIG. 24 is a diagram schematically showing the predetermined information shown in FIG. 22. FIGS. 25A through 25C are schematic diagrams respectively showing the transport route of the banknote handling apparatus related to the second embodiment.

As shown in FIG. 21, the banknote handling apparatus 200 comprises a receiving unit 202, a recognition unit 204, an escrow unit 206, a storage unit 208, an arrangement escrow unit 210, a deposit reject unit 212 and a dispense reject unit 214. Each of these units is provided along the transport path. In addition to the construction depicted in FIG. 21, the banknote handling apparatus 200 comprises a deposit-number counter 216, an operation unit 218, a control unit 220 and a memory 240, as shown in FIG. 22.

The receiving unit 202 includes an inlet, through which the operator can insert the banknotes, a receiving mechanism configured for receiving the banknotes inserted in the inlet, one by one, into the apparatus, a stacking mechanism adapted for stacking the banknotes in order to match the face/back of the banknotes, a feeding mechanism for feeding out the stacked banknotes, and an outlet provided for dispensing the banknote to the exterior of the apparatus. Namely, the receiving unit 202 can serve as the inlet, stacking mechanism and outlet. In this embodiment, while the inlet and outlet are integrally provided in the receiving unit 202, the inlet and outlet may be separated in the apparatus.

The recognition unit 204 includes a detection sensor for detecting attributes (such as the face/back, denomination and the like) of each banknote received by the receiving unit 202, and a counter for counting the number of the received banknotes. The recognition unit 204 is configured to transmit each recognition result to the control unit 220.

The escrow unit 206 includes an escrow mechanism adapted for escrowing (temporarily storing) therein the banknotes recognized by the recognition unit 204, the feeding mechanism adapted for feeding out the escrowed banknotes, and a movable separator 206*a* adapted for dividing the interior of the escrow unit 206 into a plurality of regions.

The storage unit 208 includes cassettes 208*a* through 208*c*, each adapted for storing therein the banknotes recognized to be of the predetermined denomination (the denomination corresponding to each of the cassettes 208*a* through 208*c*) by the recognition unit 204 (hereinafter referred to as "the normal banknotes"), and a cassette 208*d* adapted for collectively storing therein the banknotes of a plurality of denominations. In this case, while the feeding mechanism for feeding out the stored banknotes, one by one, is provided to each of the cassettes 208*a* through 208*c*, the cassette 208*d* is not provided with the feeding mechanism. Namely, while each of the cassettes 208*a* through 208*c* is configured to store therein as well as feed out the banknotes, the cassette 208*d* is not configured to feed out the banknotes, but is only adapted for storing therein the banknotes. In this case, the operator can alter the denomination corresponding to each of the cassettes 208*a* through 208*c* by using the operation unit 218. Although described as one example that includes the cassette 108*d* not provided with the feeding mechanism, this embodiment is not limited to such an aspect. For instance, the feeding mechanism may be provided to the cassette 208*d*, such that the cassette 208*d* can eject the banknotes to the exterior of the apparatus or repeatedly feed out the banknotes therefrom and store them therein.

The arrangement escrow unit 210 is connected with the bundling unit (not shown in the second embodiment) adapted for bundling the banknotes, and includes the escrow mechanism adapted for escrowing therein the predetermined number (e.g., 100 sheets) of banknotes and the feeding mechanism adapted for feeding out the predetermined number of escrowed banknotes to the bundling unit.

The deposit reject unit 212 is configured to accumulate therein the banknotes (hereinafter referred to as "the deposit rejected banknotes", each including reject factors (e.g., the denomination not corresponding to any one of the corresponding cassettes 208*a* through 208*c*, abnormality in the recognition, abnormality in the transportation and the like) during the depositing process, and/or banknotes (hereinafter referred to as "the returned banknotes") fed out from the escrow unit 206 when the instruction for the depositing process is cancelled.

The dispense reject unit 214 is configured to store therein the banknotes (hereinafter referred to as "the dispense rejected banknotes"), each including the reject factors (e.g., the abnormality in the recognition, abnormality in the transportation and the like) during the dispensing process.

The deposit-number counter 216 includes a counter for counting the total number of the banknotes inserted in the inlet. The deposit-number counter 216 is configured to transmit a count result of the counter to the control unit 220.

The operation unit 218 includes the plurality of keys, each adapted for inputting the instruction of the operator, and the display adapted for displaying the predetermined screen. The operation unit 218 is configured to transmit each instruction of the operator to the control unit 220.

The control unit 220 is configured to start a control program 240*a* stored in the memory 240, based on the operator's instruction transmitted from the operation unit 218, in order to control the receiving unit 202, recognition unit 204, escrow unit 206, storage unit 208, arrangement escrow unit 210, deposit reject unit 212, dispense reject unit 214, deposit-number counter 216 and operation unit 218. Further, the control unit 220 is configured to write recognition information 240*b* in the memory 240, based on each recognition result transmitted from the recognition unit 204. Additionally, the control unit 220 is configured to write the predetermined information 240*c* in the memory 240, based on each operator's instruction transmitted from the operation unit 218.

The memory 240 is configured to store therein the control program 240*a*, recognition information 240*b*, predetermined information 240*c*, history information 240*d* and other various data. The control program 240*a* is provided to be used for the control unit 220. As shown in FIG. 23, the recognition information 240*b* includes information on the number of the banknotes corresponding to each attribute. Namely, as shown in FIG. 24, the predetermined information 240*c* includes the information on the number of the banknotes (i.e., the predetermined total number of the banknotes, predetermined number of the face/back, predetermined number of the banknotes corresponding to each denomination and predetermined number of the banknotes to be deposited), predetermined processes (i.e., an individual process and a continuous process), predetermined modes (i.e., a normal mode and an interrupt mode), and predetermined booking (i.e., a date, a day of the week and time). As used herein, "the individual process" is set or determined when only one process (e.g., the depositing process or dispensing process) is performed, while "the continuous process" is set when a plurality of processes are performed. Hereinafter, a first process performed in the continuous process will be referred to as "the first process" while the process performed following the first process will be referred to as "the second process." As used herein, the history information 240*d* refers to information on a history of the process (e.g., an amount of the process per day or hour) performed by the control unit 220.

FIG. 25A shows the transport route that is used when the banknotes received by the receiving unit 202 are escrowed in the escrow unit 206. As shown in FIG. 25A, the banknotes inserted in the inlet are first received into the apparatus, one by one, by the receiving unit 202, and then recognized by the recognition unit 204. Thereafter, the normal banknotes are escrowed into the escrow unit 206 (as depicted by an arrow 1), while the deposit rejected banknotes are accumulated in the deposit reject unit 212 (as depicted by an arrow 2).

FIG. 25B shows the transport route used when the banknotes escrowed in the escrow unit 206 are stored in the storage unit 208. As shown in FIG. 25B, when the depositing process for the banknotes is confirmed, the banknotes escrowed in the escrow unit 206 are recognized by the recognition unit 204 and stored in any one of the cassettes 208*a* through 208*c*, for each denomination (as depicted by the arrow 1). Meanwhile, when the depositing process is not confirmed, the banknotes are accumulated in the deposit reject unit 212 (as depicted by the arrow 2).

FIG. 25C shows the transport route employed in the dispensing process. First, the banknotes fed out from the cassettes 208*a* through 208*c* are recognized by the recognition unit 204, respectively. Then, when the recognition result of the recognition unit 204 shows that the banknotes are normal, the banknotes are transported to the outlet (as depicted by the arrow 1). Meanwhile, when the banknotes are recognized as the dispense rejected banknotes, such banknotes are accumulated in the dispense reject unit 214 (as depicted by the arrow 2).

Figure 26:
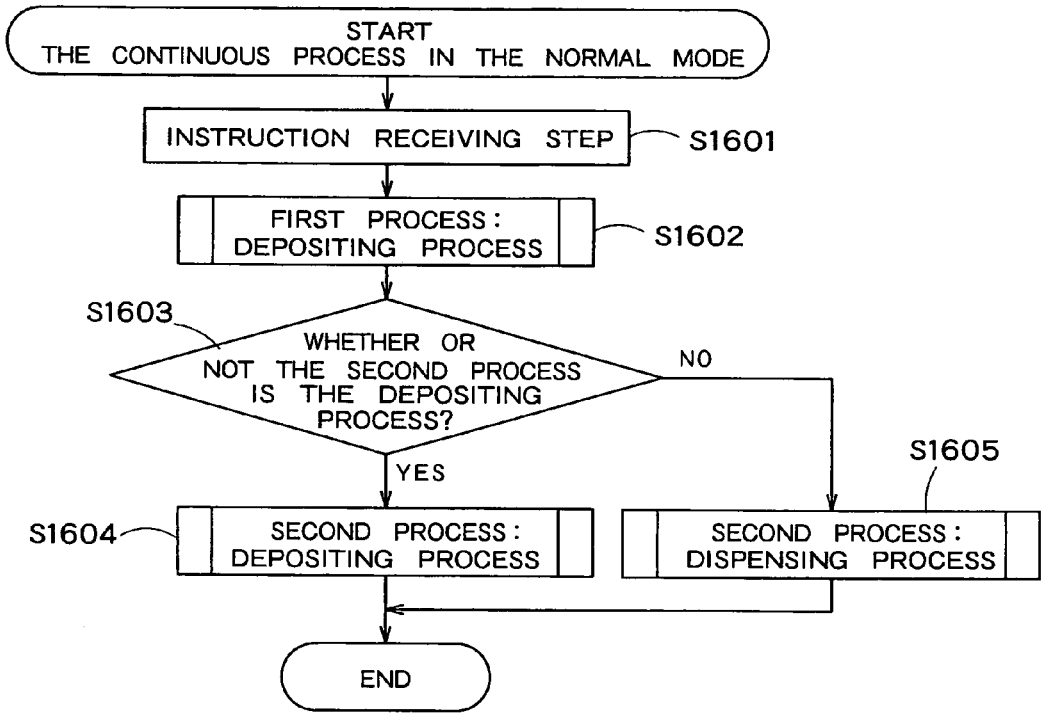
FIG. 26 is a flow chart illustrating a procedure of a continuous process in a normal mode related to the second embodiment.
Figure 27:
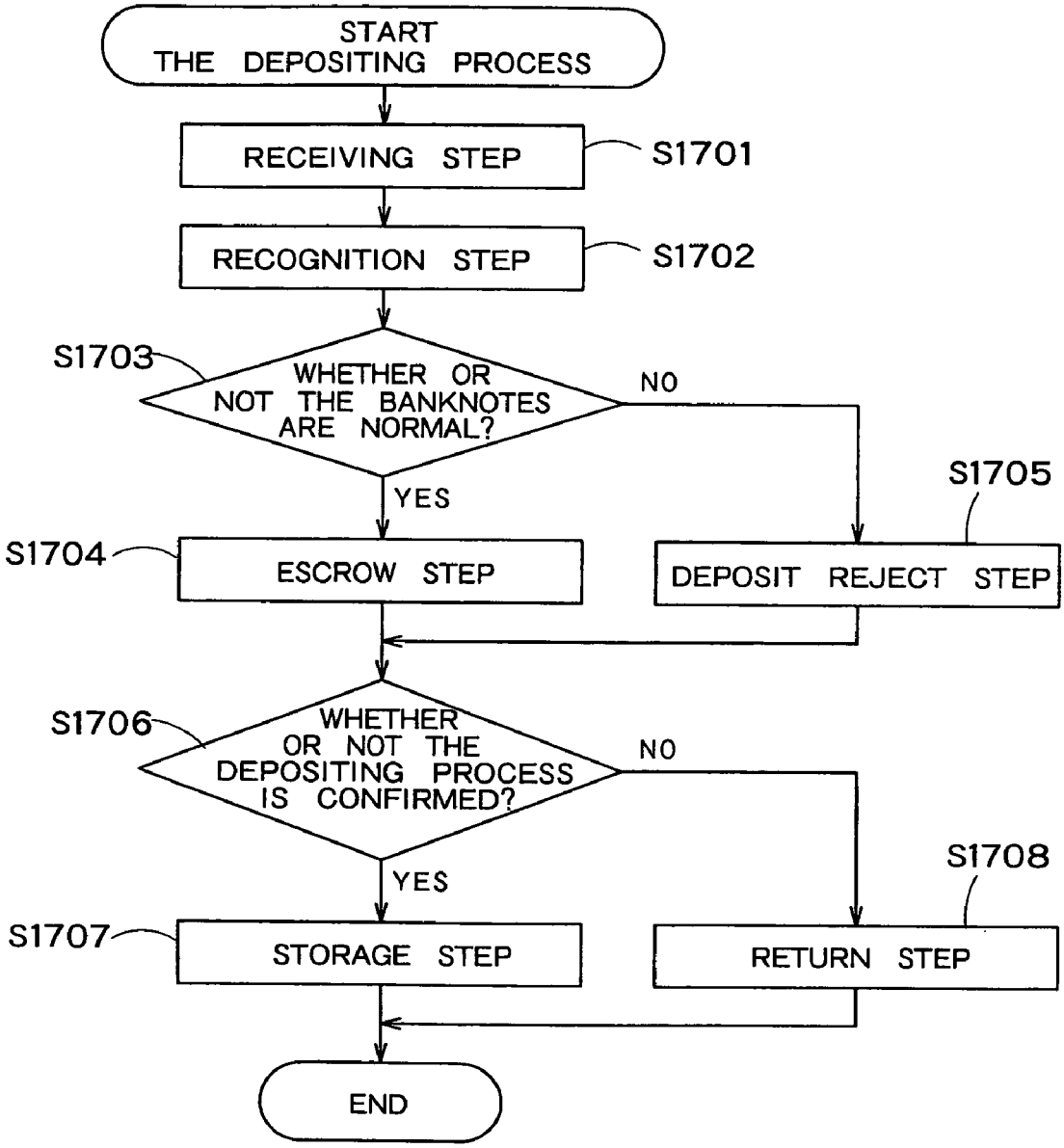
FIG. 27 is a flow chart illustrating a procedure of each depositing process (S1602 and S1604) shown in FIG. 26.
Figure 28:
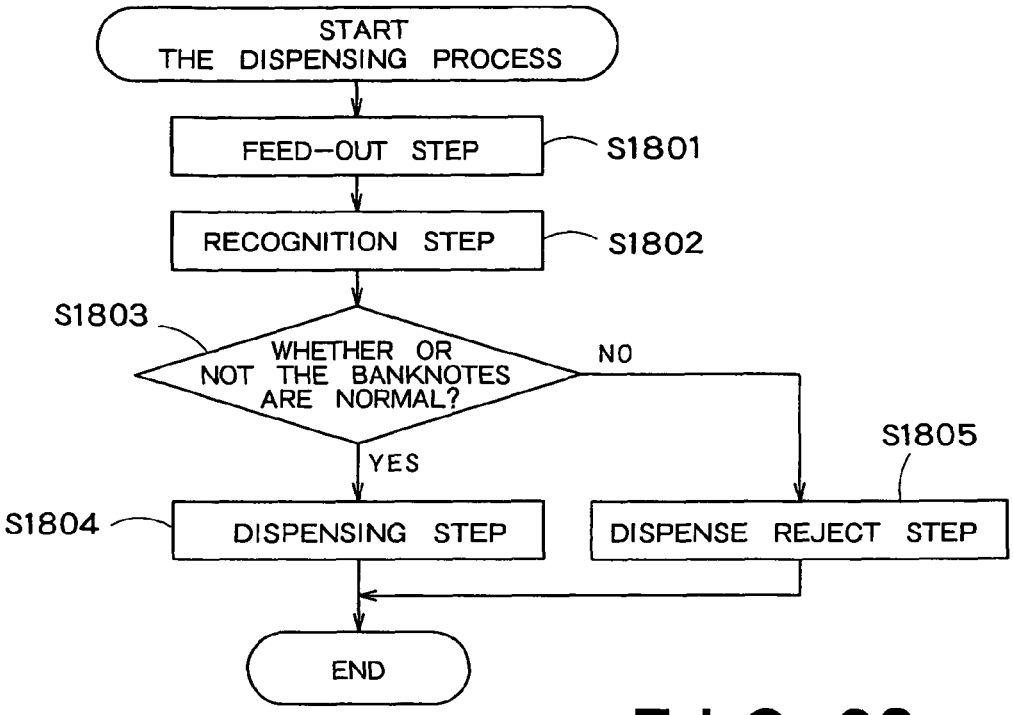
FIG. 28 is a flow chart illustrating a procedure of a dispensing process (S1605) shown in FIG. 26.

Now, referring to FIGS. 26 through 28, the continuous process in the normal mode related to this embodiment will be described. Of these drawings, FIG. 26 is a flow chart illustrating a procedure of the continuous process in the normal mode related to the second embodiment. FIG. 27 is a flow chart illustrating a procedure of the depositing process (S1602 or S1604) shown in FIG. 26. FIG. 28 is a flow chart illustrating a procedure of the dispensing process (S1605) shown in FIG. 26.

The continuous process in the normal mode related to this embodiment shown in FIG. 26 is performed when the predetermined process of the predetermined information 240*c* shown in FIG. 24 is set as the continuous process (in the normal mode).

As shown in FIG. 26, in the continuous process in the normal mode related to this embodiment, an instruction receiving step (S1601) is first performed. In this instruction receiving step (S1601), the control unit 220 receives the operator's instruction transmitted from the operation unit 218. Once the control unit 220 receives the operator's instruction, the contents of the continuous process is confirmed. Namely, the operator's instruction includes instructions about the contents of the continuous process (e.g., the continuous process for continuously performing two depositing processes or continuous process for continuously performing the depositing process and dispensing process).

Then, as shown in FIG. 26, the depositing process (S1602), as the first process, is performed. Now, this depositing process (S1602) will be described.

As shown in FIG. 27, in the depositing process (S1602), a receiving step (S1701) is first performed. In this receiving step (S1701), the control unit 220 controls the receiving mechanism of the receiving unit 202 to receive the banknote inserted in the inlet, one by one.

Then, as shown in FIG. 27, a recognition step (S1702) is performed. In this recognition step (S1702), the control unit 220 controls the recognition unit 204 to recognize the attributes of the banknotes received in the receiving step (S1701). Thereafter, the control unit 220 writes the recognition information 240*b* in the memory 240, based on each recognition result transmitted from the recognition unit 204.

Thereafter, as shown in FIG. 27, if the banknotes are recognized as the normal banknotes (S1703—YES), an escrow step (S1704) is performed. Meanwhile, if the banknotes are recognized as the deposit rejected banknotes (S1703—NO), then a deposit reject step (S1705) is performed.

As shown in FIG. 27, in the escrow step (S1704), the control unit 220 controls the transport path to escrow the normal banknotes into the escrow unit 206.

Further, as shown in FIG. 27, in the deposit reject step (S1705), the control unit 220 controls the transport path to accumulate the deposit rejected banknotes into the deposit reject unit 212.

Then, as shown in FIG. 27, if the depositing process is confirmed (S1706—YES), a storage step (S1707) is performed. Meanwhile, if the depositing process is cancelled (S1706—NO), then a return process (S1708) is performed. For instance, when the operator inputs the instruction for confirming the depositing process by using the operation unit 218, the depositing process is confirmed. Meanwhile, when the operator inputs the instruction for cancelling the depositing process, the depositing process is cancelled.

As shown in FIG. 27, in the storage step (S1707), the control unit 220 controls the feeding mechanism of the escrow unit 206 to feed out the banknotes stored in the escrow unit 206, while controlling the transport path to store the fed-out banknotes into the storage unit 208.

Meanwhile, as shown in FIG. 27, in the return step (S1708), the control unit 220 controls the feeding mechanism of the escrow unit 206 to feed out the banknotes stored in the escrow unit 206, while controlling the transport path to accumulate the fed-out banknotes into the deposit reject unit 212.

As shown in FIG. 27, the depositing process (S1602) is completed after the storage step (S1707) or return step (S1708) is ended.

Then, as shown in FIG. 26, if the second process is set as the depositing process in the instruction received in the instruction receiving step (S1601) (i.e., S1603—YES), the depositing process (S1604) as the second process is performed. Meanwhile, when the second process is set as the dispensing process (i.e., S1603—NO), the dispensing process (S1605) as the second process is performed. In this case, the depositing process (S1604) is performed in the same manner as the depositing process (S1602) (see FIG. 27). Now, the dispensing process (S1605) will be described below.

First, as shown in FIG. 28, in the dispensing process (S1605), a feed-out step (S1801) is performed. In this feed-out step (S1801), the control unit 220 controls the feeding mechanism of the storage unit 208 to feed out the banknotes stored in each of the cassettes 208*a* through 208*c*.

Then, as shown in FIG. 28, a recognition step (S1802) is performed. In this recognition step (S1802), the control unit 220 controls the recognition unit 204 to recognize the attributes of each banknote fed out in the feed-out step (S1801). Thereafter, the control unit 220 writes the recognition information 240*b* in the memory 240, based on each recognition result transmitted from the recognition unit 204.

Then as shown in FIG. 28, if the banknotes are recognized as the normal banknotes (i.e., S1803—YES), a dispensing step (S1804) is performed. Meanwhile, if the banknotes are recognized as the dispense rejected banknotes (i.e., S1803—NO), then a dispense reject step (S1805) is performed.

As shown in FIG. 28, in the dispensing step (S1804), the control unit 220 controls the transport path to transport the normal banknotes to the outlet (not shown).

As shown in FIG. 28, in the dispense reject step (S1805), the control unit 220 controls the transport path to transport the dispense rejected banknotes to the dispense reject unit 214.

Further, as shown in FIG. 28, the dispensing process (S1605) shown in FIG. 26 is completed after the dispensing step (S1804) or dispense reject step (S1805) is ended.

Finally, as shown in FIG. 26, the continuous process in the normal mode related to this embodiment is completed after the depositing process (S1604) or dispensing process (S1605), as the second process, is ended.

Figure 29:
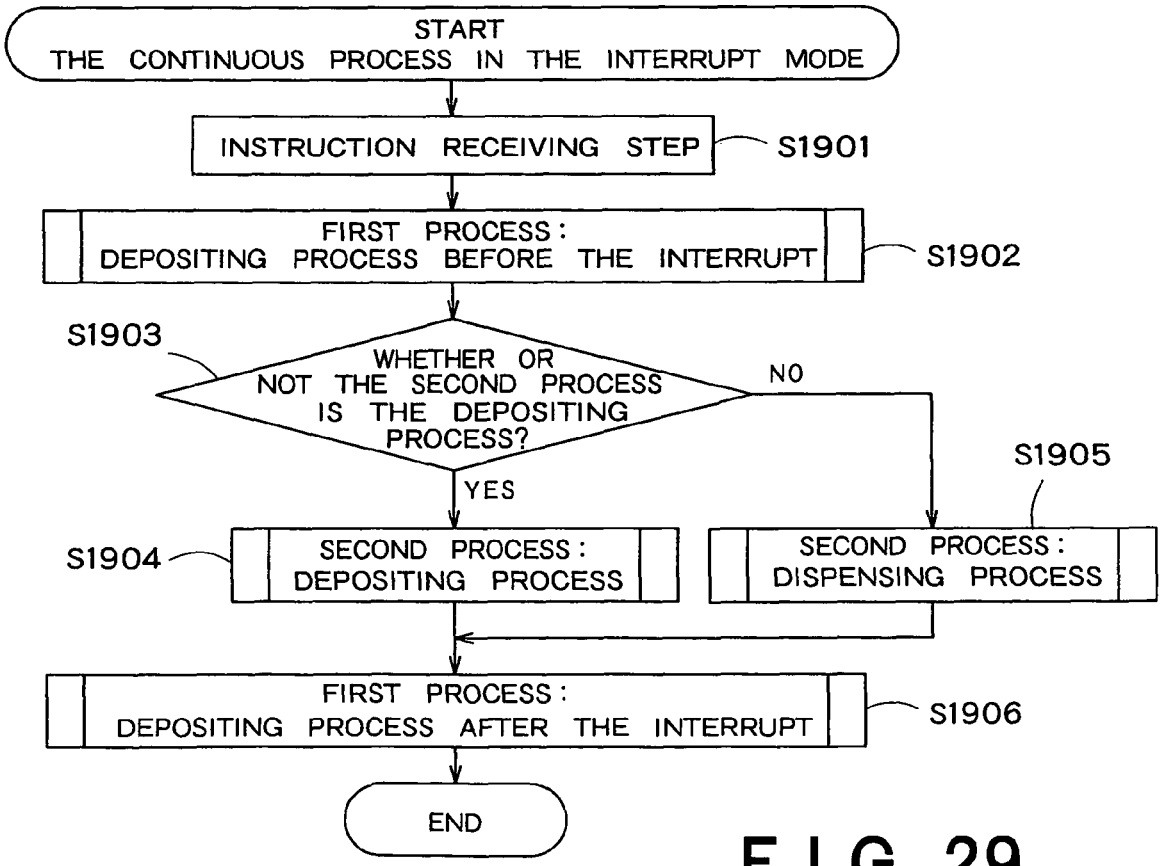
FIG. 29 is a flow chart illustrating a procedure of the continuous process in an interrupt mode related to the second embodiment.
Figure 30:
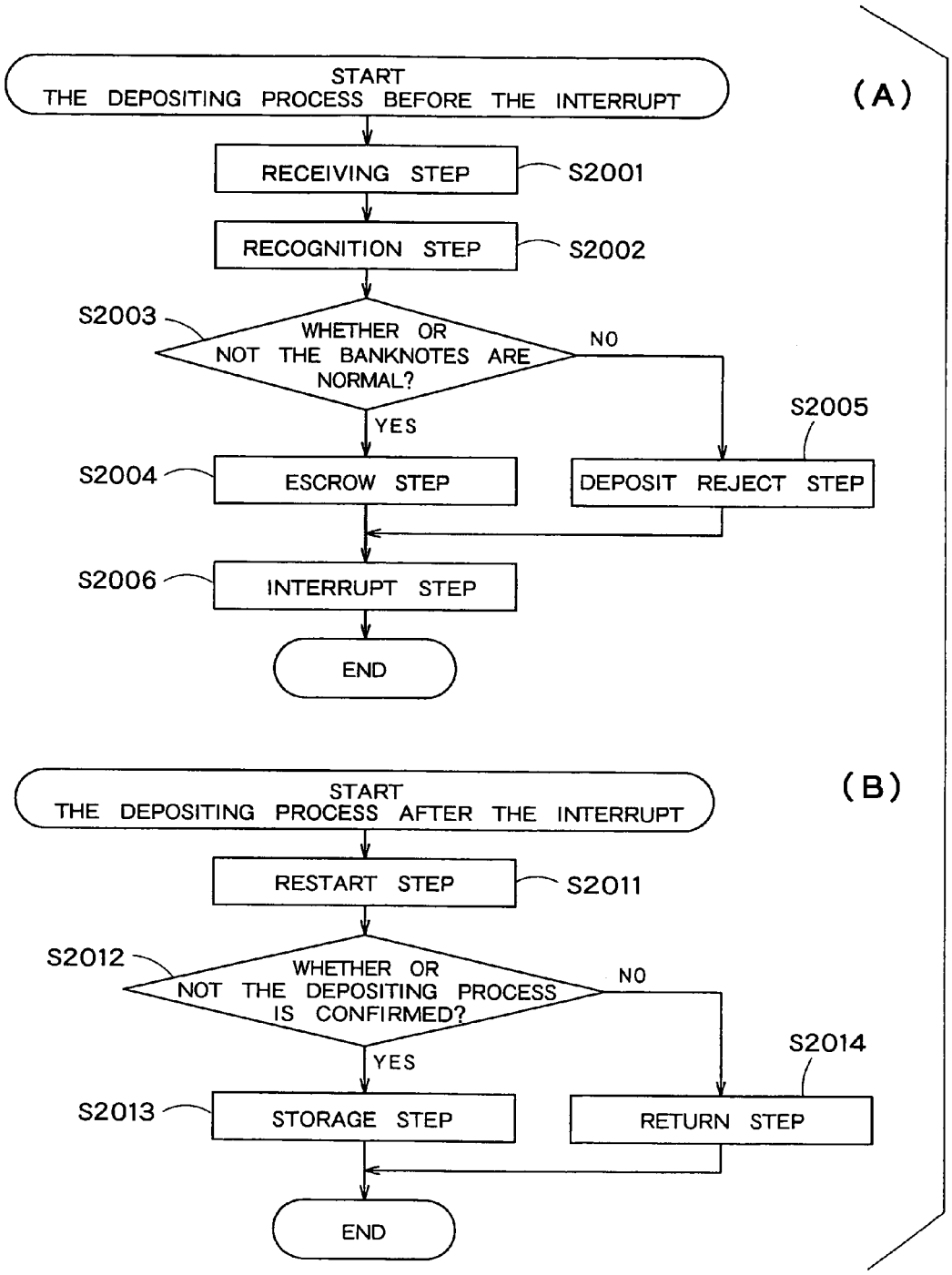
FIG. 30 is a flow chart illustrating a procedure of the depositing process before an interrupt (S1902) and a procedure of the depositing process after the interrupt (S1906), respectively shown in FIG. 29.

Next, the continuous process in the interrupt mode related to this embodiment will be described with reference to FIGS. 29 and 30. FIG. 29 is a flow chart illustrating a procedure of the continuous process in the interrupt mode related to the second embodiment. FIG. 30 is a flow chart illustrating a procedure of the depositing process before an interrupt (S1902) and a procedure of the depositing process after the interrupt (S1906), respectively shown in FIG. 29.

The continuous process in the interrupt mode related to this embodiment shown in FIG. 29 is performed in the case in which the predetermined process of the predetermined information 240*c* shown in FIG. 24 is set as the continuous process (in the interrupt mode).

As shown in FIG. 29, in the continuous process in the interrupt mode related to this embodiment, an instruction receiving step (S1901) is first performed in the same manner as the instruction receiving step (S1601) shown in FIG. 26.

Then, as shown in FIG. 29, the depositing process before the interrupt (S1902), as the first process, is performed. Now, the depositing process before the interrupt (S1902) will be described below.

As shown in FIG. 30(A), in the depositing process before the interrupt (S1902), a receiving step (S2001), a recognition step (S2002), judgment on whether or not the banknotes are normal (S2003), and an escrow step (S2004) or deposit reject step (S2005) are respectively performed, in the same manner as the receiving step (S1701), recognition step (S1702), judgment on whether or not the banknotes are normal (S1703), and the escrow step (S1704) or deposit reject step (S1705), respectively shown in FIG. 27.

Then, as shown in FIG. 30(A), an interrupt step (S2006) is performed. In this interrupt step (S2006), the control unit 220 controls the separator 206*a* to divide the interior of the escrow unit 206 into the plurality of regions. As a result, the escrow unit 206 is divided into a first region (e.g., a region provided below the separator 206*a*) where the escrowed banknotes are stored and a second region (e.g., a region provided above the separator 206*a*) where the escrowed banknotes are not present.

As shown in FIG. 30(A), the depositing process before the interrupt (S1902) is completed after the interrupt step (S2006) is ended. Namely, the control unit 220 interrupts the depositing process as the first process, when the banknotes received by the receiving unit 202 are escrowed in the escrow unit 206 or when such banknotes are accumulated in the deposit reject unit 212.

Then, as shown in FIG. 29, if the second process is set as the depositing process in the instruction received in the instruction receiving step (S1901) (i.e., S1903—YES), the depositing process (S1904) as the second process is performed in the same manner as the depositing process (S1602) shown in FIG. 26 (see FIG. 27). Meanwhile, if the second process is set as the dispensing process (i.e., S1903—NO), the dispensing process (S1905) as the second process is performed in the same manner as the dispensing process (S1605) shown in FIG. 26 (see FIG. 28). In the depositing process (S1904) performed as the second process, the banknotes are escrowed in the second region (e.g., the region provided above the separator 206*a*) of the escrow unit 206 in the escrow step (S1704) shown in FIG. 27.

Further, as shown in FIG. 29, after the depositing process (S1904) or dispensing process (S1905) as the second process is performed, the depositing process after the interrupt (S1906) as the first process is performed. Now, the depositing process after the interrupt (S1906) will be described below.

As shown in FIG. 30(B), in the depositing process after the interrupt (S1906), a restart step (S2011) is first performed. In this restart step (S2011), the control unit 220 controls the separator 206*a* to integrate the first region with the second region in the escrow unit.

Then, as shown in FIG. 30(B), if the depositing process is confirmed (i.e., S2012—YES), a storage step (S2013) is performed in the same manner as the storage step (S1707) shown in FIG. 27. Meanwhile, if the depositing process is cancelled (i.e., S2012—NO), a return step (S2014) is performed in the same manner as the return step (S1708) shown in FIG. 27.

As shown in FIG. 30(B), the depositing process after the interrupt (S1906) is completed after the storage step (S2013) or return step (S2014) is ended. Namely, after the depositing process (S1904) or dispensing process (S1905) as the second process is completed, the control unit 220 restarts the depositing process performed as the first process.

In this way, as shown in FIG. 29, the continuous process in the interrupt mode related to this embodiment is completed after the depositing process after the interrupt (S1906) is ended.

Next, a first variation of the second embodiment will be discussed. It is noted that the first variation of this embodiment is described herein as one example in which the instruction for the continuous process is received, during a period of time after the receiving process for the banknote by the receiving unit 202 is started and before the escrow process for the banknotes into the escrow unit 206 is completed, in the depositing process performed as the individual process.

Figure 31:
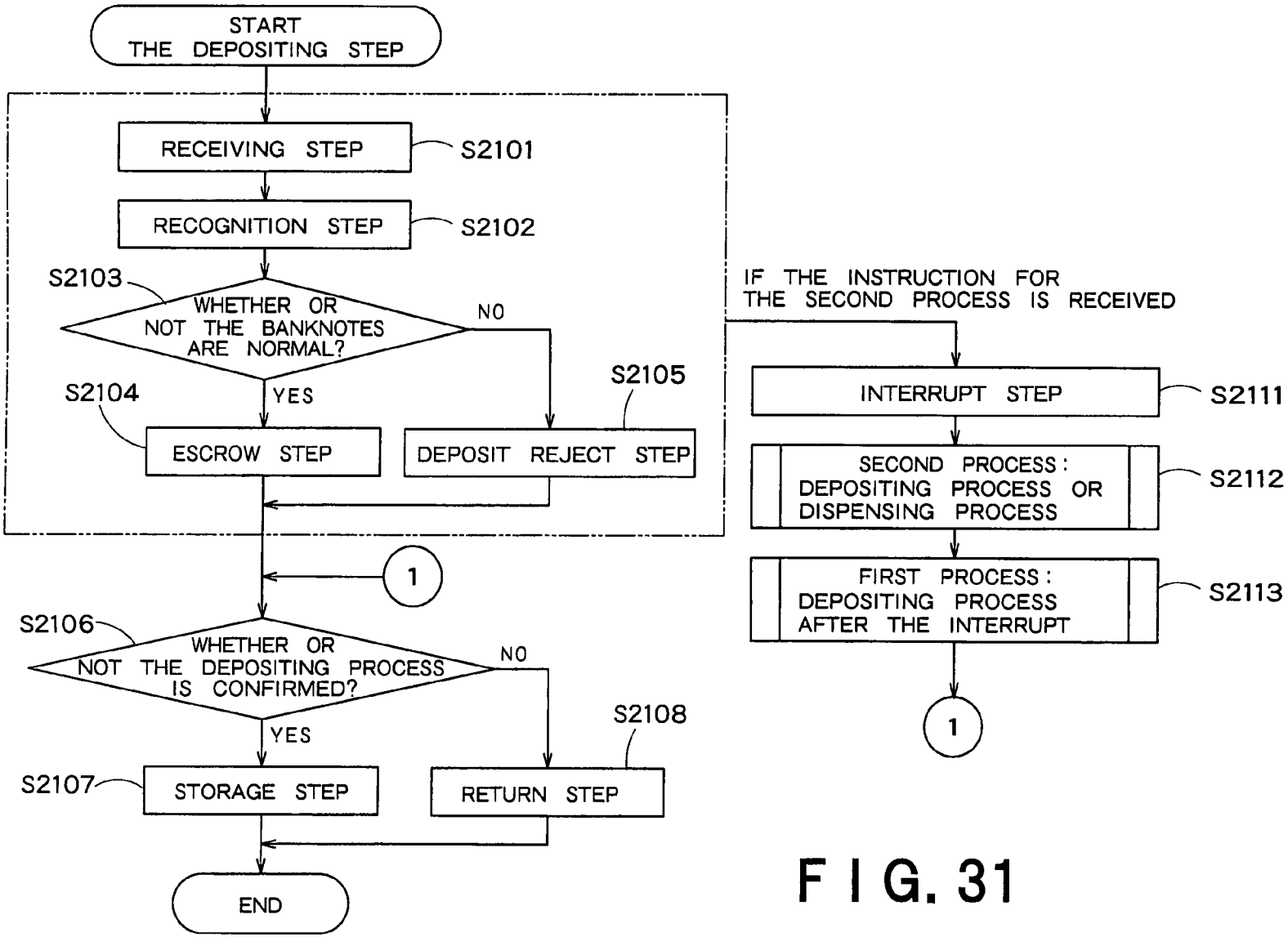
FIG. 31 is a flow chart illustrating a procedure of the depositing process, as an individual process, related to a first variation of the second embodiment.

Now, referring to FIG. 31, the continuous process related to the first variation of the second embodiment will be described. FIG. 31 is a flow chart illustrating a procedure of the depositing process, as the individual process, related to the first variation of this embodiment.

Namely, the depositing process, as the individual process, related to the first variation of this embodiment shown in FIG. 31 is performed in the case in which the predetermined process of the predetermined information 240*c* shown in FIG. 24 is set as the individual process.

As shown in FIG. 31, in the depositing process, as the individual process, related to the first variation of this embodiment, a receiving step (S2101), a recognition step (S2102), judgment on whether or not the banknotes are normal (S2103) and an escrow step (S2104) or deposit reject step (S2105) are respectively performed, in the same manner as the receiving step (S1701), recognition step (S1702), judgment on whether or not the banknotes are normal (S1703), and escrow step (S1704) or deposit reject step (S1705), respectively shown in FIG. 27. In this case, the control unit 220 checks whether or not the instruction for the second process is received by the operation unit 218 during a period of time after the receiving step (S2101) is started and before the escrow step (S2104) or deposit reject step (S2105) is completed.

Further, as shown in FIG. 31, if the instruction for the second process is received by the operation unit 218 during the period of time after the start of the receiving step (S2101) and before the completion of the escrow step (S2104) or deposit reject step (S2105), an interrupt step (S2111), a depositing process or dispensing process (S2112), as the second process, and a depositing process after the interrupt (S2113), as the first process, are performed in the same manner as the interrupt step (S2006) shown in FIG. 30(A), depositing process (S1604) or dispensing process (S1605), as the second process, shown in FIG. 26, and depositing process after the interrupt (S1906) shown in FIG. 29, respectively.

However, as shown in FIG. 31, during the period of time after the start of the receiving step (S2101) and before the completion of the escrow step (S2104) or deposit reject step (S2105), in the case in which the instruction for the second process is not received by the operation unit 218 or otherwise after the depositing process after the interrupt (2113) is completed, judgment on whether or not the depositing process is confirmed (S2106) and a storage step (S2107) or return step (S2108) are respectively performed in the same manner as the judgment on whether or not the depositing process is confirmed (S1706) and storage step (S1707) or return step (S1708), respectively shown in FIG. 27.

Finally, as shown in FIG. 31, the depositing process, as the individual process, related to the first variation of this embodiment is completed after the storage step (S2107) or return step (S2108) is ended.

Figure 32:
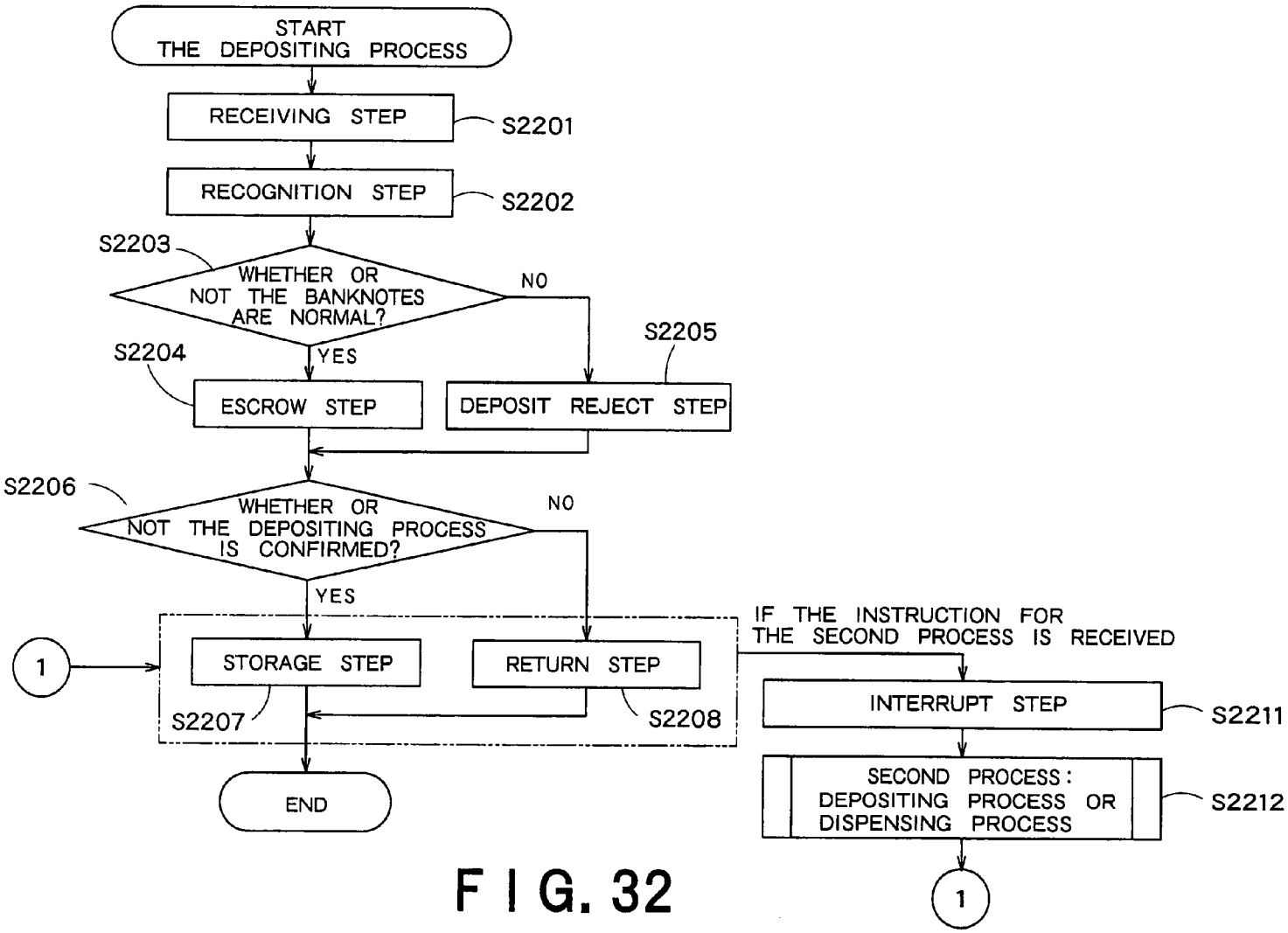
FIG. 32 is a flow chart illustrating the procedure of the depositing process, as the individual process, related to a second variation of the second embodiment.

Next, referring to FIG. 32, the individual process related to a second variation of this embodiment will be described. FIG. 32 is a flow chart illustrating the procedure of the depositing process, as the individual process, related to the second variation of the second embodiment.

The depositing process, as the individual process, related to the second variation of this embodiment shown in FIG. 32 is performed in the case in which the predetermined process of the predetermined information 240*c* shown in FIG. 24 is set as the individual process.

As shown in FIG. 32, in the depositing process, as the individual process, related to the second variation of this embodiment, a receiving step (S2201), a recognition step (S2202), judgment whether or not the banknotes are normal (S2203), an escrow step (S2204) or deposit reject step (S2205), judgment whether or not the depositing process is confirmed (S2206), and a storage step (S2207) or return step (S2208) are respectively performed in the same manner as the receiving step (S1701), recognition step (S1702), judgment whether or not the banknotes are normal (S1703), escrow step (S1704) or deposit reject step (S1705), judgment whether or not the depositing process is confirmed (S1706), and storage step (S1707) or return step (1708), respectively shown in FIG. 27. In this case, the control unit 220 checks whether or not the instruction for the second process is received by the operation unit 218 during a period of time that the storage step (S2207) or return step (S2208) is performed.

As shown in FIG. 32, if the instruction for the second process is received by the operation unit 218 during the period of time that the storage step (S2207) or return step (S2208) is performed, an interrupt step (S2211) is performed. In this interrupt step (S2211), the control unit 220 controls the feeding mechanism of the escrow unit 206 to stop the feed out of the banknotes from the escrow unit 206 to the storage unit 208.

Then, as shown in FIG. 32, a depositing process or dispensing process (S2212), as the second process, is performed in the same manner as the depositing process (S1604) or dispensing process (S1605), as the second process, shown in FIG. 26. Thereafter, the storage step (S2207) or return step (S2208) is restarted.

Finally, as shown in FIG. 32, the depositing process, as the individual process, related to the second variation of this embodiment is completed after the storage step (S2207) or return step (S2208) is ended.

Namely, in the above second embodiment, the banknote handling apparatus 200 comprises the receiving unit 202 adapted for receiving the banknotes inserted in the inlet, the recognition unit 204 adapted for recognizing the banknotes received by the receiving unit 202, the escrow unit 206 having the escrow mechanism adapted for escrowing therein the banknotes recognized by the recognition unit 204 and the feeding mechanism adapted for feeding out the escrowed banknotes, the storage unit 208 having a storage mechanism adapted for storing therein the banknotes fed out from the escrow unit 206, and the control unit 220 adapted for performing the control for escrowing the banknotes received by the receiving unit 202 into the escrow unit 206 through the recognition unit 204 and then storing the banknotes escrowed in the escrow unit 206 into the storage unit 208 in the depositing process. In the continuous process for continuously performing the depositing process, as the first process, and the second process following the depositing process performed as the first process, the control unit 220 is configured to select the normal mode, in which the depositing process (S1602) as the first process is first performed, and then the depositing process (S1604) or dispensing process (S1605) as the second process is performed after the completion of the depositing process (S1602) performed as the first process; and the interrupt mode, in which the depositing process as the first process is first performed to the middle (i.e., the depositing process before the interrupt (1902) is performed), and then the depositing process (S1904) or dispensing process (S1905), as the second process, is performed after the depositing process, as the first process, is interrupted, and thereafter the depositing process, as the first process, is restarted (i.e., the depositing process after the interrupt (S1906) is performed) after the completion of the depositing process (S1904) or dispensing process (S1905) performed as the second process. With such configuration, the waiting time of the operator required for performing a plurality of dealing operations can be significantly reduced.

Additionally, in this embodiment, the control unit 220 may be configured to select the interrupt mode, in the case in which the instruction for the continuous process is received by the operation unit 218 and the interrupt mode for the continuous process is set in the predetermined process of the predetermined information 240*c* shown in FIG. 24. With this configuration, the time and labor of the operator for inputting the instruction for the interrupt mode by using the operation unit 218 can be saved.

Additionally, in this embodiment, the control unit 220 may be configured to select the interrupt mode, in the depositing process performed as the individual process, in the case in which the instruction for the second process is received by the operation unit 218 during a period of time after the receiving process for the banknotes by the receiving unit 202 (i.e., the receiving step (S2101)) is started and before the escrow process (i.e., the escrow step (S2104) or deposit reject step (S2105)) for escrowing the banknotes into the escrow unit 206 is completed, whereby the first process can be interrupted (i.e., the interrupt step (S2111) can be performed), in the depositing process performed as the individual process, after the banknotes inserted in the inlet are escrowed in the escrow unit 206. With such configuration, the operation mode can be switched into the continuous process in the interrupt mode, without stopping the individual process, even after the operator inputs the instruction for the individual process by using the operation unit 218. This can significantly reduce the operator's waiting time.

Additionally, in this embodiment, the control unit 220 may be configured to select the interrupt mode, in the depositing process performed as the individual process, in the case in which the instruction for the second process is received by the operation unit 218 during a period of time after the feed out of the banknotes by the escrow unit 206 is started and before the storage of the banknotes into the storage unit 208 is completed (or during the storage step (S2207) or return step (S2208)), whereby the feed out of the banknotes by the escrow process can be interrupted (i.e., the interrupt step (S2211) can be performed), in the depositing process performed as the individual process. With such configuration, the operation mode can be switched into the continuous process in the interrupt mode, without stopping the individual process, even after the operator inputs the instruction for the individual process by using the operation unit 218. This can significantly reduce the operator's waiting time.

Additionally, in this embodiment, the control unit 220 may be configured to select the normal mode or interrupt mode, based on at least one of a combination of the date, day of the week, starting time and ending time, respectively received by the operation unit 218 (i.e., the predetermined program of the predetermined information 240*c*). With such configuration, the time and labor of the operator for inputting the instruction for the interrupt mode by using the operation unit 218 can be saved, and errors of the operator in a setting operation can be reduced or substantially eliminated.

Additionally, in this embodiment, the control unit 220 may be configured to select the interrupt mode, in the case in which the total number of the banknotes recognized by the recognition unit 204 (i.e., the total number in the recognition information 240*b*) is equal to or greater than the predetermined number of the banknotes. With such configuration, the time and labor of the operator for inputting the instruction for the interrupt mode by using the operation unit 218 can be significantly saved and occurrence of the operator's errors in the setting operation can be prevented.

Additionally, in this embodiment, the control unit 220 may be configured to select the interrupt mode, in the case in which the count result of the deposit-number counter 216 is equal to or greater than the predetermined number thereof. With such configuration, the time and labor of the operator for inputting the instruction for the interrupt mode by using the operation unit 218 can be saved, and the operator's errors in the setting operation can be well avoided.

Additionally, in this embodiment, the control unit 220 may be configured to select the normal mode or interrupt mode, based on the history information 240*d* stored in the memory 240. For instance, the control unit 220 may refer to the history information 240*d* corresponding to a day or time, at which the instruction for the individual process or continuous process is received by the operation unit 218, and select the interrupt mode, in the case in which the process amount written in the history information 240*d* exceeds a predetermined threshold value (i.e., in the case in which the instruction for the individual process or continuous process is received on the day or time, at which considerably many processes were performed in the past). In this case, the threshold value may be a preset value or optionally set by the operator for each operation. With such configuration, the time and labor of the operator required for inputting the instruction for the interrupt mode and/or instruction for the predetermined booking by using the operation unit 218 can be significantly saved. In addition, this configuration can optionally select the predetermined mode that is optimum for the day or time, at which any given process is performed.

Additionally, in this embodiment, the escrow unit 206 may include the movable separator 206*a* adapted for dividing the interior of the escrow unit 206 into the plurality of regions. With such configuration, only the banknotes escrowed in the escrow unit 206 in the escrow step (S1704) of the depositing process (S1904) as the second process can be returned, while leaving the banknotes escrowed in the escrow unit 206 in the escrow step (S2004) of the depositing process as the first process, (i.e., the depositing process before the interrupt (S1902)), in the case in which the depositing process is cancelled, while the return step (S1708) is performed, in the depositing process (S1904) as the second process, after the depositing process, as the first process, is interrupted in the middle (or the depositing process before the interrupt (S1902) is performed).

While the above second embodiment has been described by way of example in regard to the banknote handling apparatus, this invention is not limited to such an aspect. For instance, the present invention can also be applied to the coin handling apparatus adapted for handling the coins or applied to the paper sheet handling apparatus adapted for handling mediums or objects other than the banknotes.

Third Embodiment

Figure 33:
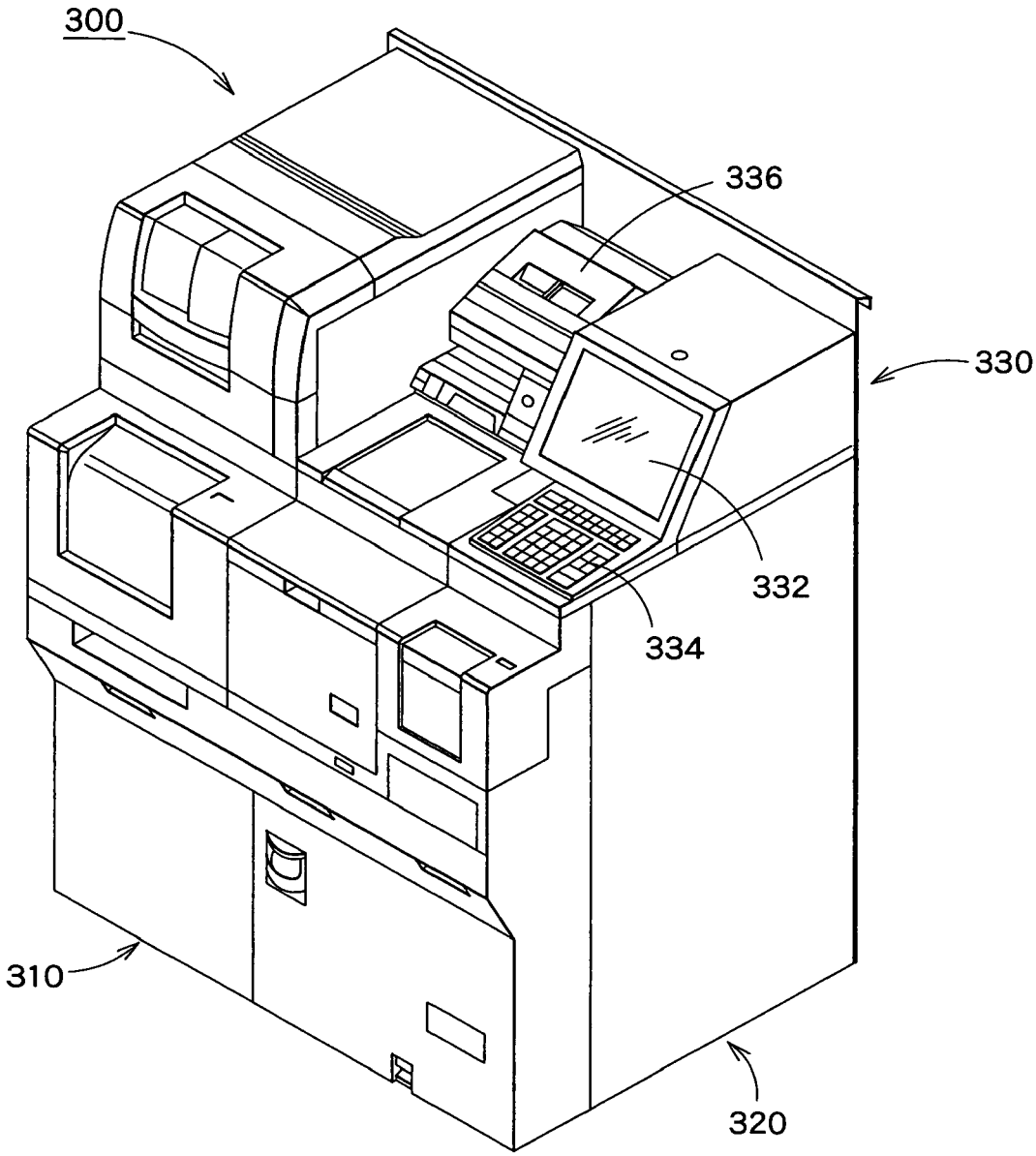
FIG. 33 is a perspective view showing a money handling apparatus related to a third embodiment of the present invention.

Hereinafter, a third embodiment of the present invention will be described with reference to the drawings. The third embodiment of this invention is composed of a combination of the banknote handling apparatus as described in the above first and/or second embodiment and the coin handling apparatus adapted for handling the coins. FIG. 33 is a perspective view showing a money handling apparatus related to the third embodiment. More specifically, FIG. 33 illustrates the money handling apparatus composed of the combination of the banknote handling apparatus in the above first embodiment and one exemplary coin handling apparatus.

Generally, the money handling apparatus 300 as shown in FIG. 33 is used for a cashier machine installed in a cash room in a bank or the like and adapted for mechanically depositing and dispensing the money. In this money handling apparatus 300, the amount and/or number of the money deposited into or dispensed from the apparatus is automatically read by the recognition unit, while a disbursement process, a cash process and the like for the money are performed. In addition, this money handling apparatus 300 may have a function for automatically calculating the total amount of the money stored in the apparatus 300 as well as a function for bundling the money inserted or set in an insertion slot, for each unit number thereof.

In the money handling apparatus 300 as shown in FIG. 33, when seen from the front, the banknote handling apparatus 310 is provided on the left side, while the coin handling apparatus 320 is provided on the right side. The banknote handling apparatus 310 and coin handling apparatus 320 are juxtaposed relative to each other, while being electrically connected with each other by a terminal unit 330 provided to a top portion of the coin handling apparatus 320. Thus, with the operation of the terminal unit 330, the banknote handling apparatus 310 and coin handling apparatus 320 can cooperate with each other.

The banknote handling apparatus 310 has substantially the same construction as that of the banknote handling apparatus 10 in the aforementioned first embodiment. Therefore, the description on the construction of this banknote handling apparatus 310 is now omitted. Thus, the construction of the coin handling apparatus 320 will be described in detail.

Figure 34:
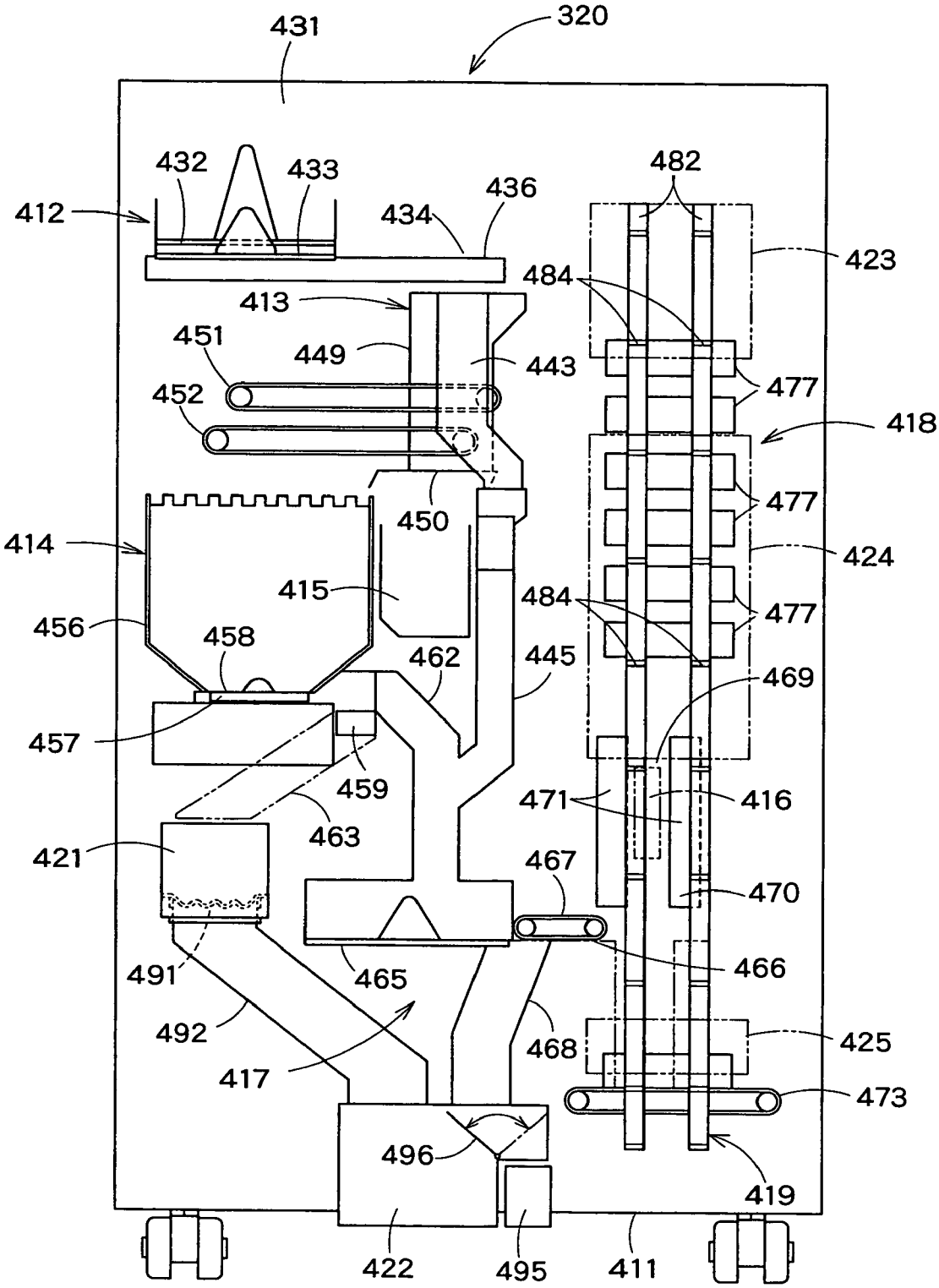
FIG. 34 is a front view showing an internal structure of a coin handling apparatus of the money handling apparatus shown in FIG. 33.
Figure 35:
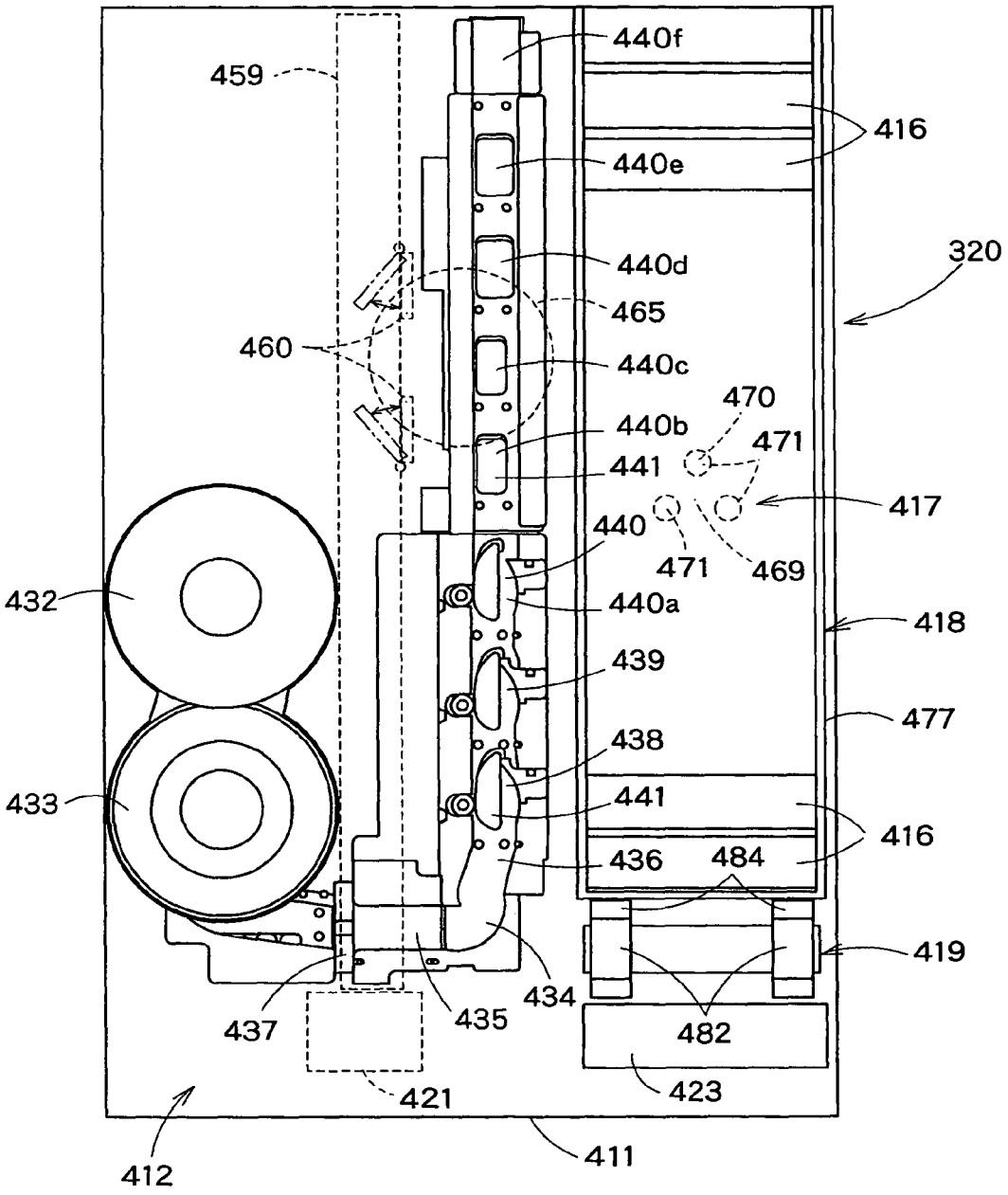
FIG. 35 is a plan view showing the internal structure of the coin handling apparatus of the money handling apparatus shown in FIG. 33.
Figure 36:
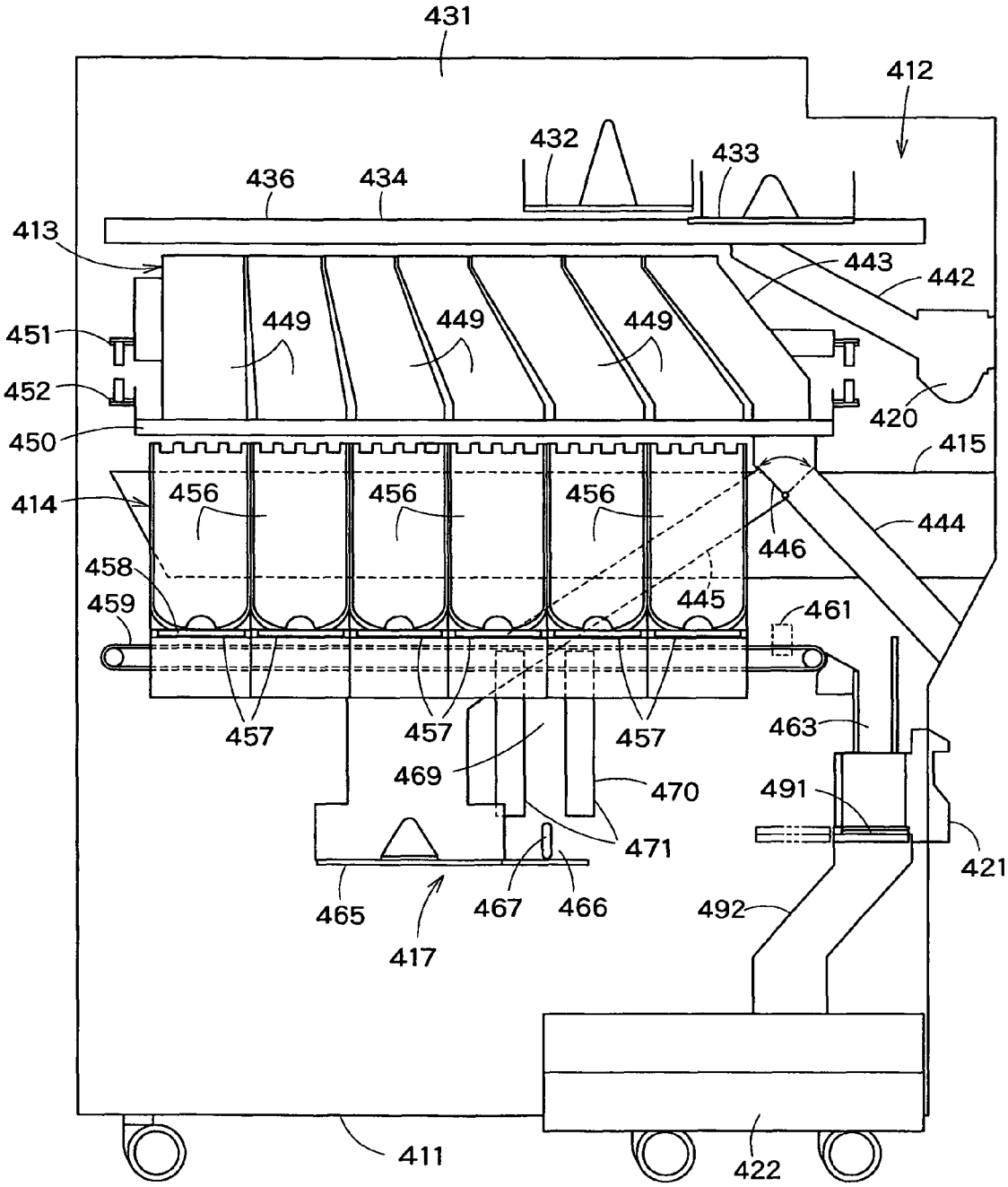
FIG. 36 is a left side view showing the internal structure of the coin handling apparatus of the money handling apparatus shown in FIG. 33.
Figure 37:
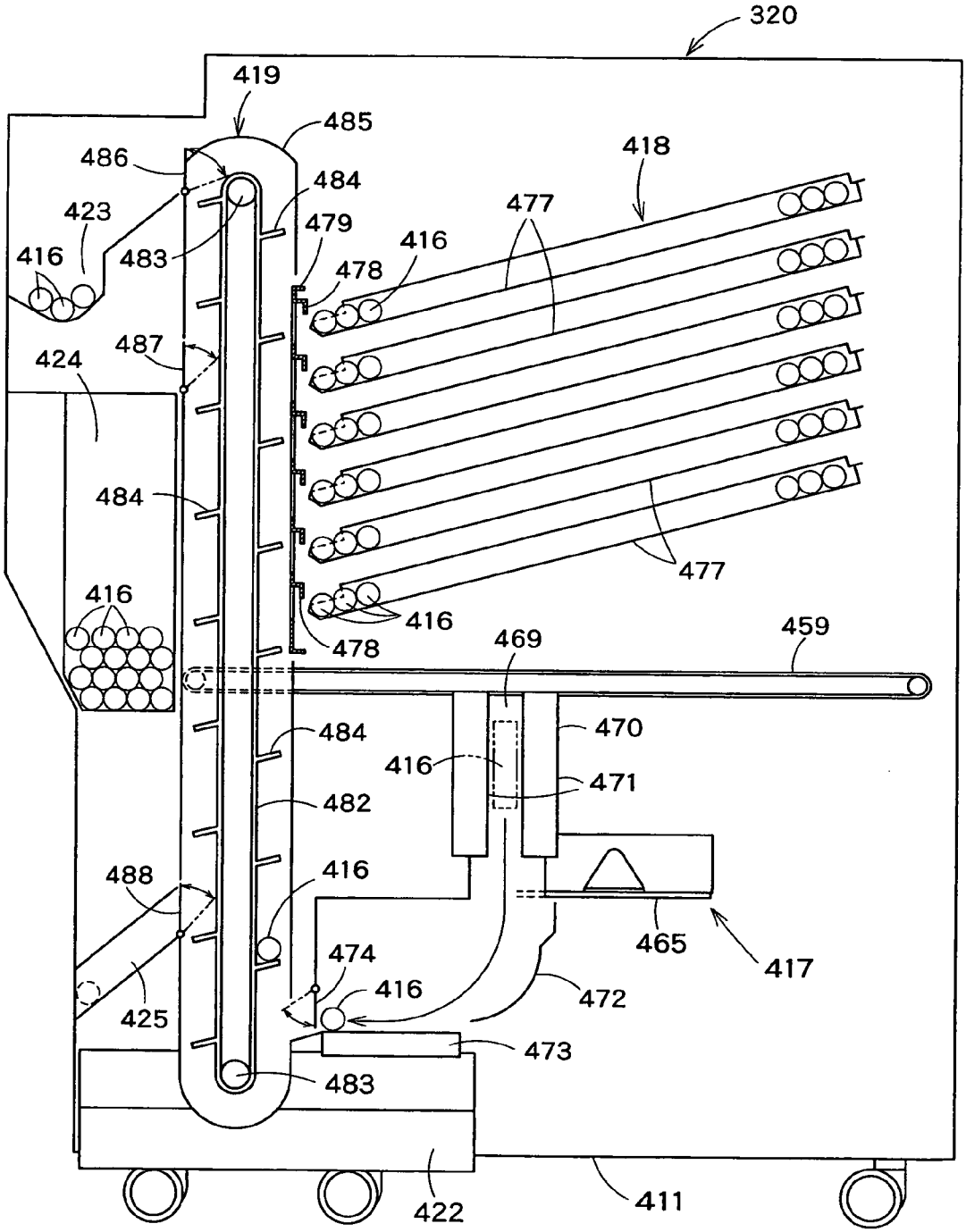
FIG. 37 is a right side view showing the internal structure of the coin handling apparatus of the money handling apparatus shown in FIG. 33.

FIGS. 34 through 37 respectively show an internal structure of the coin handling apparatus 320. Specifically, FIG. 34 is a front view showing the internal structure of the coin handling apparatus 320, FIG. 35 is a plan view showing the internal structure of the coin handling apparatus, FIG. 36 is a left side view showing the internal structure of the coin handling apparatus 320, and FIG. 37 is a right side view showing the internal structure of the coin handling apparatus 320.

As shown in FIGS. 34 through 37, the coin handling apparatus 34 has a body 411. In the body 411, when seen from the front (i.e., as shown in FIG. 34), a coin receiving and handling unit 412 adapted for receiving the coins from the exterior of the body 411 and then recognizing and sorting the coins is provided in an upper left region. In a region below the coin receiving and handling unit 412, an escrow unit 413 adapted for escrowing therein the coins respectively sorted for each denomination by the coin receiving and handling unit 412, is provided. Further, in a region below the escrow unit 413, a coin storage and feed-out unit 414 adapted for storing therein and feeding out the coins fed from the escrow unit 413, and a return box 415 adapted for returning the coins fed from the escrow unit 413 are provided, respectively. In a region below the coin storing and feed-out unit 414 and return box 415, a wrapping unit 417 adapted for forming a coin-roll 416 composed of wrapped coins formed by wrapping a predetermined number of coins in a stacked condition is provided. Additionally, in an upper right region relative to the wrapping unit 417, a coin-roll storage and feed-out unit 418 adapted for storing therein and feeding out each coin roll 416 is provided. Furthermore, a coin-roll transport unit 419 adapted for transporting each coin roll 416 is provided in a front region relative to the wrapping unit 417 and coin-roll storage and feed-out unit 418. Accordingly, the wrapping unit 417 is provided in a lower region of the body 411, and the coin storage and feed-out unit 414 and coin-roll storage and feed-out unit 418 are respectively arranged in a width direction (i.e., from left to right in FIG. 34) of the body 411 in a region above the wrapping unit 417. In addition, the escrow unit 413 and coin receiving and handling unit 412 are vertically arranged, in succession, in a region above the coin storage and feed-out unit 414.

In a front portion of the body 411, a return slot 420 is provided for returning rejected coins to the front region relative to the escrow unit 413. Further, a dispensing box 421 is detachably provided to the front region relative to the wrapping unit 417, while a coin recovery unit 422 is detachably provided to a region below the wrapping unit 417. Additionally, a coin-roll outlet 423 adapted for dispensing the coin-rolls 416 and a coin-roll collective storage unit 424 adapted for collectively storing therein the coin-rolls 416 are detachably provided, respectively, in the front region relative to the coin-roll storage and feed-out unit 418. Furthermore, a coin-roll release slot 425 for releasing the coin-rolls 416 to the exterior of the body 411 is provided to the front region relative to the wrapping unit 417.

The coin receiving and handling unit 412 includes a supply disk 432 adapted for receiving loose coins inserted from an insertion slot 431 provided in a top face of the body 411, a rotary disk 433 configured for further receiving the coins supplied, in a proper amount at a time, from the supply disk 432, and a coin path 434 configured for transporting the coins fed out, one by one, from the rotary disk 433.

The coin path 434 includes a recognition path 435 extending in the width direction of the body 411 from the rotary disk 433, and a sorting path 436 extending backward in the body 411 from the recognition path 435. In each of these paths, a transport belt (not shown) is provided for transporting coins.

Along the recognition path 435, a recognition unit 437 is provided for recognizing the denomination, authentication, fitness or the like of each transported coin.

Further, along the sorting path 436, a rejected-coin diversion unit 438, a diversion unit 439 for any given denomination of the coins, a diversion unit 440 for each denomination of the coins are arranged, in succession, from the upstream side toward the downstream side. The diversion unit 440 for each denomination of the coins includes a five-yen (5-yen) coin diversion unit 440*a*, a 1-yen coin diversion unit 440*b*, a 50-yen coin diversion unit 440*c*, a 100-yen coin diversion unit 440*d*, a 10-yen coin diversion unit 440*e* and a 500-yen coin diversion unit 440*f*. To each of the diversion units 438 through 440, a diversion hole 441 is provided for dropping and diverting the corresponding coins into the unit 438 through 440. More specifically, each of the rejected-coin diversion unit 438, diversion unit 439 for any given denomination of the coins and 5-yen coin diversion unit 440*a* is configured to compulsorily drop the coins into the diversion hole 441 by utilizing an electric driving means, such as a solenoid or the like. Meanwhile, the other diversion units 440*b* through 440*f* are arranged in such an order that the coins can be selectively dropped into each corresponding diversion hole 441, with the coin-roll radius increased as one goes from the upstream side unit 440*b* toward the downstream side unit 440*f*.

A return chute 442 adapted for guiding the rejected coins into a return slot 420 is provided to a lower portion of the rejected-coin diversion unit 438.

A chute 443 is provided to a lower portion of the diversion unit 439 for any given denomination of the coins, and a chute 444 for collecting the coins into a bag and a chute 445 for directly wrapping the coins are provided to a lower portion of the chute 443, respectively. Additionally, a switching plate 446 is provided for selectively guiding the coins from the chute 443 into either one of the chute 444 for collecting the coins into the bag or chute 445 for directly wrapping the coins. The chute 444 for collecting the coins into the bag serves to guide and store the coins into the bag attached to a bag attachment member (not shown) provided to a front face of the body 411.

The escrow unit 413 is arranged to extend backward in the body 411, corresponding to each denomination of the coins. Namely, the escrow unit 413 is configured to receive the coins diverted for each denomination thereof by the diversion unit 440 and then store the coins for each denomination thereof. Specifically, the escrow unit 413 includes a plurality of escrow cylinders 449, each provided for each denomination of the coins, and a bottom plate 450 adapted for collectively opening and closing bottom faces of the escrow cylinders 449. The escrow cylinder 449 and bottom plate 450 can be independently moved in the width direction of the body 411, by means of transfer mechanisms 451, 452, respectively.

As shown in FIG. 34, the coins can be escrowed when each escrow cylinder 449 is located below the diversion unit 440 for each denomination of the coins along the sorting path 436 and the bottom face of each escrow cylinder 449 is closed by the bottom plate 450. In the case of storing the escrowed coins, only the escrow cylinders 449 are moved in the left direction toward a region above the coin storage and feed-out unit 414, and then the bottom face of each escrow cylinder 449 is opened to release the coins escrowed in the cylinder 449 into the coin storage and feed-out unit 414. Meanwhile, in the case of returning the escrowed coins, only the bottom plate 450 is moved leftward from a region above the return box 415, and then the bottom face of each escrow cylinder 449 is opened to release the coins escrowed in the cylinder 449 into the return box 415.

The coin storage and feed-out unit 414 extends backward in the body 411, corresponding to each denomination of the coins. Specifically, the coin storage and feed-out unit 414 includes a plurality of coin storage units 456, each adapted for receiving and storing therein the coins released from the escrow unit 413, for each denomination of the coins, and a plurality of coin feed-out units 457, each adapted for feeding out the coins, one by one, from a bottom portion of each corresponding coin storage unit 456.

For instance, each coin feed-out unit 457 includes a feed-out rotary disk 458 having a plurality of feed-out holes formed therein. In this case, each feed-out hole is configured to allow only one coin to enter therein. Accordingly, with the rotation of the feed-out rotary disk 458, the coins respectively getting in the feed-out holes can be fed out, one by one, from the periphery to the outside of the rotary disk 458.

On one side of the coin storage and feed-out unit 414, a conveyor 459 extends backward in the body 411. The conveyor 459 is configured to receive the coins fed out from a lower portion of the coin storage and feed-out 414. In a central region of the conveyor 459, a disbursing mechanism 460 adapted for disbursing the coins from the conveyor is provided. On a front end side of the conveyor 459, a reversal roller (not shown) adapted for arranging the coins into one layer and one line, and a dispense recognition unit 461 adapted for recognizing each coin arranged in the one layer and one line are provided, respectively. Upon wrapping the coins, the coins fed out in a forward region relative to the central region of the conveyor 459 can be disbursed from the conveyor 459, with transportation of the coins toward the central region of the conveyor 459 and actuation of the disbursing mechanism 460. Meanwhile, the coins fed out in a backward region relative to the central region of the conveyor 459 can be disbursed from the conveyor 459, with the transportation of the coins toward the central region of the conveyor 459 and actuation of the disbursing mechanism 460. In this way, the coins disbursed form the conveyor 459 can be fed into the wrapping unit 417 through a chute 462, respectively.

Meanwhile, upon dispensing or recovering the coins, the coins received on the conveyor 459 are transported forward, then recognized by the dispense recognition unit 461, and finally fed into the dispensing box 421 through a chute 463.

The return box 415 is configured to extend backward in the body 411 and detachably provided to the front face of the body 411.

To the wrapping unit 417, a wrapping rotary disk 465 and a wrapping coin path 466 are provided, respectively. The wrapping rotary disk 465 is configured to receive the coins fed out from the coin feed-out unit 414 and then guided by the chute 462 or coins diverted by the diversion unit 439 for any given denomination of the coins and then guided by the chute 445 for directly wrapping the coins. The wrapping coin path 466 serves to receive and transport the coins fed out, one by one, by the rotation of the wrapping rotary disk 465. To the wrapping coin path 466, a transport belt 467 adapted for transporting the coins is provided. The width of the wrapping coin path 466 can be optionally controlled, corresponding to each predetermined denomination of the coins to be wrapped. This can prevent inadvertent advancement into the wrapping coin path 466 of the coins having a coin-roll radius greater than that of the coins of the predetermined denomination to be wrapped. Meanwhile, the coins having the coin-roll radius smaller than that of the coins of the predetermined denomination to be wrapped can be ejected from an eject slot (not shown) provided to a face of the wrapping coin patch 466. In this case, the coins ejected from the eject slot are collected in the recovery unit 422 through a chute 468.

Along the wrapping coin path 466, a sensor adapted for detecting the number and/or passage of the transported coins, and a stopper or the like are provided, respectively. In this case, if the sensor detects the last coin of the predetermined number of coins to be stacked, during the transportation of the coins from the wrapping coin path 466 to a downstream region thereof, then the stopper stops the transportation of the coins following the last coin, based on the detection of the sensor.

In a downstream region of the wrapping coin path 466, a stacking unit 469 is provided for stacking the coins fed therein from the wrapping coin path 466. This stacking unit 469 can serve to stack the predetermined number of coins, upward, one on another. Specifically, the stacking unit 469 is formed to extend upward in a substantially vertical direction relative to a stacking bottom plate (not shown). The stacking bottom plate is placed among three wrapping rollers 471 of a wrapping mechanism 470 and arranged to be flush with the face of the wrapping coin path 466. In a lower portion of the stacking unit 469, a stacking roller (not shown) is provided to project upward from the stacking bottom plate. With the rotation of the stacking roller, the coins fed from the wrapping coin path 466 can be taken into the lower portion of the stacking unit 469. At this time, a back end in the feed direction of each coin taken into the stacking unit 469 is somewhat raised from the face of the wrapping coin path 466 as well as a top face of the stacking bottom plate. Thus, the distal end of each coin further fed into the stacking unit 469 can get into a space formed under the raised back end of each coin previously taken into the lower portion of the unit 469. In this way, the coins can be stacked upward, one on another, in the stacking unit 469.

In the wrapping mechanism 470, the predetermined number of stacked coins are first pushed upward to a predetermined wrapping position by a support rod (not shown) that is configured to project upward from a bottom plate of the path, and then rotated, with the circumferential face of the stacked coins grasped or held by the three wrapping rollers 471. Then, wrapping paper is wrapped around the stacked coins, with each end of the wrapping paper caulked against each corresponding end face of the stacked coins. In this manner, the coin-roll 416 can be formed.

Namely, in the wrapping unit 417, the place for stacking the coins and the place for wrapping the stacked coins are located in the same position.

It is noted that the bottom plate of the path, stacking rollers, support rod and the like can be retracted from each corresponding lower position of the stacking unit 469, respectively, thereby allowing the formed coin-roll 416 to be released downward.

A coin-roll chute 472 is provided below the stacking unit 469. Initially, this coin-roll chute 472 receives each coin-roll 416 released from the wrapping unit 417, with the longitudinal direction (or stacked direction) of the coin-roll 416 kept in the vertical direction. Then, the coin-roll chute 472 guides the coin-roll 416, while rolling the coin-roll 416 forward as well as changing the longitudinal direction of the coin-roll 416 into the horizontal and parallel direction relative to the front face of the body 411. On a distal end side of the coin-roll chute 472, a lateral transport unit 473 is provided together with a switching unit 474. The switching unit 474 can serve to switch a release operation and a release-restriction operation, for each coin-roll 416 released from the lateral transport unit 473 toward the coin-roll transport unit 419 located in front of the lateral transport unit 473.

The lateral transport unit 473 is used for transport the coin-rolls 416 between the body 411 and a coin-roll storage apparatus, while the coin-roll storage apparatus is separately provided on one side of the body 411.

A plurality of coin trays 477, each adapted for storing therein a plurality of coin-rolls 416, for each denomination of the coins, are provided to the coin-roll storage and feed-out unit 418. The plurality of coin trays 477 are arranged on a plurality of stages, while being inclined downward and forward, respectively. Each coin tray 477 is configured to extend backward in the body 411 and serves to store therein the plurality of coin-rolls 416. Specifically, in each coin tray 477, the coin-rolls 416 are arranged backward in the body 411, with the longitudinal direction of each coin-roll 416 kept horizontal and parallel relative to the front face of the body 411. Further, the downward inclination of each coin-roll tray 477 can allow the coin-rolls 416 arranged therein to be naturally moved forward. In addition, each coin-roll tray 477 can be moved in the inclined direction thereof between an advanced position in which a front end of the coin-roll tray 477 is advanced up to the coin-roll transport unit 419 and a retracted position in which the coin-roll tray 477 is retracted a distance from the advanced position.

Between the coin-roll trays 477 and the coin-roll transport unit 419, a stopper 479 is provided to be vertically movable in front of the coin-roll trays 477. The stopper 479 has a plurality of stopper members 478, each corresponding to one coin-roll tray 477. When the stopper 479 is in a lowered position, each stopper member 478 is in contact with the forefront coin-roll 416 of the corresponding coin-roll tray 477 moved in its advanced position. However, when the stopper 479 is in an elevated position, each stopper member 478 is no longer contacted with the coin-roll 416 of the corresponding coin-roll tray 477 in the advanced position.

The coin-roll transport unit 419 has a coin-roll transport belt 482 adapted for transporting each coin-roll 416, with the longitudinal direction of the coin-roll 416 kept horizontal and parallel relative to the front face of the body 411. The coin-roll transport belt 482 is provided between two, upper and lower, rollers 483, so that the belt 482 can be vertically rotated. To an outer circumferential face of the coin-roll transport belt 482, a plurality of coin-roll support members 484, each configured to support and transport each coin-roll 416, are provided to project outward. Further, a guide member 485 is provided around the coin-roll transport belt 482, such that each coin-roll 416 can be guided between the guide member 485 and the coin-roll transport belt 482.

Now, storage operation for the coin-rolls 416 into the coin-roll trays 477 and feed-out operation for the coin-rolls 416 from the coin-roll trays 477, by using the coin-roll tray 477, stopper 479 and coin-roll transport unit 419 will be discussed, respectively.

Upon storing each coin-roll 416 into one of the coin-roll tray 477, the coin-roll 416 wrapped in the wrapping unit 417 and then released forward is first transported upward by the coin-roll transport belt 482, while being supported by each corresponding support member 484 of the coin-roll transport belt 482. Then, once the coin-roll 416 is moved upward to pass through the coin-roll tray 477 for storing the coin-roll 416 therein, the coin-roll tray 477 for storing the coin-roll 416 therein is advanced. At this time, the forefront coin-roll 416 already stored in the coin-roll tray 477 is held by the stopper member 478 of the stopper 479 moved in its lowered position. In this way, a space for newly storing therein the coin-roll 416 can be formed in a foremost portion of the advanced coin-roll tray 477. Thereafter, when the coin-roll belt 482 is lowered, the coin-roll 416 supported by the support member 484 of the coin-roll transport belt 482 will be lowered and thus transferred into the space formed in the foremost portion of the coin-roll tray 477. Then, the coin-roll tray 477 is retracted.

Meanwhile, upon feeding out the coin-rolls 416 from each coin-roll tray 477, the coin-roll tray 477 is advanced, while the stopper 479 is moved to the elevated position for preventing the contact between the stopper members 478 of the stopper 479 with the coin-rolls 416. As a result, each support member 484 of the coin-roll transport belt 482 can pick up the forefront coin-roll 416 of the corresponding coin-roll tray 477. Then, the coin-roll tray 477 is retracted.

In a forward region relative to the coin-roll transport belt 482, the coin-roll outlet 423, coin-roll collective storage unit 424 and coin-roll release slot 425 are provided, respectively. Corresponding to each position of these parts 423 through 425, switching plates 486, 487, 488 are arranged, respectively. Such switching plates 486, 487, 488 can serve to selectively feed the coin-rolls 416 transported by the coin-roll transport belt 482, into the coin-roll outlet 423, coin-roll collective storage unit 424 and coin-roll release slot 425, respectively.

The dispensing box 421 is detachably provided to the body 411. Further, a bottom plate 491 that can be optionally opened and closed is provided to the dispensing box 421. A recovery chute 492 is provided in a lower region relative to the place at which the dispensing box 421 is attached. This recovery chute 492 serves to guide the coins into the coin recovery unit 422, when the coins are released from the dispensing box 421 due to the opening of the bottom plate 491.

The recovery unit 422 is detachably provided to the body 411.

In addition, a return box 495 is juxtaposed with the recovery unit 422. In this case, upon wrapping the coins fed from the coin storage and feed-out unit 414, the coins ejected from the wrapping unit 417 through the chute 468 are recovered or collected in the recovery unit 422 due to actuation of a switching plate 496. Meanwhile, upon directly wrapping the coins, the coins ejected from the wrapping unit 417 through the chute 468 are stored in the return box 495 due to the switching plate 496. This return boxy 495 is detachably provided to the front face of the body 411.

Next, the terminal unit 330 provided to the money handling apparatus 300 as shown in FIG. 33 will be described.

The terminal unit 330 is composed of a display 332, such as an LCD or the like, a card reader/key boat unit 334, a printer 336, and a controller (not shown) incorporated in the terminal unit 330. For instance, when an ID card storing therein an individual ID of a specified clerk in a bank or the like is passed through a card reader of the card reader/key board unit 334, a user of the money handling apparatus 300 is recognized, then the depositing process, dispensing process, reconciliation process, bundling process and the like are displayed on the display 332.

One example for actually starting each of the above processes will be discussed below. First, when the ID card is passed through the card reader of the card reader/keyboard unit 334, the clerk using the money handling apparatus 300 is identified. Then, kinds of the processes that the clerk is allowed to do are displayed on the display 332. Thereafter, the process that the clerk wants to do is selected among the kinds of the processes displayed on the display 322, by using a key board of the card reader/keyboard unit 334. For instance, if the clerk wants to operate the apparatus to dispense 1,234,567 yen therefrom, then the clerk selects the dispensing process displayed on the display 332 and inputs the amount of the money. If the inputted amount of the money is correct, the clerk presses down an amount confirmation button provided to the card reader/key board unit 334. Once the amount confirmation button is pressed down, the banknote handling apparatus 310 and coin handling apparatus 320 are driven by the controller of the terminal unit 330 to respectively calculate the amount of the money to be handled. More specifically, the denominations and numbers of the banknotes respectively corresponding to 1,234,000 yen and the denominations and numbers of the coins respectively corresponding to 567 yen are calculated, respectively. Then, the banknote handling apparatus 310 and coin handling apparatus 320 will perform the dispensing process, based on the calculation results, respectively.

Upon the dispensing process, except for the case of automatically calculating the denominations and numbers of the money to be dispensed, the clerk may input the denominations and numbers of the money to be dispensed at a point of time that the clerk inputs the amount of the money to be dispensed.

Similarly, in the case of the depositing process, the banknotes and coins are separately inserted into the apparatuses 310, 320, and then the apparatuses 310, 320 perform the depositing process, respectively. In this case, at a point of time that the banknotes and coins are respectively escrowed in the escrow units of the apparatuses 310, 320, the controller of the terminal unit 330 calculates the total amount of the money and then drives the display 332 to display the total amount of the money thereon. If there is no error in the displayed total amount of the money, a deposit confirmation process is performed by the clerk. Then, the banknotes and coins escrowed in the escrow units of the apparatuses 310, 320 will be stored in the storage units of the apparatuses 310, 320, respectively.

As described above, with the provision of the terminal unit 330 in the money handling apparatus 300 including the banknote handling apparatus 310 and coin handling apparatus 320, both of the apparatuses 310, 320 can cooperate with each other in accordance with the operation of the terminal unit 330. Since both of the banknote handling apparatus 310 and coin handling apparatus 320 can be provided in a significantly compact form, the money handling apparatus 300 can also take a considerably compact form on the whole.

It should be construed that the specific construction and operation in each of the aforementioned embodiments (i.e., the first to third embodiments) are respectively shown and described by way of example, and hence there is no intent to limit the invention by such disclosure. Namely, the technical scope of this invention is indicated by the appended claims, and all of expressions and variations equivalent to the claims should be considered to fall within the scope of this invention.

The invention claimed is:

1. A banknote handling apparatus, comprising:

a casing;

an inlet configured for inserting banknotes into the casing from the exterior thereof;

a plurality of storages provided in a lower portion of the casing, in a substantially horizontal direction and in parallel relative to one another, and respectively adapted for storing therein the banknotes;

an escrow storage juxtaposed with the respective storages in the casing and adapted for escrowing therein the banknotes inserted into the casing from the exterior thereof through the inlet;

a transport unit provided above the respective storages and escrow storage in the casing and adapted for transporting the banknotes between any two of the inlet, storages and escrow storage; and a plurality of diverters respectively provided at diversion points in the transport unit toward the respective storages and escrow storage, and adapted for diverting the banknotes transported by the transport unit into a specified storage or escrow storage, wherein the escrow storage is configured to temporarily store therein all the deposited banknotes and to feed out the stored banknotes to the storage, and wherein the plurality of storages and the escrow storage are arranged in a horizontal direction in the casing.

2. The banknote handling apparatus according to claim 1, wherein the escrow storage has substantially the same capacity as the capacity of each of the storages.

3. The banknote handling apparatus according to claim 1, wherein the transport unit has a transport path defined as a laterally elongated loop that is located above the respective storages and escrow storage.

4. The banknote handling apparatus according to claim 3, wherein the transport unit further includes a plurality of diversion transport paths, each branched downward from the transport path and connected with each of the storages and escrow storage.

5. The banknote handling apparatus according to claim 4, wherein each diverter is composed of a diversion claw provided to each diversion point at which the diversion transport path is branched from the transport path, and wherein the diverter composed of the diversion claw can be rotated about a shaft, whereby the banknotes transported by the transport unit can be diverted into the specified storage or escrow storage, due to the rotation of the diverter corresponding to the storage or escrow storage to which the banknotes are to be fed, upon feeding the banknotes transported in the transport path into each of the storages or escrow storage.

6. The banknote handling apparatus according to claim 1, further comprising:

a bundling unit provided above the transport unit in the casing and adapted for bundling the banknotes transported from the transport unit; and a bundled-banknote outlet provided in the vicinity of the inlet and configured for dispensing bundled banknotes bundled by the bundling unit to the exterior of the casing.

7. The banknote handling apparatus according to claim 1, further comprising:

a bundling unit provided in the casing and adapted for bundling a plurality of loose banknotes accumulated in a stacked condition; and a bundled-banknote outlet configured for dispensing the bundled-banknotes bundled by the bundling unit to the exterior of the casing, wherein a plurality of batches of the bundled-banknotes can be accumulated in the bundled-banknote outlet.

8. The banknote handling apparatus according to claim 7, wherein an opening configured for allowing the bundled banknotes to be taken out therefrom is provided to the bundled-banknote outlet, and a shutter mechanism adapted for opening and closing the opening is provided to the opening, and wherein the shutter mechanism is configured not to open the opening of the bundled-banknote outlet until a predetermined number of bundled banknotes are accumulated in the bundled-banknote outlet.

9. The banknote handling apparatus according to claim 7, wherein the bundling unit includes a stacking unit adapted for accumulating therein the plurality of loose banknotes in the stacked condition, a bundling mechanism adapted for bundling the plurality of loose banknotes accumulated in the stacked condition, and a transport arm adapted for transporting the plurality of loose banknotes accumulated in the stacked condition from the stacking unit to the bundling mechanism, while transporting the bundled banknotes bundled by the bundling mechanism from the bundling mechanism to the bundled-banknote outlet, and wherein the transport arm is located in a substantially central position of the bundling unit, while the stacking unit, bundling mechanism and bundled-banknote outlet are arranged around the transport arm, respectively, such that the transport arm is movable between any two of the stacking unit, bundling mechanism and bundled-banknote outlet.

10. The banknote handling apparatus according to claim 9, wherein the bundled-banknote outlet includes a mounting mechanism adapted for placing thereon the plurality of batches of the bundled banknotes and a lifting and lowering table provided below the mounting mechanism and configured to be vertically movable, wherein the bundled banknotes are first transferred from the transport arm onto the lifting and lowering table at a point below the mounting mechanism, then the lifting and lowering table is elevated and reaches the mounting mechanism, whereby the bundled banknotes on the lifting and lowering table can be transferred onto the mounting mechanism.

11. The banknote handling apparatus according to claim 10, wherein the mounting mechanism is composed of claws, each provided to be upwardly rotatable about a shaft from a state extending in a substantially horizontal direction, wherein when no force is applied to each claw from below, the claws extend in the substantially horizontal direction, while one or more batches of the bundled banknotes can be placed on the claws extending in the substantially horizontal direction, and wherein when the lifting and lowering table reaches the mounting mechanism, the bundled-banknotes on the lifting and lowering table pushes and rotates each claw upward, whereby the bundled banknotes on the lifting and lowering table and the bundled banknotes placed on the mounting mechanism can be overlapped with one another, and thereafter, when the lifting and lowering table is lowered, the bundled banknotes on the lifting and lowering table can be transferred onto the mounting mechanism.

12. The banknote handling apparatus according to claim 7, wherein the bundled-banknote outlet includes a mounting mechanism adapted for placing thereon the plurality of batches of the bundled banknotes and a lifting and lowering table provided below the mounting mechanism and configured to be vertically movable, wherein when the lifting and lowering table is elevated and reaches the mounting mechanism, the bundled banknotes on the lifting and lowering table are transferred to the mounting mechanism, and wherein a restricting member adapted for restricting upward movement of the bundled banknotes is provided to a top portion of the bundled-banknote outlet in a position opposite to the lifting and lowering table.

13. The banknote handling apparatus according to claim 1, wherein the banknote handling apparatus is adapted for dispensing a predetermined number of banknotes for each dispensing process, and further comprises:

an escrow stage adapted for stacking therein the loose banknotes;

a bundling unit adapted for bundling a predetermined number of loose banknotes stacked in the escrow stage, so as to form the bundled banknotes;

an outlet configured for dispensing the predetermined number of loose banknotes; and a control unit adapted for feeding out the loose banknotes stored in the storages and stacking them in the escrow stage, then transporting the loose banknotes stacked in the escrow stage to the bundling unit, and thereafter feeding out the loose banknotes, corresponding to a fraction less than the predetermined number of the banknotes to be bundled, from the storages and transporting them to the outlet.

14. The banknote handling apparatus according to claim 13, wherein the inlet and outlet are provided in an integrated form.

15. The banknote handling apparatus according to claim 13, wherein the control unit is adapted for feeding out the loose banknotes corresponding to the fraction from the storages and transporting them to the outlet if the bundled banknotes formed by the bundling unit is a last batch.

16. The banknote handling apparatus according to claim 13, wherein the control unit is adapted for feeding out the fraction of the banknotes from the storages and transporting them to the outlet, during a period of time after the loose banknotes stacked in the escrow stage are transported to the bundling unit and before next loose banknotes are stacked in the escrow stage, in the case in which the plurality of batches of the bundled banknotes are formed by the bundling unit.

17. The banknote handling apparatus according to claim 15, wherein the banknote handling apparatus further comprises an operation unit adapted for receiving instructions for a dispensing process, including the number of the banknotes to be dispensed, the amount of money of the banknotes to be dispensed and the number of the bundled banknotes, and wherein the control unit is adapted for judging whether or not the bundled banknotes formed by the bundling unit corresponds to the last batch, based on the number of the bundled banknotes received by the operation unit.

18. The banknote handling apparatus according to claim 15, wherein the banknote handling apparatus further comprises a recognition unit adapted for recognizing the denomination and number of the loose banknotes fed out from the storages, and wherein the control unit is adapted for judging whether or not the bundled banknotes formed by the bundling unit is the last batch, based on a recognition result of the recognition unit.

19. The banknote handling apparatus according to claim 13, wherein the banknote handling apparatus further comprises:

a transport arm adapted for transporting the predetermined number of banknotes stacked in the escrow stage to the bundling unit; and a transport arm detector adapted for detecting the position of the transport arm, wherein the control unit is adapted for feeding out the fraction of the loose banknotes from the storages and transporting them to the outlet, at least during a period of time that the transport arm detector detects that the transport arm is out of a predetermined range from the escrow stage, in the case in which the predetermined number of loose banknotes stacked in the escrow stage are transported to the bundling unit.

* * * * *